US006332743B1

(12) United States Patent
Park et al.

(10) Patent No.: US 6,332,743 B1
(45) Date of Patent: Dec. 25, 2001

(54) ELEVATOR TYPE PARKING SYSTEM

(75) Inventors: Tae-Weon Park, Masan; Oh-Yeong Kong; Seon-Sun Lee, both of Changwon; Jae-Whan Kim, Jinju, all of (KR)

(73) Assignee: LG Industrial Systems Co., Ltd., Seoul (KR)

( * ) Notice: Subject to any disclaimer, the term of this patent is extended or adjusted under 35 U.S.C. 154(b) by 0 days.

(21) Appl. No.: 09/185,750

(22) Filed: Nov. 4, 1998

(30) Foreign Application Priority Data

Nov. 6, 1997 (KR) ..... 97/58480
Nov. 6, 1997 (KR) ..... 97/58481
Nov. 6, 1997 (KR) ..... 97/58482
Nov. 6, 1997 (KR) ..... 97/58487

(51) Int. Cl.[7] ..... E04H 6/12
(52) U.S. Cl. ..... 414/234; 414/239; 414/254
(58) Field of Search ..... 414/233, 234, 414/239, 240, 241, 253, 254, 259, 260

(56) References Cited

U.S. PATENT DOCUMENTS 3,674,158 * 7/1972 Owen ..... 414/234
4,936,730 * 6/1990 Morioka ..... 414/239
4,950,117 * 8/1990 Go ..... 414/253 X
5,049,022 * 9/1991 Wilson ..... 414/253
5,267,822 * 12/1993 Paravia et al. ..... 414/234 X
5,314,284 * 5/1994 Tsai ..... 414/234
5,330,305 * 7/1994 Go ..... 414/254
5,333,987 * 8/1994 Takaoka ..... 414/253 X
5,374,150 * 12/1994 Becker et al. ..... 414/254
5,383,757 * 1/1995 Takaoka et al. ..... 414/240
5,868,540 * 2/1999 Hirose et al. ..... 414/234
5,915,907 * 6/1999 Yatou et al. ..... 414/254

FOREIGN PATENT DOCUMENTS

2244267 * 11/1991 (GB) ..... 414/240
2176078 * 7/1990 (JP) ..... 414/254
2311674 * 12/1990 (JP) ..... 414/254
4005376 * 1/1992 (JP) ..... 414/234
4343981 * 11/1992 (JP) ..... 414/234

* cited by examiner

*Primary Examiner*—James W. Keenan

(57) ABSTRACT

An elevator type parking system is disclosed. The system includes a main frame having a plurality of vertical columns and horizontal columns for forming a hoist way in a center portion thereof a plurality of parking rooms at both sides of the hoist way, a lift movable along the hoist way formed in the main frame, a lift lifting and lowering drive unit for lifting and lowering the lift, a parking unit installed in each floor of the parking room and being horizontally movable, a parking unit actuating unit installed on the lift for horizontally pulling the parking unit from the parking room to the hoist way and pushing the same from the hoist way to the parking room, a driven unit fixed to the parking unit and driven by the parking means actuating unit for thereby horizontally moving the parking unit.

23 Claims, 58 Drawing Sheets

ELEVATOR TYPE PARKING SYSTEM

BACKGROUND OF THE INVENTION

1. Field of the Invention

The present invention relates to an elevator type parking system, and in particular to an improved elevator type parking system which is capable of horizontally moving a parking means of each parking room between the parking room and a hoist way by one driving means installed on the lift for thereby increasing a productivity of a system and decreasing the manufacturing cost as well as decreasing time required for a loading and unloading operation of a vehicle by horizontally moving a corresponding pallet without an additional operation when a lift arrives at a designated pallet position by operating a pallet horizontal movement unit when a lift is lifted and lowered.

2. Description of the Conventional Art

Generally, the conventional elevator type parking system is formed of a tower type structure in which a hoist way is formed in the center portion of the same and a plurality of parking rooms are formed at both sides of the hoist way. In this system, the lift is lifted and lowered through the hoist way, and the vehicles are parked at the parking rooms and are unloaded from the parking rooms.

As one of the conventional elevator type parking system, "a pallet horizontally lifting and lowering parking system" of Korean Utility Model Laid-upon No. 92-18228 is disclosed.

In the above-described system, a lift is fixed to one end of a chain wound on a sprocket driven by a driving motor, and a balance weight is fixed to the other end of the chain, so that the lift and balance weight fixed to both ends of the chain are upwardly and downwardly moved by the driving operation of the driving motor. A pallet support member supporting the parking pallet is installed on each floor of the parking room for loading the vehicle.

In the conventional pallet horizontally lifting and lowering parking system, when loading the vehicle, am empty lift is loaded by the driving operation of the driving motor and is moved to a position lower than the pallet of the designated floor, and then the pallet is moved above the lift by a pallet horizontal movement unit disposed in the lift, and the lift is lowered onto the drive-in/out floor. Thereafter, a vehicle is loaded on the pallet on the lift. The lift is moved to a designated floor, and then the pallet on which the vehicle is loaded is placed on the pallet support member, and the lift is lowered onto the drive-in/out floor for thereby completing a parking operation of the system.

When unloading the vehicle, an empty lift is moved to a position lower than the pallet of the designated floor, and the pallet on which the vehicle is loaded is moved above the lift by the horizontal movement unit, and then the lift is lowered. In this state, when a driver drives in, the lift is moved to the designated floor, and the pallet is placed on the pallet support member by the horizontal movement unit for thereby lowering the lift onto the drive-in/out floor and completing a parking operation of the system.

However, in the above-described conventional pallet horizontally lifting and lowering parking system, the lift positioned on the drive-in/out floor is moved to the position of the pallet of the designated floor, and then the pallet on the designated floor is horizontally moved and is placed on the lift. In this state, the lift is lifted or lowered onto the drive-in/out floor. Thereafter, the lift is lifted and lowered, and then the pallet on which the vehicle is placed is moved to the designated floor. In addition, the lift returns to the drive-in/out floor. When unloading the vehicle, the lift on the drive-in/out floor is moved to the position of the pallet on the designated floor, and the pallet on the designated floor on which the vehicle is placed is horizontally moved and then is placed on the lift. The lift is lowered onto the drive-in/out floor for thereby unloading the vehicle. The lift is lifted and lowered, and the pallet placed on the lift is moved to the designated floor. Thereafter, the lift should be returned to the drive-in/out floor, so that the time required for the vehicle loading and unloading operation is significantly increased.

In addition, as another one of the conventional elevator type parking system, "a pallet horizontally lifting and lowering parking system" of Korean Patent Laid-upon No. 94-7326 is disclosed.

In this parking system, a rotation support member is disposed in the lift of the parking system, so that the vehicle becomes rotatable when loading and unloading the vehicle. However, the above-described conventional pallet horizontally lifting and lowering parking system includes an operation of a pallet horizontally lifting and lowering parking system as well as a function for changing the direction of the vehicle by rotating the vehicle on the pallet on the lift on the drive-in/out floor. The other features are the same as the previously explained pallet horizontally lifting and lowering parking system. Therefore, the time required for loading and unloading the vehicle is significantly increased like the previously explained conventional pallet horizontally lifting and lowering parking system.

There is another conventional art of "Pallet horizontal movement/lift lifting and lowering type parking system" of Korean Patent Laid-upon No. 91-8092.

In this elevator type parking system, a plurality of lift forks and pallet forks are alternately formed from each other in the lift and pallet so that the lift forks and pallet forks do not interfered with each other when the lift and pallet are passing through each other. Therefore, the lift is only lifted and lowered, and the pallet is only horizontally moved for thereby implementing a loading and unloading operation of the vehicle.

Namely, in the above-described conventional pallet horizontal movement/lift lifting/lowering parking system, when loading the vehicle, a user drives into the lift placed on the drive-in/out floor. When wheels of the vehicle are placed on the lift forks of the lift, the lift is lifted and lowered and is moved to a position higher than the designated floor pallet of the parking room. Therefore, the pallet horizontal movement unit installed in each pallet is moved for thereby moving the pallet below the lift.

Next, in this state, the lift is lowered, and the wheels of the vehicle on the lift forks are placed on the pallet forks.

At this time, since the lift forks and pallet forks are formed to alternately pass through each other, when the lift is lowered. The lift forks of the lift downwardly pass through the pallet forks of the pallet.

The pallet horizontal movement unit is operated, and the pallet on which the vehicle is placed is horizontally moved, so that the lift is moved to the drive-in/out floor for thereby completing the vehicle loading operation.

When unloading the vehicle, the lift is moved to a position lower than the pallet on the designated floor of the parking room, and the pallet horizontal movement unit is operated, and the pallet on the designated floor is horizontally moved above the lift. In this state, the lift is lifted, and the vehicle placed on the pallet forks of the pallet is placed on the lift forks of the lift.

The pallet horizontal movement unit is operated, and the pallet is moved to the parking room. Thereafter, the lift is lifted and lowered for thereby moving the same to the drive-in/out floor, so that the unloading operation of a vehicle is completed.

However, in the above-described pallet horizontal movement/lift lifting/lowering parking system, since the pallet is not moved between the parking room and drive-in/out floor.

Instead, it is horizontally moved in only the parking room. Therefore, the time required for a loading and unloading operation of the vehicle may be advantageously decreased, but since the pallet horizontal movement unit horizontally moving the pallet is additionally installed in each parking room of the floor, the assembling productivity of the parking system is decreased, and the fabrication cost is increased.

In addition, when the lift arrives at the position of the pallet of the designated floor, since the pallet is engaged with the pallet horizontal movement unit in a state that the pallet is horizontally movable, the operation time is extended.

Furthermore, in the conventional parking system, in a state that the pallet is horizontally moved in a position matching with the parking room or the lift, the pallet may be movable and may be moved from the normal position thereby decreasing the operational safety and causing an accident.

In a state that the lift is lowered to a position matching with the turntable, when a driver drives in or out, during the operation that the vehicle passes through the front side of the lift, the weight of the vehicle is not uniformly applied to a predetermined front portion of the lift, so that the lift becomes unbalanced. In this case, excess weight is applied to the lifts lifting and lowering drive unit likely causing an unbalance of the lift.

SUMMARY OF THE INVENTION

Accordingly, it is an object of the present invention to provide an elevator type parking system which overcomes the aforementioned problems encountered in the conventional art.

It is a first object of the present invention to provide an elevator type parking system which is capable of horizontally moving a pallet for overcoming the problem of extended loading and unloading time in a parking system in which the pallet is horizontally moved and is lifted and lowered, and is capable of horizontally moving the pallet of each parking room based on one parking unit drive unit installed in the lift without installing a horizontal driving unit of the pallet in each floor of the parking room for thereby enhancing a productivity of the system and decreasing the fabrication cost.

It is a second object of the present invention to provide an elevator type parking system which is capable of implementing a lift lifting and lowering operation at the time when the parking unit drive unit and the parking unit are engaged in a state that the parking unit is horizontally movable by the parking unit drive unit installed in the lift and is capable of directly horizontally moving the pallet without an additional operation when the lift arrives at the position of the pallet of the designated floor for thereby decreasing the time required for the loading and unloading operation.

It is a third object of the present invention to provide an elevator type parking system which is capable of implementing a loading and unloading operation with respect to the parking room below the drive-in/out floor by adapting to an upper portion drive-in type or intermediate portion drive-in type parking system in which the drive-in/out floor of the vehicle, namely, the lobby of the parking system is installed at an upper portion or intermediate portion of the parking system and is capable of changing the park direction of the lift and vehicle on the drive-in/out floor without moving the lift and vehicle to the bottom floor for changing the park direction of the vehicle for thereby decreasing the time required for the loading and unloading operation of the system.

It is a fourth object of the present invention to provide an elevator type parking system which is capable of preventing excess load from being applied to the lift lifting and lowering drive unit by preventing the weight of the parking unit and vehicle from being applied to the lift when the parking unit on which the vehicle is loaded is horizontally moved toward the lift.

It is a fifth object of the present invention to provide an elevator type parking system which is capable of preventing shaking of the parking unit (pallet) in a state that the pallet is horizontally moved to the parking room and in a state that the pallet is horizontally moved toward the lift.

It is a sixth object of the present invention to provide an elevator type parking system which is capable of effectively implementing a horizontal movement of the parking unit (pallet).

It is a seventh object of the present invention to provide an elevator type parking system which is capable of providing a footboard unit on which a vehicle driver stands for getting into or getting out of the vehicle for thereby implementing a stable getting into and off operation.

It is an eighth object of the present invention to provide an elevator type parking system which is capable of preventing a biased load applied to the lift lifting and lowering drive unit by preventing an unbalance of the lift when loading and unloading the vehicle.

The first object of the present invention is implemented by a main frame having a plurality of vertical columns and horizontal columns for forming a hoist way in a center portion thereof, a plurality of parking rooms at both sides of the hoist way, a lift movable along the hoist way formed in the main frame, a lift lifting and lowering drive means for lifting and lowering the lift, a parking means installed in each parking room of each floor and being horizontally movable, a parking means actuating means installed on the lift for horizontally pulling the parking means from the parking room the hoist way or pushing the same from the hoist way to the parking room, and a drives means fixed to the parking means and driven by the parking means actuating means for thereby horizontally moving the parking means.

The second object of the present invention is implemented by horizontally moving the hooking member of the parking unit drive unit for being engaged with the hooking member of the driven unit before the lift arrives at a predetermined floor.

The third object of the present invention is implemented by a main frame having a plurality of vertical columns and horizontal columns for forming a hoist way in a center portion thereof a plurality of parking rooms at both sides of the hoist way, a lift movable along the hoist way formed in the main frame, a lift lifting and lowering drive means for lifting and lowering the lift, a parking means installed in each floor of the parking room and being horizontally movable, a parking means actuating means installed on the lift for horizontally pulling the parking means from the parking room to the hoist way and pushing the same from the hoist way to the parking room, a driven means fixed to the parking means and driven by the parking means actuating means for thereby horizontally moving the parking means, a turntable installed at a lobby floor, in which a vehicle drives in and out, for changing a park direction of the vehicle loaded thereon, and a turntable horizontal movement means for horizontally moving the turntable between the hoist way and the parking room.

The fourth object of the present invention is implemented by providing an elevator type parking system which is capable of horizontally moving the parking unit (pallet) in a state that the same is supported by the pallet horizontal movement guide rail installed in the pallet support member of the main frame and is capable of preventing over load from being applied to the lift lifting and lowering means by preventing the weight of the pallet and vehicle from being applied to the lift.

The fifth and sixth objects of the present invention are implemented by providing an elevator type parking system in which the roller is rotatably installed in the parking unit and the guide rail guiding the operation of the roller in the parking room and on the hoist way, forming the guide rail in a U shape, forming a stop groove on the bottom surface on which the roller slidably moves for stopping the movement of the roller, and installing a stopper and buffering member at the end portion spaced apart from the hoist way for stopping the over run of the roller.

The seventh object of the present invention is implemented by a main frame having a plurality of vertical columns and horizontal columns for forming a hoist way in a center portion thereof a plurality of parking rooms at both sides of the hoist way, a lift movable along the hoist way formed in the main frame, a lift lifting and lowering drive means for lifting and lowering the lift, a parking means installed in each floor of the parking room and being horizontally movable, a parking means actuating means installed on the lift for horizontally pulling the parking means from the parking room to the hoist way and pushing the same from the hoist way to the parking room, a driven means fixed to the parking means and driven by the parking means actuating means for thereby horizontally moving the parking means, a turntable installed at a lobby floor, in which a vehicle drives in and out, for changing a park direction of the vehicle loaded thereon, and a turntable horizontal movement means for horizontally moving the turntable between the hoist way and the parking room and a vertically movable footboard means including a footboard means installed in the lobby floor, on which footboard means a vehicle driver stands when getting into or off the vehicle in order to load or unload the vehicle from the lift or the turntable for thereby preventing a part of the driver body from falling down into the hoist way.

The eighth object of the present invention is implemented by a main frame having a plurality of vertical columns and horizontal columns for forming a hoist way in a center portion thereof a plurality of parking rooms at both sides of the hoist way, a lift movable along the hoist way formed in the main frame, a lift lifting and lowering drive means for lifting and lowering the lift, a parking means installed in each floor of the parking room and being horizontally movable, a parking means actuating means installed on the lift for horizontally pulling the parking means from the parking room to the hoist way and pushing the same from the hoist way to the parking room, a driven means fixed to the parking means and driven by the parking means actuating means for thereby horizontally moving the parking means, and a lift unbalance prevention means installed in a lobby floor of the main frame and being horizontally movable from a first position in which the lower portion of the lift is supported to a second position spaced-apart from the first position for preventing a unbalance of the lift due to a unbalanced load of the vehicle when the vehicle is loaded into or unloaded from the lift.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 1 through 15 are views illustrating an elevator type parking system according to a first embodiment of the present invention, of which:

FIG. 1 is a front view illustrating an elevator type parking system according to the present invention;

FIG. 2 is a plan view illustrating a lift and a parking unit of an elevator type parking system according to the present invention;

FIG. 3 is a plan view illustrating a parking unit and a turntable for an elevator type parking system according to the present invention;

FIG. 4 is a perspective view illustrating a lift and a parking unit and a lift lifting and lowering unit and a turntable for an elevator type parking system according to the present invention;

FIG. 5 is a perspective view illustrating a rear side of a lift for an elevator type parking system according to the present invention;

FIG. 6 is a side view illustrating a rear side of a lift for an elevator type parking system according to the present invention;

FIG. 7 is a front view illustrating a rear side of a lift for an elevator type parking system according to the present invention;

FIG. 8 is a front view illustrating a parking unit drive unit for an elevator type parking system according to the present invention;

FIG. 9 is a side view illustrating a parking unit drive unit for an elevator type parking system according to the present invention;

FIG. 10 is a perspective view illustrating a parking unit (pallet) for an elevator type parking system according to the present invention;

FIG. 11 is a plan view illustrating a parking unit horizontal movement guide unit for an elevator parking system according to the present invention;

FIG. 12 is a front view illustrating a parking unit horizontal movement guide unit for an elevator type parking system according to the present invention;

FIG. 13 is a perspective view illustrating a turntable for an elevator type parking system according to the present invention;

FIG. 14 is a front view illustrating a turntable for an elevator type parking system according to the present invention; and FIG. 15 is a plan view illustrating a turntable horizontal moving unit for an elevator type parking system according to the present invention;

FIGS. 28 through 34 are views illustrating a lift unbalance prevention unit for an elevator type parking system according to a second embodiment of the present invention, of which:

FIG. 28 is a plan view illustrating a lift and turntable and a lift unbalance prevention unit;

FIG. 29 is a side view illustrating a lift and turntable and a lift unbalance prevention unit;

FIG. 30 is a front view illustrating a lift and turntable and a lift unbalance prevention unit;

FIG. 31 is a plan view illustrating an arrangement between a lift and a lift unbalance prevention unit;

FIG. 32 is side view illustrating an arrangement between a lift and a lift unbalance prevention unit;

FIG. 33 is an enlarged side view illustrating a nonoperational state of a lift unbalance prevention unit;

FIG. 34 is an enlarged side view illustrating an operational state of a lift unbalance prevention unit;

FIGS. 39 through 46 are views illustrating an elevator type parking system according to a third embodiment of the present invention, of which:

FIG. 39 is a front view illustrating an elevator type parking system according to the present invention;

FIG. 40 is a cross-sectional view taken along the line A—A of FIG. 39;

FIG. 41 is a perspective view illustrating an elevator type parking system according to the present invention;

FIG. 42 is a view illustrating a state that a lift according to a third embodiment of the present invention reaches a designated floor pallet position in an elevator type parking system;

FIG. 43 is a view illustrating a state that a pallet for an elevator type parking system according to a third embodiment of the present invention is horizontally moved in the direction of a lift;

FIG. 44 is a cross-sectional view taken along the line B—B of FIG. 40;

FIG. 45 is a view illustrating an operational state that a vehicle is loaded in an elevator type parking system according to a third embodiment of the present invention; and FIG. 46 is a view illustrating an operational state that a vehicle is unloaded in an elevator type parking system according to a third embodiment of the present invention.

DETAILED DESCRIPTION OF THE PREFERRED EMBODIMENTS

Figure 1:
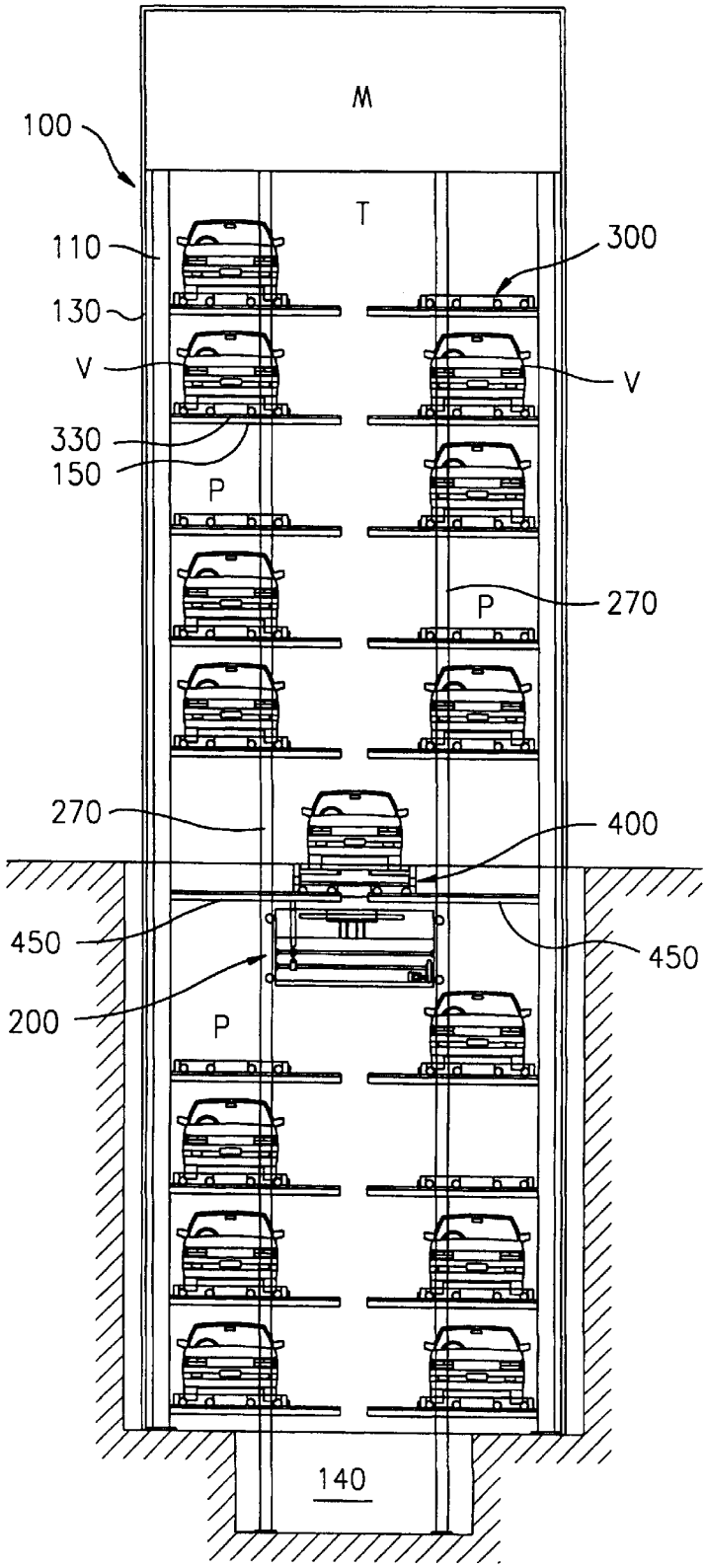

The elevator type parking system according to a first embodiment of the present invention will be explained with reference to the accompanying drawings.

As shown in FIGS. 1 through 4, the elevator type parking system according to the present invention includes a main frame 100 implemented by forming a hoist way T in a center portion of the system and a plurality of parking rooms P at both sides of the hoist way by assembling a plurality of vertical and horizontal columns 110 and 120, a lift 200 slidable along the hoist way T formed in the main frame, a lift lifting and lowering drive means for lifting and lowering the lift, a parking means (hereinafter called "pallet") 300 installed in each floor of the parking room P and being horizontally movable, a parking means drive means installed in the lift 200 for horizontally pulling the pallet 300 from the parking room to the hoist way and pushing the same from the lifting and lowering to the parking room, and a driven means fixed to the pallet 300 and driven by the parking means drive means for thereby horizontally moving the parking system.

Figure 3:
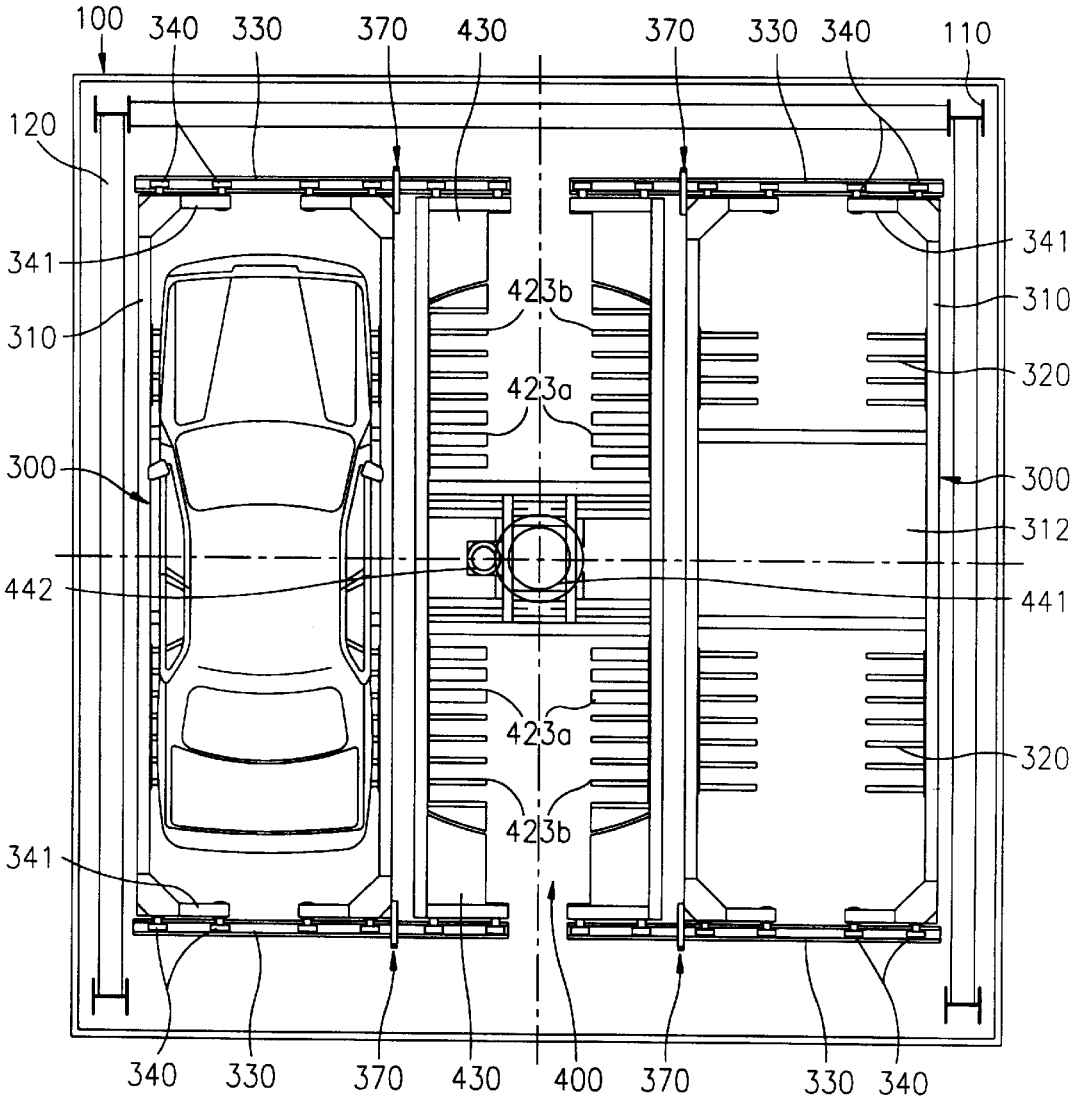
Figure 4:
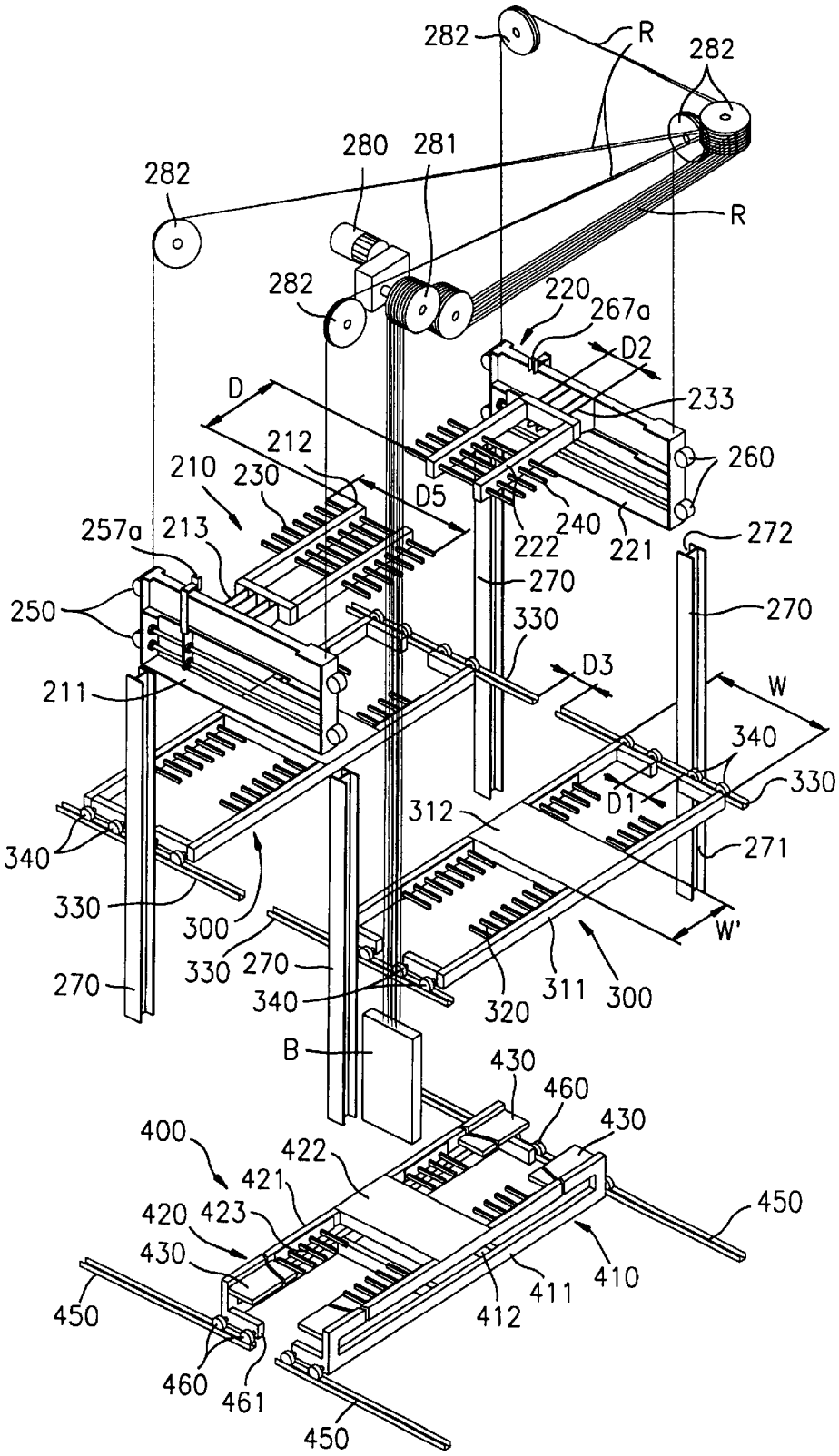

In addition, the parking system according to the present invention may be implemented by a turntable installed in the lobby floor of the hoist way T as shown in FIGS. 3 and 4.

Figure 2:
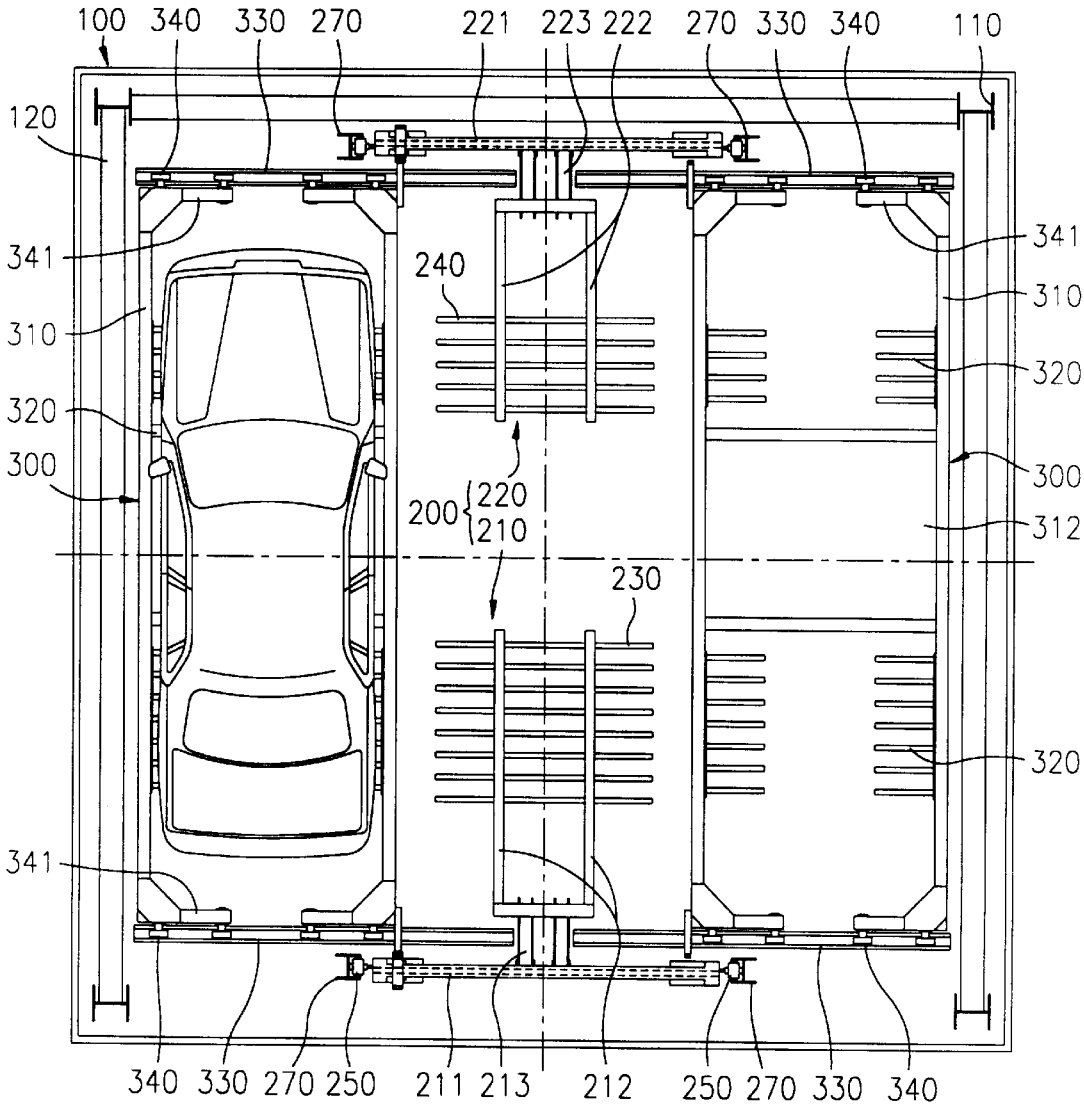

As shown in FIG. 2, the main frame 100 is installed between H-shaped four main columns 110 and includes horizontal support members 120 connecting an extra column (not shown) and a main column 110.

When the system according to the present invention is installed in an independent tower type, as shown in FIG. 1, the main frame 100 is covered by an outer plate 130, and when the system is installed in the building, the main frame 100 without the outer plate 130 is installed in the building.

In addition, when the outer plate 130 is installed, a drive-in/out port (not shown) is formed in the front side of the same for a car driving-in and driving-out operation. In the drive-in/out port, a door (not shown) is installed. When the outer plate 130 is not installed, a drive-in/out port is installed in the building, and a door is installed therein.

In the machinery compartment M, a lifting and lowering drive motor and a lift lifting and lowering drive unit having driving sheaves, and driven sheaves which are explained later are installed.

As shown in FIG. 1, the hoist way T is formed in the center portion between the bottom of the machinery compartment M formed in the uppermost portion of the main frame 100 and the lowermost portion of the main frame 100.

Pits 140 a re formed in the lowermost portion of the hoist way T for providing additional operation space when the lift 200 is moved to the lowermost portion.

A plurality of the parking rooms P are formed for each floor and are divided by the pallet support member 150 horizontally installed in the horizontal support member 120 of the main frame 100.

As shown in FIG. 2, the lift 200 is formed of a front side lift 210 near the inlet and outlet portion and a rear side lift 220 disposed further from the inlet and outlet port than the front side lift 210.

Figure 5:
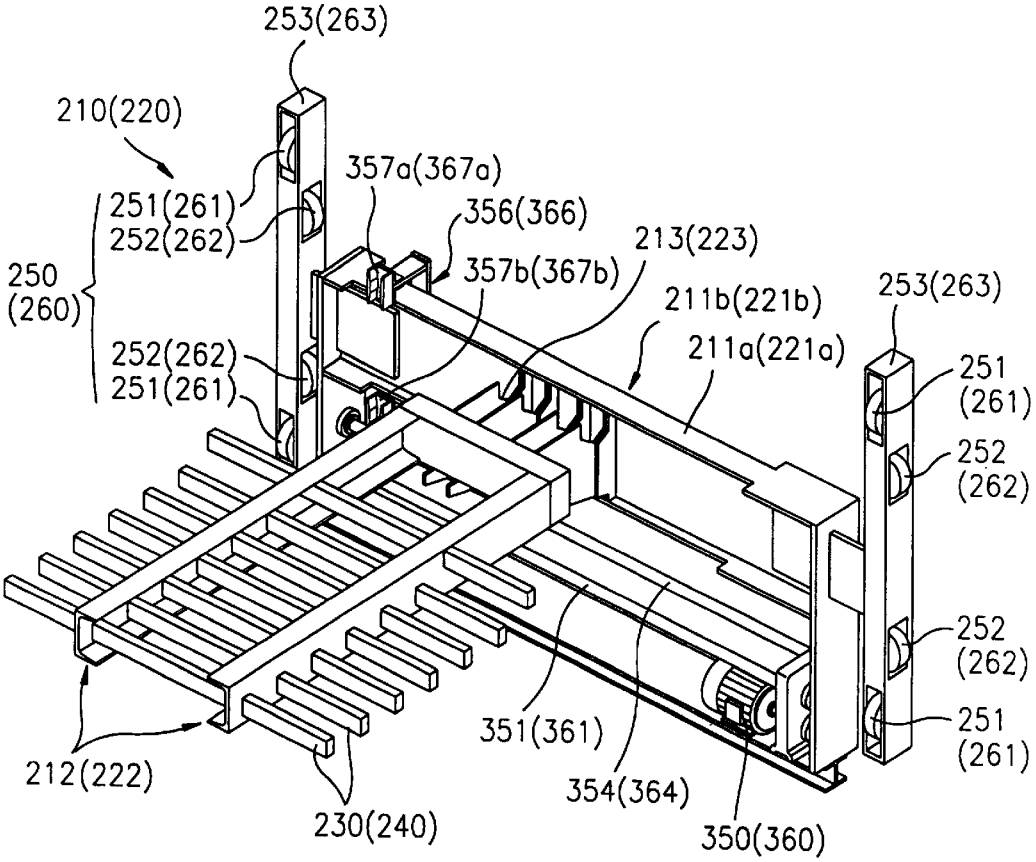
Figure 6:
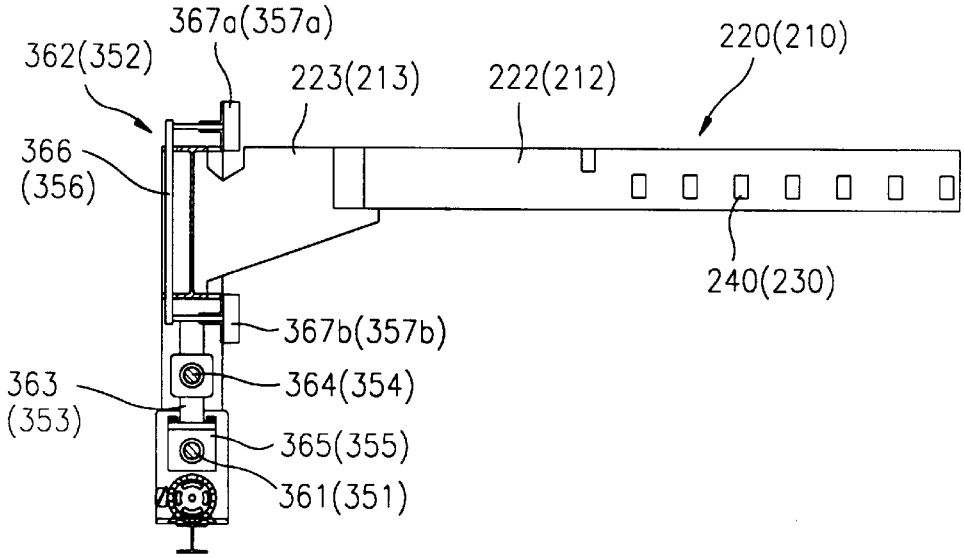
Figure 7:
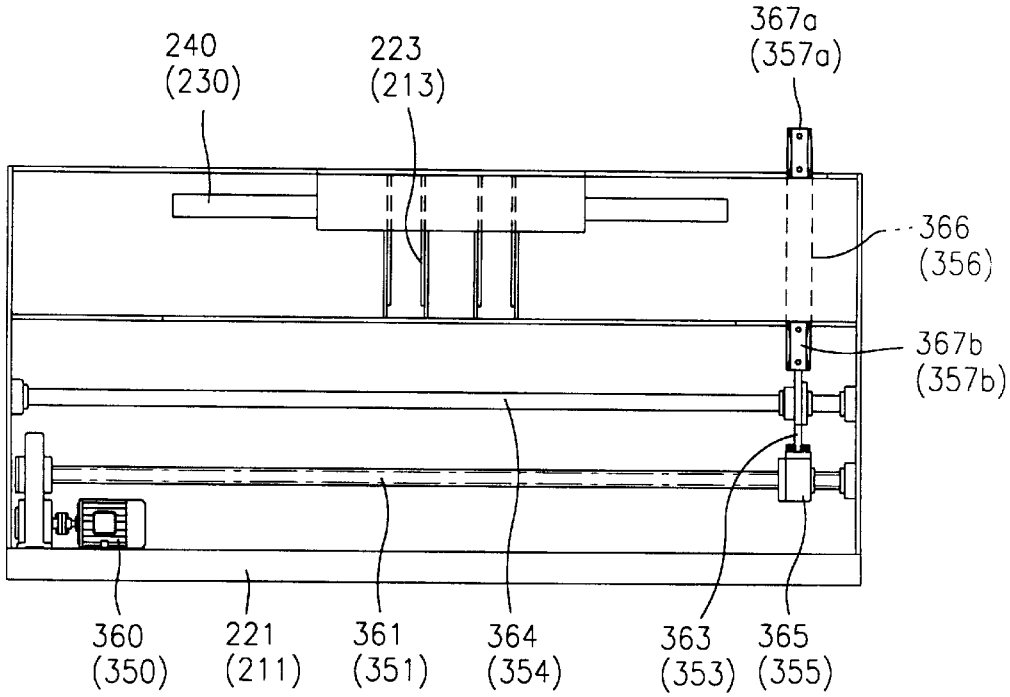
Figure 8:
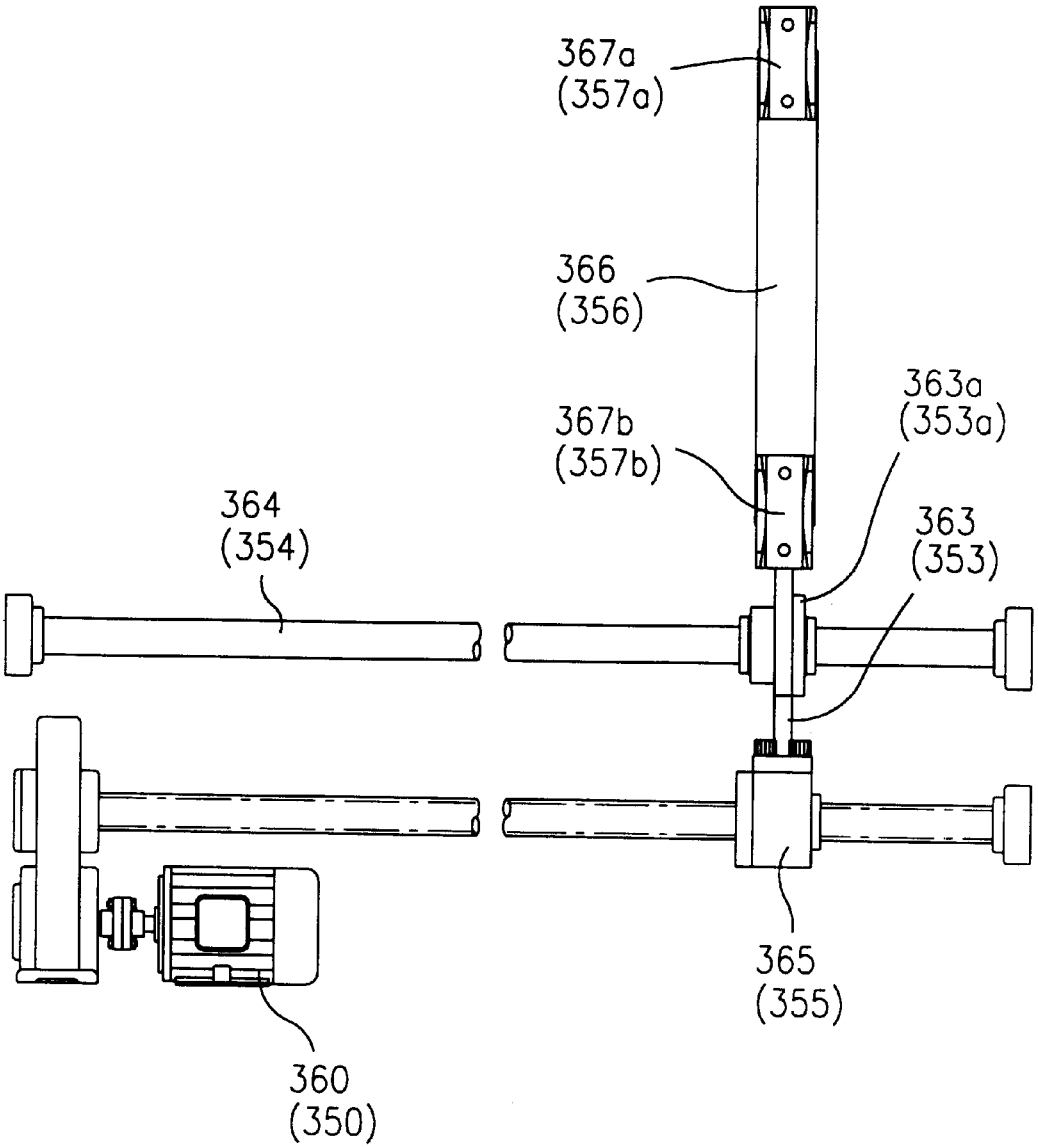
Figure 9:
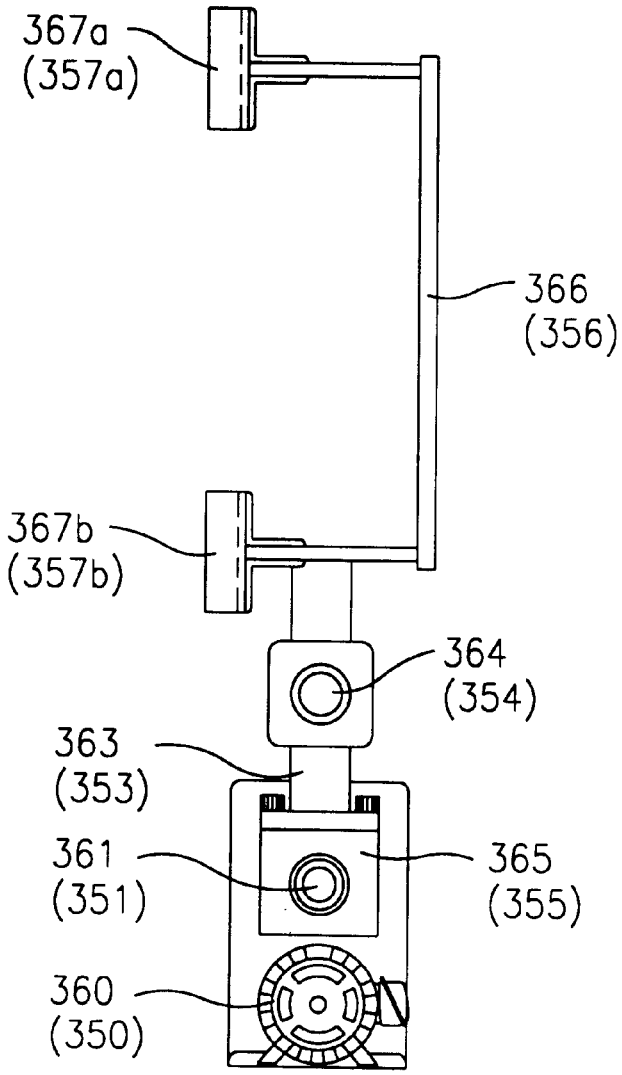

In FIG. 5, only the front side lift 210 is illustrated and the same has a construction similar with the rear side lift 220. The rear side lift 220 is formed symmetrically in the front and rear sides, respectively. The support member 222 of the rear side lift 220 is shorter than the support member 212 of the front side lift 210, and the number of the lift forks 240 is smaller than the number of the front side lift forks 230.

Therefore, the reference numerals 210 and 220 are given for the front side lift 210 and the rear side lift 220.

The lifts 210 and 220 each are formed of a plurality of forks 230 and 240 on which the wheels of the vehicle are placed and a support frame supporting the forks 230 and 240. Here, the support frame has a narrow width and is formed by curving a lengthy steel column or steel rod. Preferably, the interior surrounded by the support frame is formed as a space for decreasing the fabrication cost.

In detail, the lift 200 includes lift frames 211 and 221 formed by curving the steel column or rod in a rectangular shape and upwardly and downwardly movable by the lifting and driving unit, extended fork support members 212 and 222 each having its end portion fixed to the lift frames 211 and 221 and extended toward the center of the hoist way T, and a plurality of lift forks 230 and 240 fixed to the support members 212 and 222 and extended toward the parking room.

Front side wheels or rear side wheels of the vehicle are placed on the lift forks 230 and 240 of the lifts 210 and 220.

When a vehicle V is placed in a front side drive-in state, the front side wheels of the vehicle are placed on the lift forks 230 of the front side lift 210, and the rear side wheels of the vehicle V are placed on the lift forks 240 of the rear side lift 220.

In addition, when the vehicle V is loaded in a rear side drive-in state, the rear side wheels of the vehicle V are placed on the lift forks 230 of the front side lift 210, and the front side wheels of the vehicle V are placed on the lift forks 240 of the rear side lift 220.

The lift frames 211 and 221 and the support members 212 and 222 are fixedly connected by the connection members 213 and 223, and the support members 212 and 222 are formed to two parallel support members, and the width in the direction of the leftward and rightward directions of the support members 212 and 222 is narrower than the width in the leftward and rightward directions of the hoist way T, and the connection members 213 and 223 are formed of parallel connection members, and the width in the direction of the leftward and rightward directions of the connection members 213 and 223 is narrower than the width in the leftward and rightward directions of the support members 212 and 222.

The support members 212 and 222 supporting the forks 230 and 240 may be formed in a rectangular shape having its inner portion filled by a predetermined shaped frame and steel plate and are preferably formed of a lengthy column member having a narrow width as shown in FIGS. 2 and 4 for decreasing the weight and fabrication cost.

The lift forks 230 and 240 each are formed to be across the support members 212 and are extended from both sides of the support members 212 and 222, so that the wheels W of the vehicle are placed on the extended portion.

As shown in FIGS. 2 and 4, the inner ends of the support members 212 and 222 of the front side and rear side lifts 210 and 220 are not connected, namely are spaced-apart at a predetermined distance for thereby preventing any interference with the connection members 312 of the pallet 300. The connection members 213 and 223 of the lifts 210 and 220 are formed narrower to prevent any interference with the horizontal movement guide roller support member 341.

The lifts 210 and 220 are slidably lifted and lowered by the lift lifting and lowering drive unit, and preferably, a lift lifting and lowering guide unit may be installed for preventing shaking of the lifts 210 and 220 when the lifts 210 and 220 are lifted and lowered.

As shown in FIG. 4, the lift lifting and lowering guide unit includes lifting and lowering guide rollers 250 and 260 supported by the lift frames 211 and 221, and a plurality of lift lifting and lowering guide rails 270 (preferably, four rails) vertically installed in the main frame 100 for guiding the lifting and lowering guide rollers 250 and 260.

As shown in FIG. 5, the lifting and lowering guide rollers 250 and 260 are supported by the lifting and lowering guide roller support members 253 and 263 which are fixed to both sides of the lift frames 211 and 221 and which are extended upwardly and downwardly.

The lift lifting and lowering guide rail 270 and the lift lifting and lowering guide rollers 250 and 260 implement a smooth lifting and lowering operation of the lifts 210 and 220 and prevent any leftward and rightward direction movements when the lifts 210 and 220 are lifted and lowered. As shown in FIG. 4, the lifting and lowering guide rail 270 is formed to have a front and rear side guide surface 271 and a left and right side guide surface 272. As shown in FIG. 5, the lifting and lowering guide rollers 250 and 260 include the front and rear side guide rollers 251 and 261 slidably contacting with the front and rear side guide surface and the left and right side guide rollers 252 and 262 slidably contacting with the left and right side guide surface 271. FIG. 4 illustrates a schematic view of the lifting and lowering guide rollers 250 and 260.

In addition, FIG. 5 illustrates the lifting and lowering guide roller 250 of the front side lift 210, and the lifting and lowering guide roller 260 of the rear side lift 220 is installed symmetrically thereto. Therefore, in FIG. 5, the portions corresponding to the front side lift 210 and the rear side lift 220 are given the same reference numerals.

As shown in FIG. 4, the lift lifting and lowering drive unit includes a lifting and lowering drive motor 280 installed in the machinery compartment M (shown in FIG. 1), a plurality of ropes R (preferably, eight strands) driven by the lifting and lowering drive motor 280, a driving sheave 281 for driving the rope R, and a plurality of guide sheaves 282 for changing the driving direction of the rope R based on the driving sheave 281.

In the thusly constituted lift lifting and lowering drive unit, the driving sheave 281 is connected based on a decelerator (not shown) installed at a portion of the lifting and lowering drive motor 280, and one end of each of the ropes R is fixed to the balance weight B, and the other end of each of the same is fixed to the lift frames 211 and 221 of the lifts 210 and 220 by two strands through the guide sheave 282.

The ropes R formed of two strands fixed to the lift frames 211 and 221 are fixed to the upper portions of the lifting and lowering guide roller support members 253 and 263 and are connected with the lift frames 211 and 221 through the lifting and lowering guide roller support members 253 and 263.

In addition, when connecting the ropes R with the upper portions of the lifting and lowering roller support members 253 and 263, the extension of the rope R is prevented using a turn buckle joint (not shown), and a tensile force is provided to the rope R.

Figure 10:
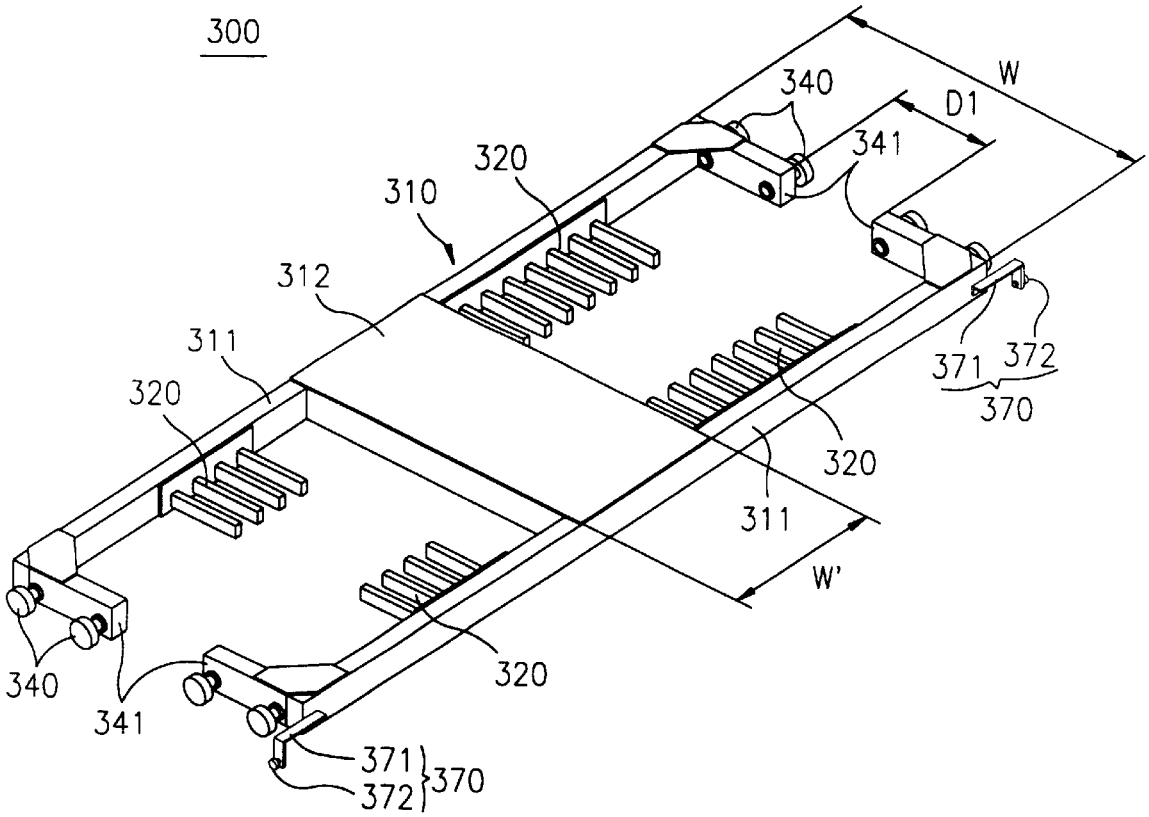
Figure 11:
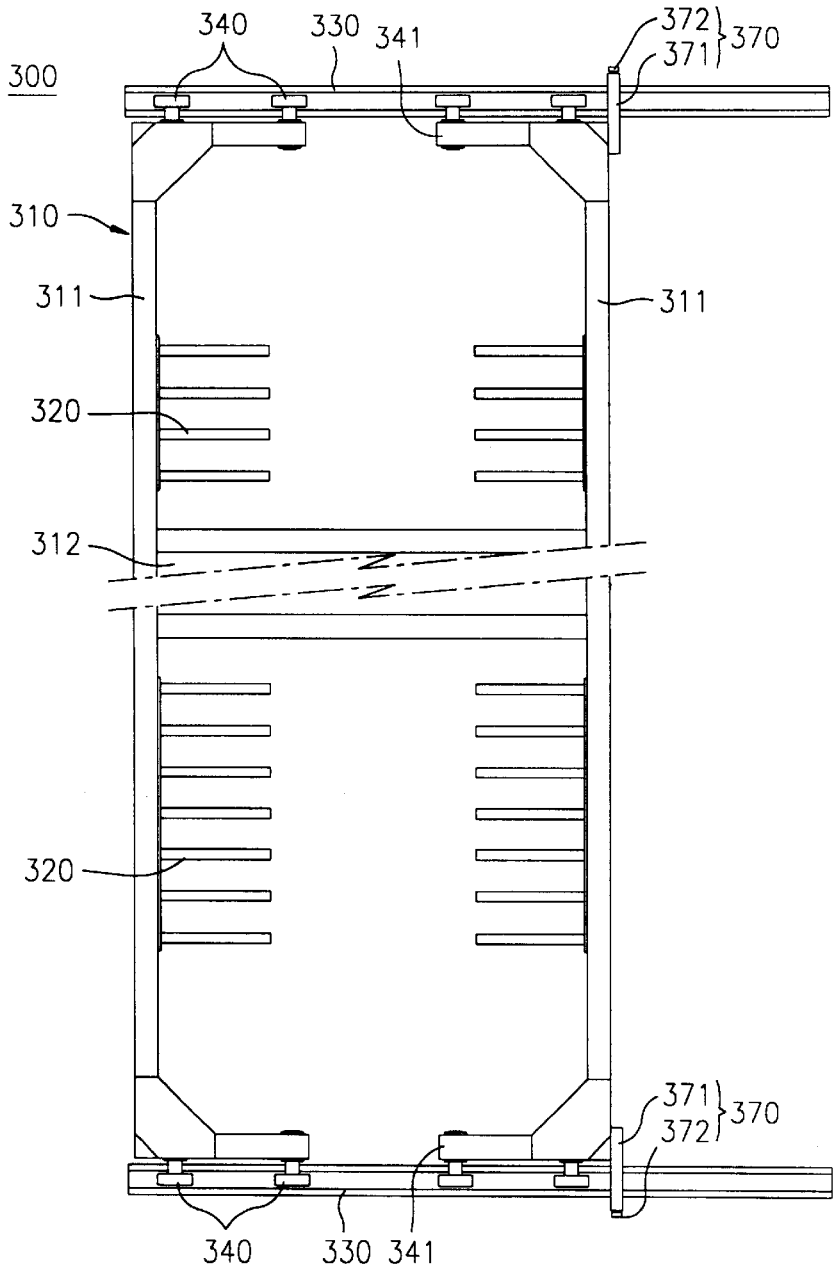
Figure 12:
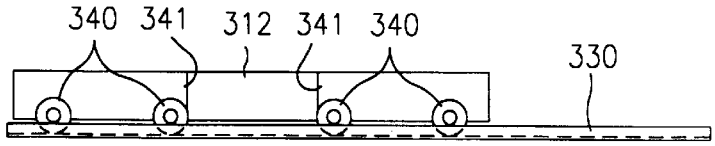

As shown in FIG. 10, the pallets 300 of each parking room include a pallet frame 310 installed between a pair of pallet support members 150 (shown in FIG. 1) horizontally installed between the main column 110 and the extra columns of the main frame 100 and slidably installed between the hoist way T and the parking room P, and a plurality of pallet forks 320 installed to be opposite the inner side of the pallet frame 310.

At this time, the pallet forks 320 are formed alternately with the lift forks 230 and 240 of the lift 200 for preventing any interference therebetween when the lift 200 moves through the pallet 300.

The pallet frame 310 includes two parallel first support columns 311*a*, a pair of support members 311 formed in a C shape and formed of a second column 341 shorter than a first support column in which both ends of the first support column 311*a* are vertically curved and extended toward the other first support column, and a connection plate 312 connecting the intermediate portion of the first columns 311*a*.

The width W between the support members 311 is wider than the distance D5 between both free end portions of the lift forks 230 and 240 of the lift 200, so that the lifts 210 and 220 pass between the two support members 311 (FIGS. 4 and 10).

In addition, the width W' in the front and rear side directions of the connection plate 312 is narrower than the distance D between free ends of the support members 212 and 222 of the lifts 210 and 220 for preventing any interference between the lifts 210 and 220 and the pallet 300.

As shown in FIGS. 1 through 4 and 10, the pallet horizontal movement guide unit includes a pair of horizontal movement guide rails 330 fixed on the upper surface of the pallet support member 150 of the parking room P and a horizontal movement guide roller 340 engaged to the pallet frame 310 and slidably contacting with the horizontal movement guide rail 330.

The inner sides of the horizontal movement guide rail 330 are spaced-apart so that the connection members 213 and 223 of the lifts 210 and 220 pass therethrough.

As shown in FIG. 10, the horizontal movement guide roller 340 is operably installed at the second column 341 of the pallet frame 310, and the distance D1 of the free ends of the second column 341 is longer than the distance D2 of the connection members of the connection members 213 and 223 of the lifts 210 and 220 for thereby preventing any interference between the second column 341 and the connection members 210 and 223 of the lifts 210 and 220 when the lifts 210 and 220 pass through the pallet 300(FIGS. 4 and 10).

Altogether, four horizontal movement guide rollers 340 are installed at each second column 341 in the pallet 300, of which two are installed at an end portion of each horizontal movement guide support member 341, respectively, and the distance between the rollers 340 is wider than the distance D3 between the horizontal movement guide rails 330 (FIGS. 4 and 10).

Therefore, at least three horizontal movement guide rollers 340 are supported by one of the horizontal movement guide rails 330 in a state that more than two horizontal movement guide rollers 340 are not concurrently positioned in the distance between the horizontal movement guide rails 330 while the pallet 300 horizontally moves to the other side of the horizontal movement guide rail, so that the pallet 300 maintains a horizontal movement.

As shown in FIGS. 5 through 9, the parking unit (pallet) drive unit includes horizontal movement driving motors 350 and 360 installed in the lift frames 211 and 221 of the lifts 210 and 220 and normally and reversely rotating, ball screws 351 and 361 rotatably supported by the lift frames 211 and 221 and normally and reversely rotating by the horizontal movement driving motors 350 and 360, nut members 355 and 365 screwed to the ball screws 351 and 361 and horizontally moving by the rotation of the ball screws 351 and 361, hooking members 352 and 362 connected with the nut members 355 and 365 and horizontally moving by the nut members 355 and 365, and a pair of engaging members 370 (as shown in FIG. 10) fixed to both sides of the hoist way of the pallet 300, extended toward the hoist way, and selectively engaged by the hooking members 352 and 362.

The ball screws 351 and 361 are installed so that the horizontal movement driving motors 350 and 360 are decelerated based on the horizontal movement mechanism. The above-described horizontal movement mechanism is a driving force transfer mechanism generally formed of a gear, a chain and sprockets, etc.

As shown in FIGS. 6 through 9, the hooking members 352 and 362 includes column-shaped hooking member bodies 353 and 363 fixed to the nut members 355 and 365 and upwardly extended, U-shaped extended members 356 and 366 fixed to the upper portion of the bodies 353 and 363, upper portion hookers 357*a* and 367*a* fixed to the upper portion free ends and lower portion free ends of the extended members 356 and 366.

The hookers 357*a* and 357*b* and 367*a* and 357*b* of the hooking members 352 and 362 are formed of a channel-shaped member extended toward the front and rear side ends of the lateral surfaces of the hoist way of the pallet 300.

As shown in FIG. 10, the engaging member 370 includes a fixing plate 371 extended toward the hoist way of the front and rear side ends of the lateral surface of the hoist way of the pallet, and an engaging roller 372 operably installed at the fixing plate 371 and inserted into and hooked by the hookers 357*a* and 357*b* and 367*a* and 367*b*.

Preferably, the parking unit drive unit includes sliding support bodies 353*a* and 363*a* slidably supporting the hooking member bodies 353 and 363 for preventing shaking when the hooking members 352 and 362 are horizontally moved, and guide rods 354 and 364 having both ends fixed to the lift frames 211 and 221 for guiding a sliding and horizontal movement of the sliding support bodies 353*a* and 363*a*. Here, the sliding support bodies 353*a* and 363 are formed to have a hallow intersion, and the guide rods 354 and 364 pass through the hallow for thereby slidably supporting the sliding support bodies 353*a* and 363*a* on the guide rods 354 and 364.

Each of the hookers 357*a* and 357*b* and 367*a* and 367*b* is guided by the upper and lower members 211*a* and 221*a* of the lift frames 211 and 221.

Here, the upper and lower members 211*a* and 221*a* of the lift frames 211 and 221 are formed to have a narrower width except for the portions such as the end portions as shown in FIG. 5 in order to prevent any interference when the hookers 357*a* and 357*b* and 367*a* and 367*b* horizontally move.

The construction is such that the channel-shaped hookers 357*a* and 357*b* are installed in the hooking members 352 and 362, and the engaging roller 372 is installed in the engaging member 370 but are not limited thereto. Namely, the engaging plate having the same cross section as the hookers 357*a* and 357*b* and 367*a* and 367*b* may be installed at the engaging member 370, and the hooking roller having the same structure as the engaging roller may be installed at the hooking members 352 and 362.

The hooking members 352 and 362 are installed to reciprocate between the portions in which the same are engaged with the engaging roller 372 of the pallet 300 in which the hookers 357*a* and 357*b* are positioned in the parking room P and the unlocking position.

Figure 13:
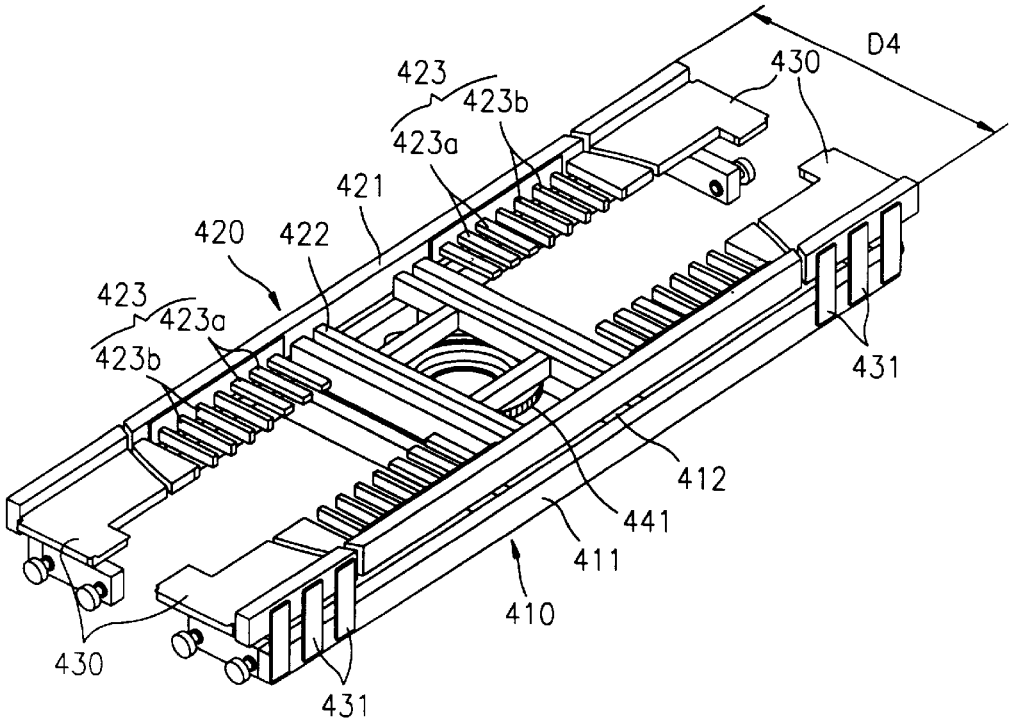

As shown in FIGS. 1, 3 and 13, the turntable 400 is installed horizontally to the bottom surface of the drive-in floor when the vehicle V is driven in and out and includes a turntable base 410, a rotation member 420 rotatable on the turntable base 410, and a turntable rotation driving unit for rotating the rotation member 420.

The turntable base 410 includes a pair of outer members 411, and the connection member 412 rotatably supporting the rotation member 420.

The rotation member 420 does not interfere with the lifts 210 and 220 as well as the pallet 300.

The rotation member 420 includes a pair of rotation frames 421 horizontally installed on the bottom surface of the drive-in floor, a connection member 422 connecting the intermediate portions of the rotation frame 421, and a plurality of turntable forks 423 extended opposite to each other on the inner surface of the rotation frame 421.

At this time, the inner distance D4 of the rotation frame 421 is longer than the distance D5 between both ends of the lift forks 230 and 240 of the lifts 210 and 220, and the turntable forks 423 are formed not to interfere with the lift forks 230 and 240 when the lifts 210 and 220 pass through the turntable 400.

The inner forks 423*a* (in the drawings, three forks are seen) formed near the center portion of the turntable 400 among turntable forks 423 preferably have wider cross section surfaces compared to the outer forks 423*b* (in the drawings, three forks are seen) positioned far from the center of the turntable 400, namely, from the connection member 422.

Therefore, when the lifts 210 and 220 are lowered to the position of the turntable 400, and then the lift forks 230 and 240 and the turntable forks 423 are inserted into each other, the inner and outer forks 423*a* and 423*b* of the drive-in outlet side becomes an alternately inserted state with respect to the lift forks 230 of the front side lift 210. However, in the opposite side (inner side) of the drive-in outlet, only the outer forks 423*b* become an engaged state with the lift forks 240 of the rear side lift 220, and the inner side forks 423*a* are not alternately engaged with the lift forks 240 of the rear side lift 220 because the number of the inner side forks of the turntable is greater than the number of the forks of the rear side lift 220. In this case, when the surface area of the inner side forks 423*a* is narrower than the surface area of the outer forks 423*b*, the distances between the inner side forks 423*a* are increased, so that the vehicle may collide with a predetermined portion when the vehicle moves.

Namely, when the lifts 210 and 220 are lowered to the position of the turntable 400, the inner side forks of one (positioned in the rear side) of the inner forks 423*a* of the turntable 400 are not alternately engaged with the lift forks 240 of the rear side lifts 220. Therefore, the surface area of the inner forks 423*a* is widened, so that the vehicle V is stably supported on the inner forks 423*a* for thereby implementing a stable loading and unloading operation of the vehicle V.

In the front and rear sides of the rotation member 420 of the turntable 400, a running surface for the vehicle is formed and then the vehicle runs thereon when the same comes in and out, and a deck panel 430 is fixed to the turntable base 410 for preventing a fall of the vehicle.

Figure 16:
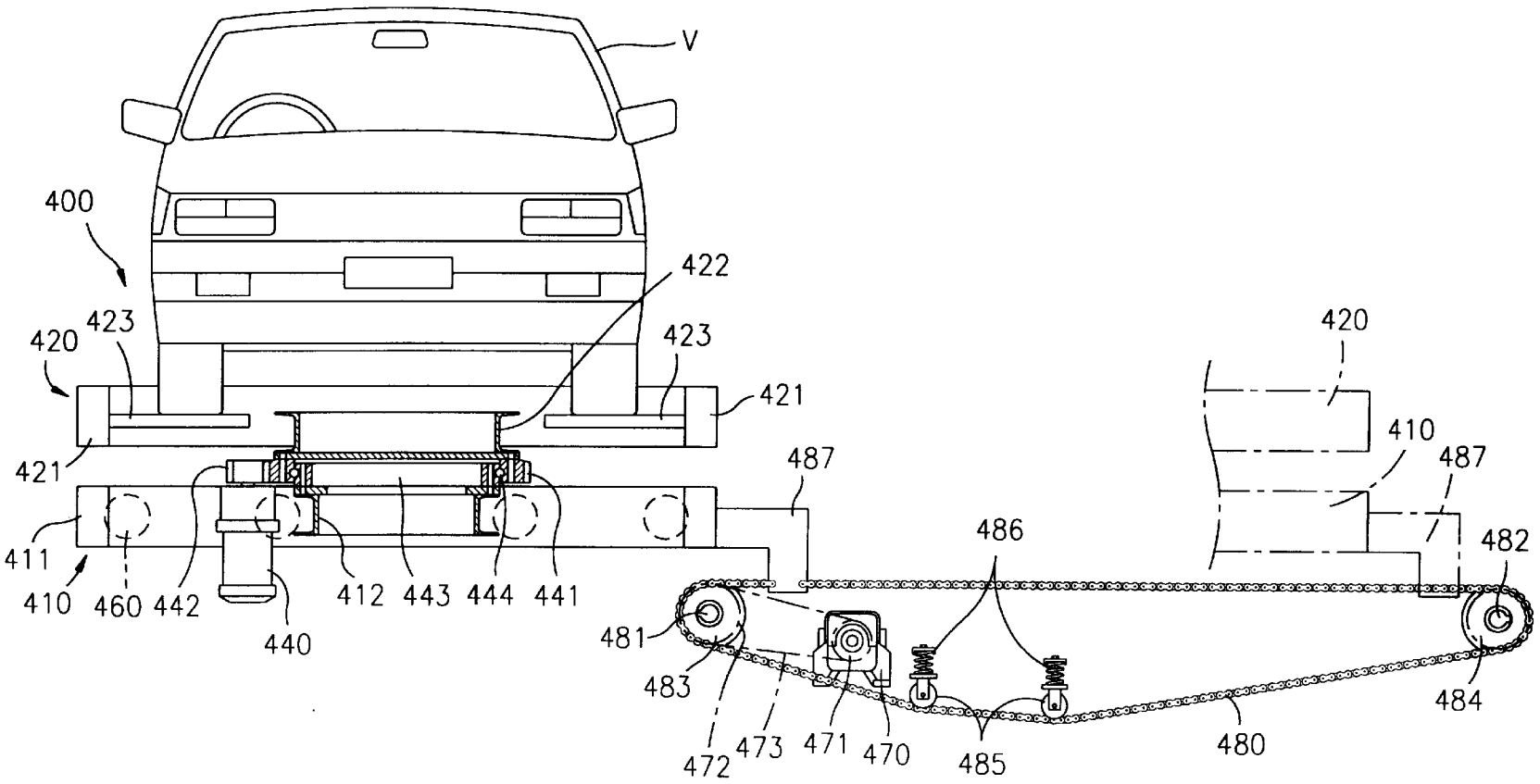
FIG. 16 is a cross-sectional view taken along the line A—A of FIG. 15.
Figure 17:
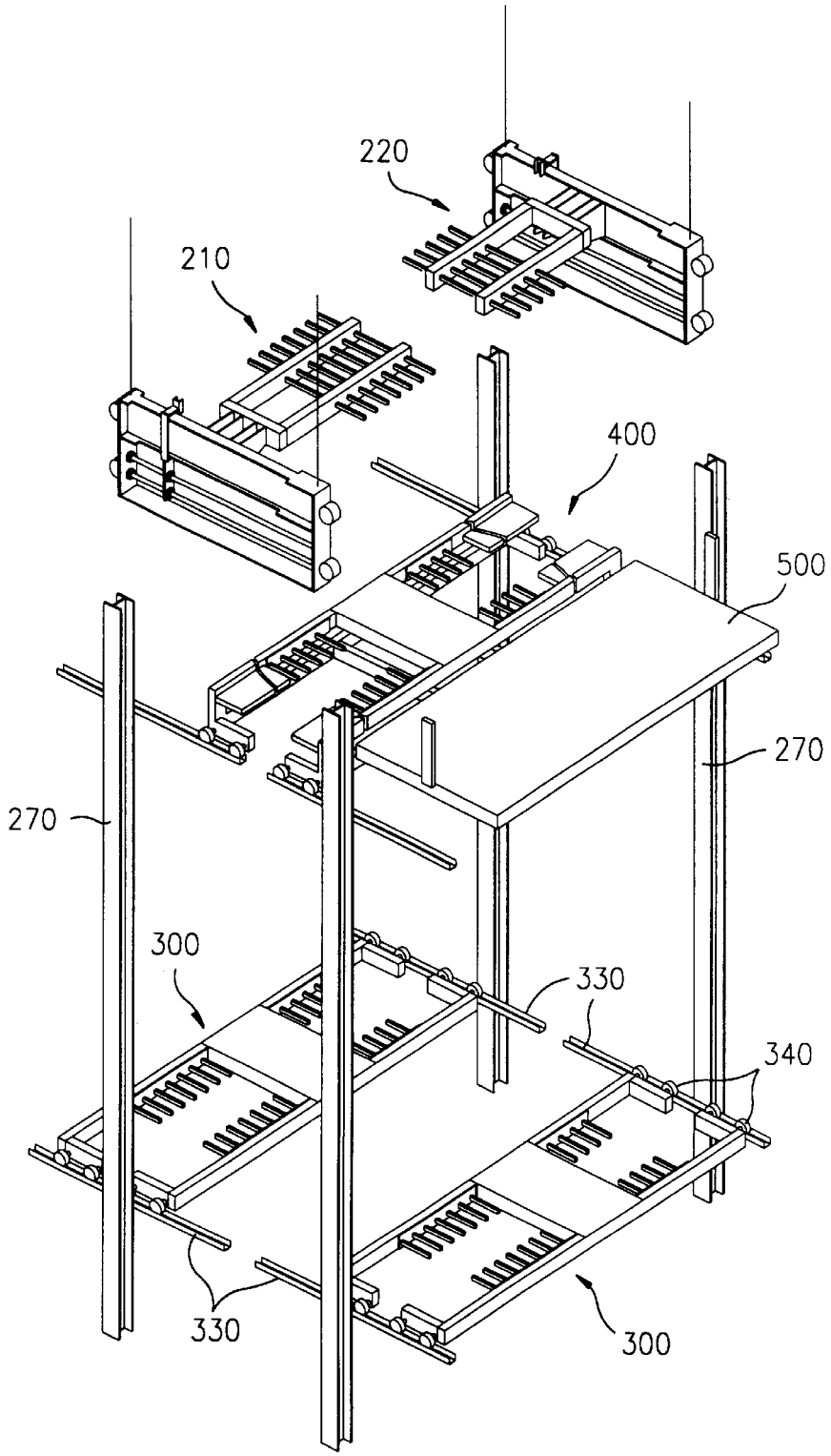
FIG. 17 is a perspective view illustrating a footboard unit of an elevator type parking system according to the present invention.
Figure 18:
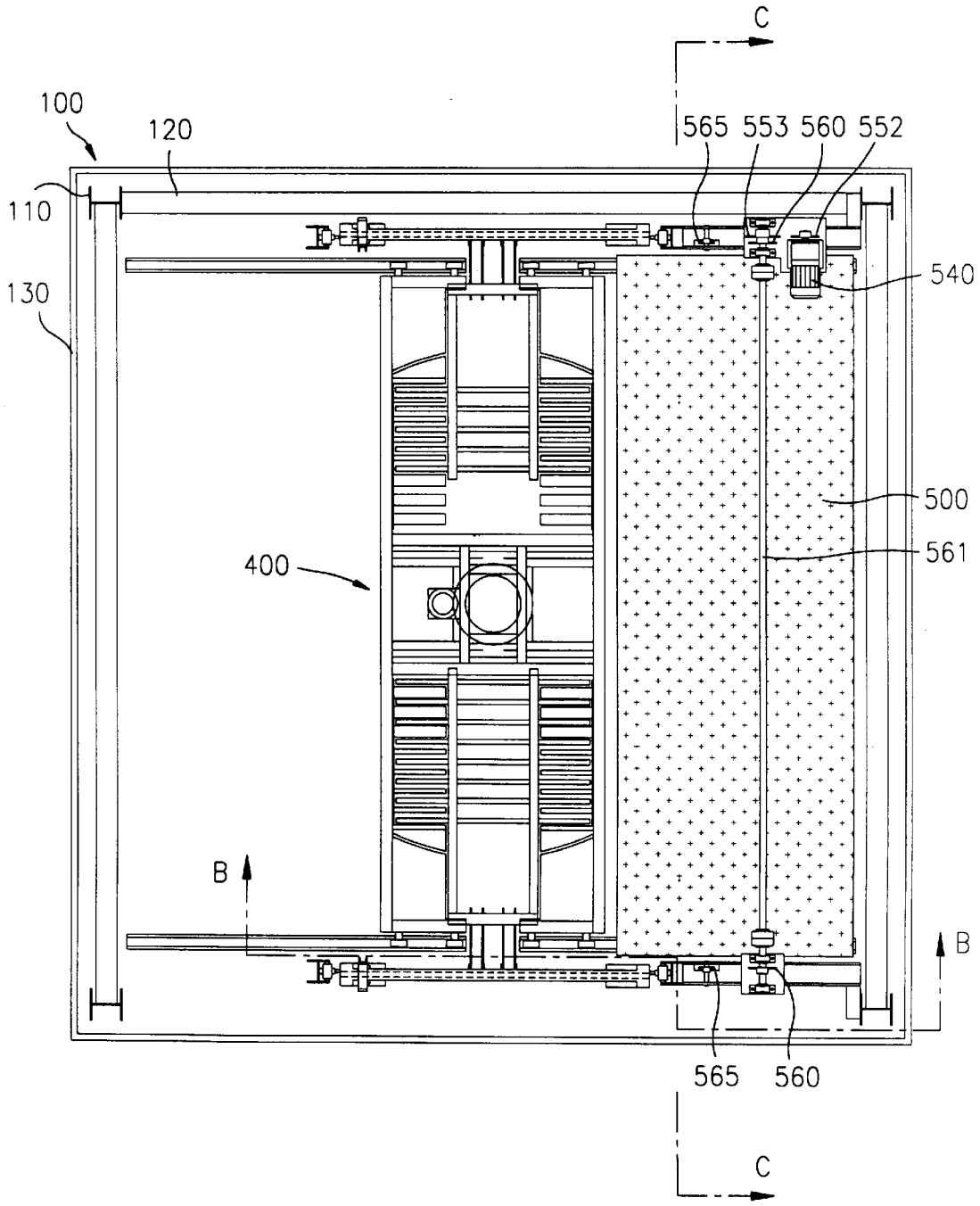
FIG. 18 is a plan view illustrating a footboard unit for an elevator type parking system according to the present invention.
Figure 19:
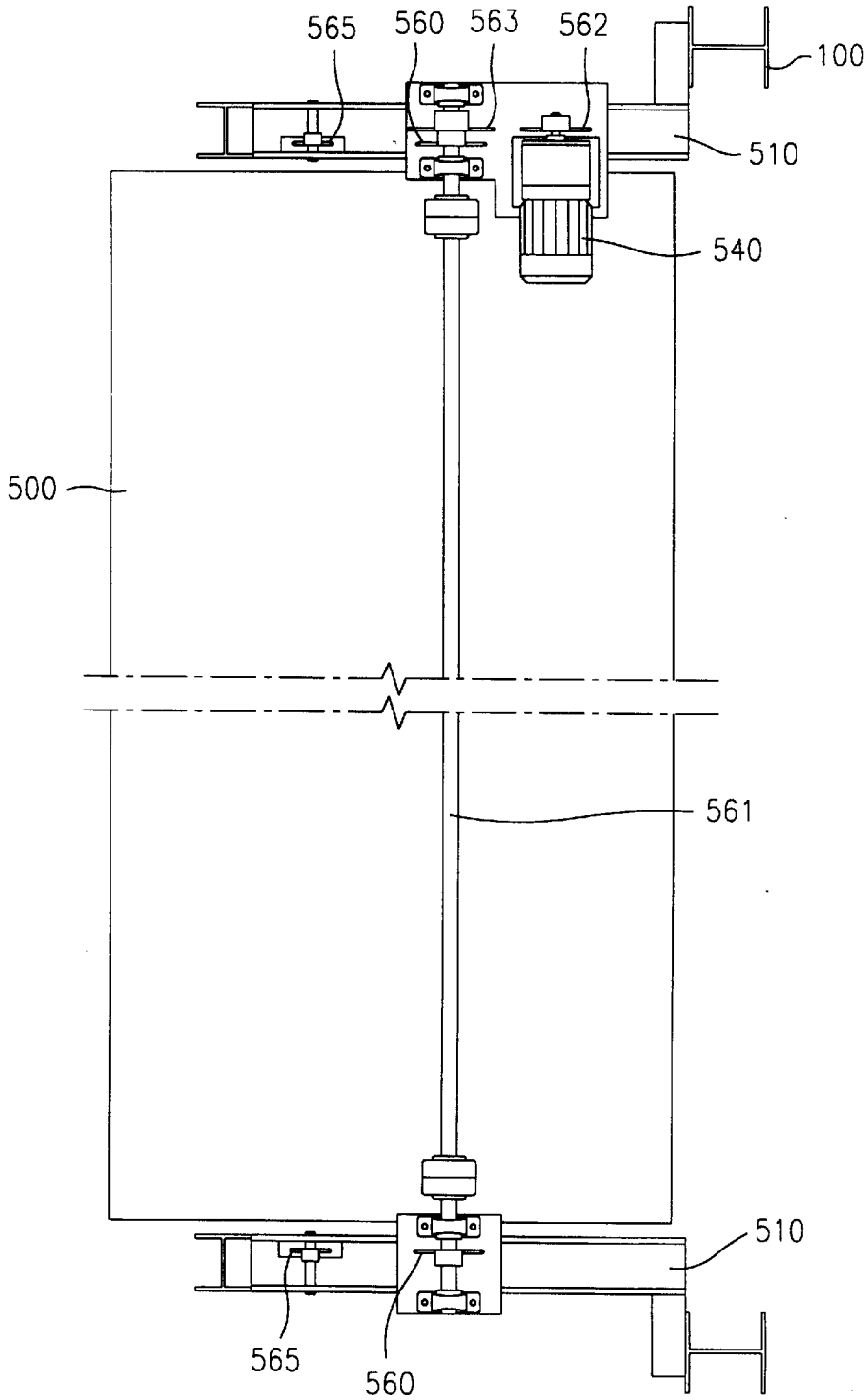
FIG. 19 is a partially enlarged plan view illustrating a footboard driving unit for an elevator type parking system according to the present invention.
Figure 20:
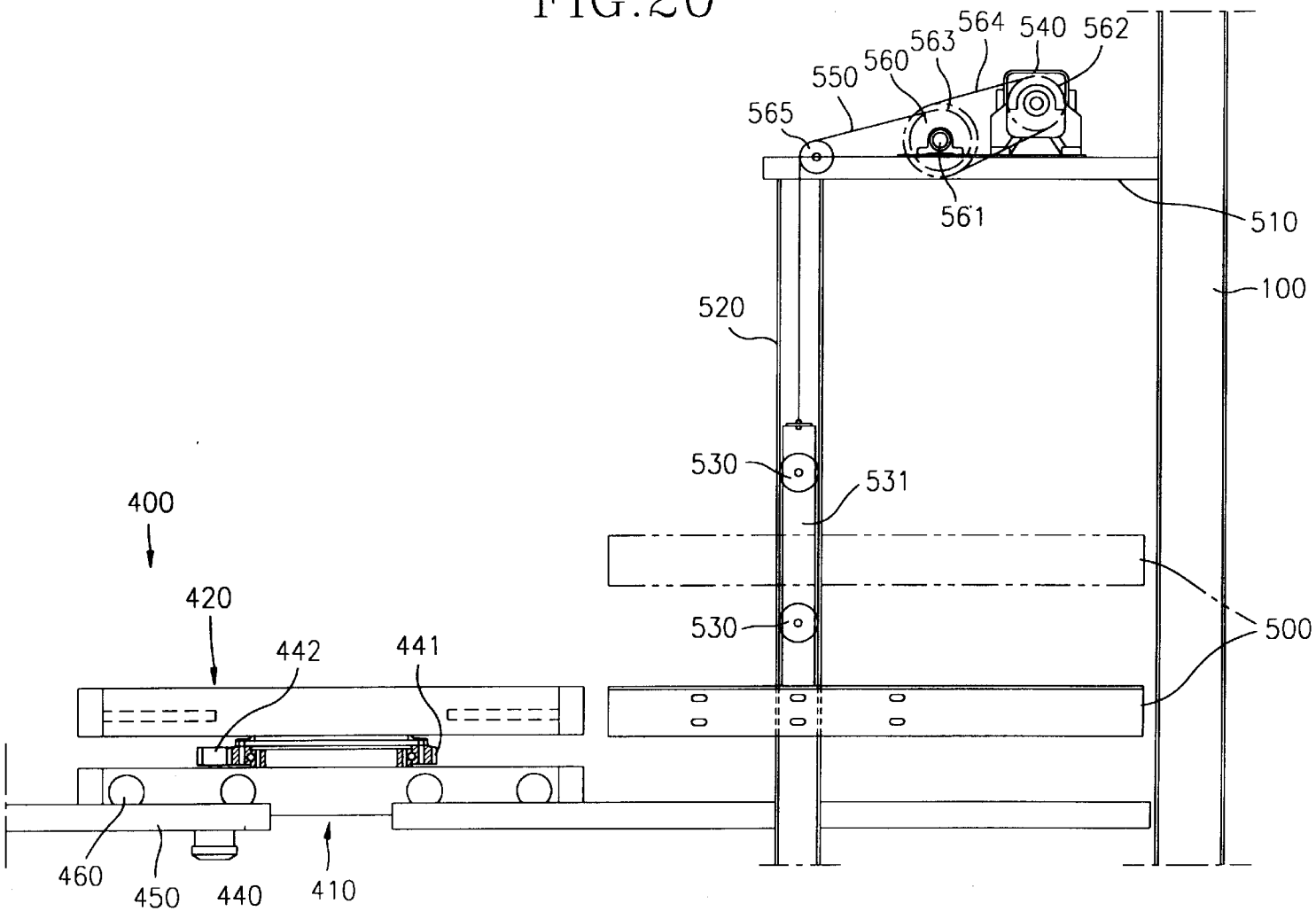
FIG. 20 is a cross-sectional view taken along the line B—B of FIG. 18.
Figure 21:
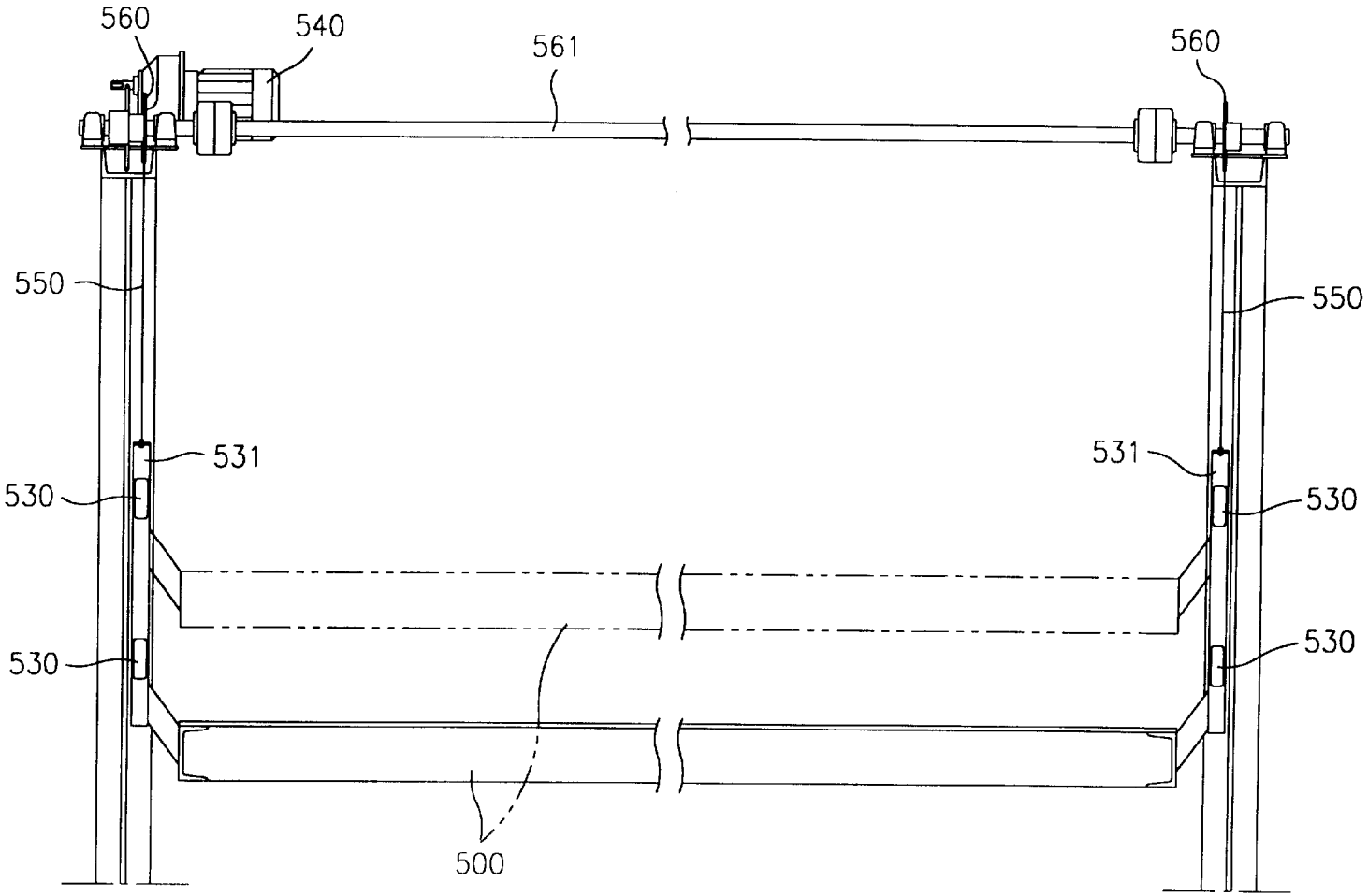
FIG. 21 is a cross-sectional view taken along the line C—C of FIG. 18 for showing a lifting and lowering operation state of a footboard unit for an elevator type parking system according to the present invention.

As shown in FIGS. 13 and 16, the turntable rotation driving unit includes a turntable rotation driving motor 440 fixedly installed at the turntable base 410, a ring gear 441 fixed at the bottom center portion of the connection member 422 of the rotation member 420, and a pinion 442 coaxially fixed to the rotation shaft of the turntable rotation driving motor 440 and engaged with the ring gear 441 for thereby rotating the connection member 422.

Figure 14:
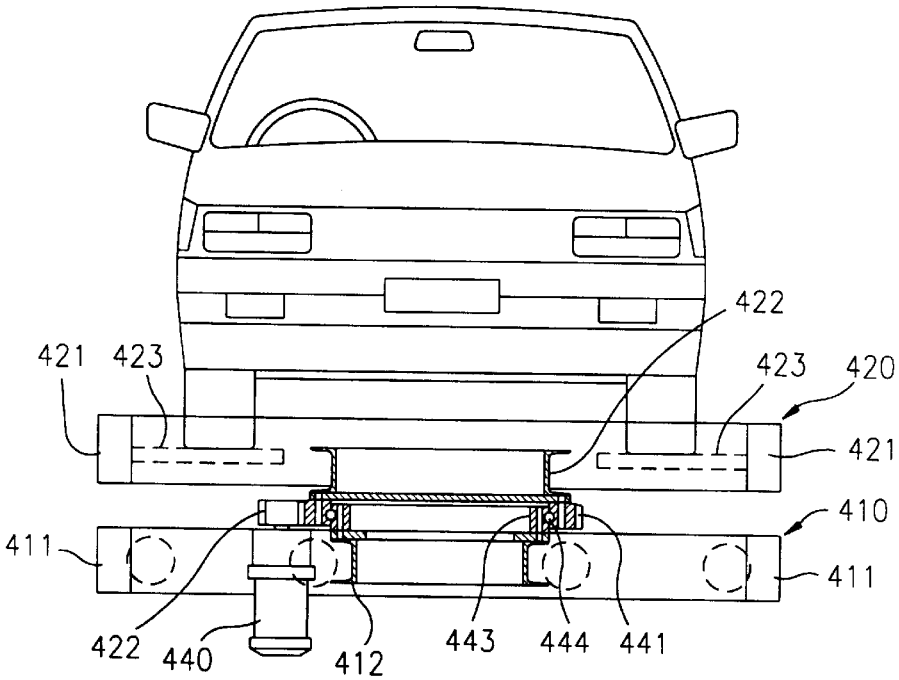

As shown in FIG. 14, the ring gear 441 is supported by the support shaft 443 fixed to the center portion of the turntable base 410, and a bearing 444 is installed between the outer circumferential surface of the support shaft 443 and the inner circumferential surface of the ring gear 441 for thereby implementing a smooth operation of the ring gear 441.

The support shaft 443 is preferably formed of a cylindrical shaft for decreasing the weight of the same.

If the decelerator is integrally formed with the rotation driving motor 440, the pinion 442 may be directly engaged with the rotation shaft of the turntable driving motor 440. If the decelerator is not integrally formed with the rotation driving motor 440, the pinion 442 may be engaged using an additional motor mechanism.

The turntable 400 is movably installed between the position of the hoist way T and the position spaced-apart from the above-described position (the position corresponding to the lower portion of the upper floor parking room) for preventing any interference between the lift and the vehicle V when the vehicle comes into or out from the lower floor parking room P of the drive-in and out floor.

Figure 15:
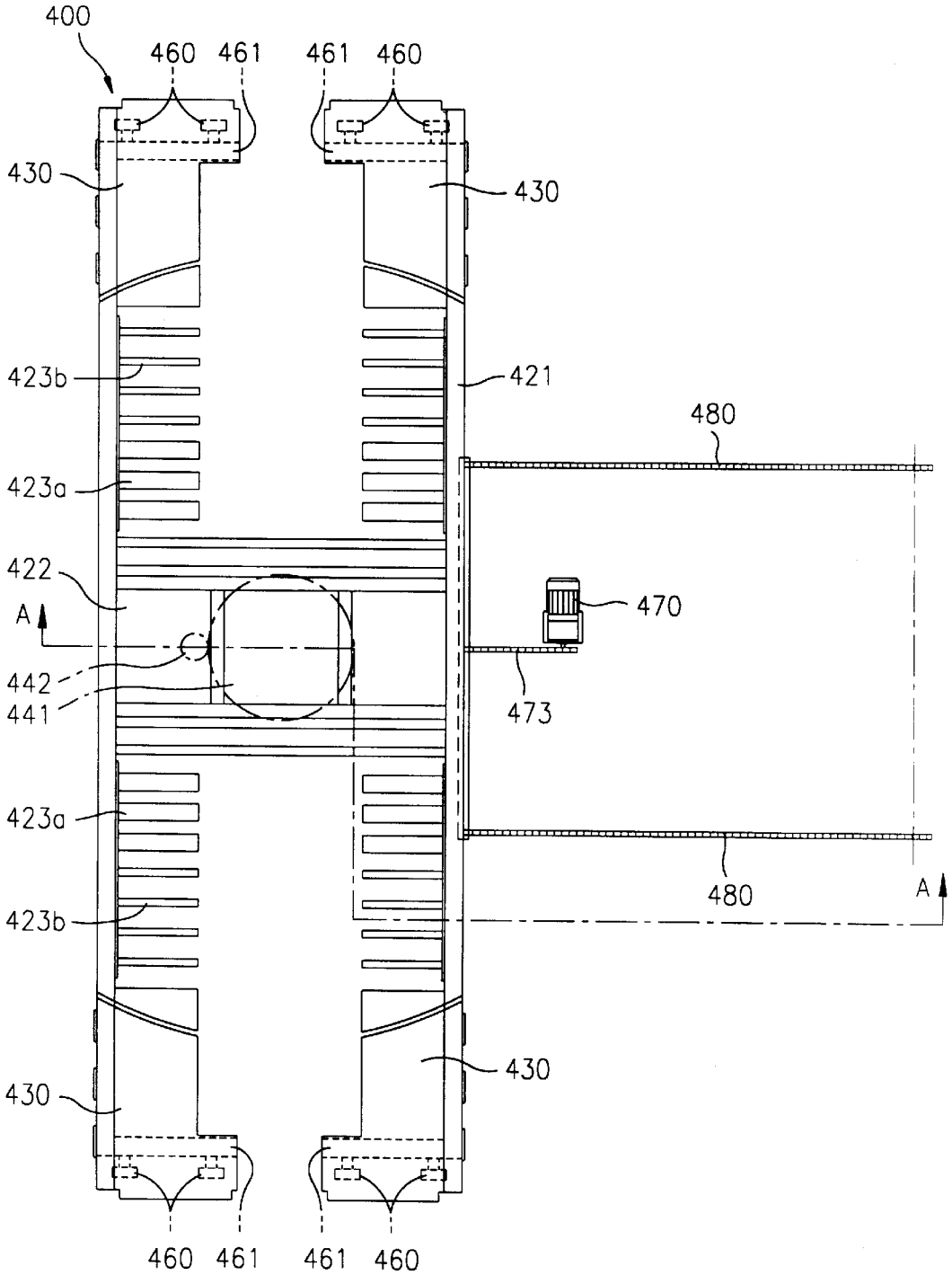

As shown in FIGS. 4, 15 through 16, the turntable horizontal movement unit includes a turntable horizontal movement guide rail 450 installed at the bottom height of the drive-in and out floor, a turntable horizontal movement guide unit operably engaged with the turntable base 410 and having a turntable horizontal movement roller 460 guided by the turntable horizontal movement guide rail 450, and a turntable horizontal movement driving unit for horizontally moving the turntable 400.

The turntable horizontal movement guide rail 450 of the turntable horizontal movement guide unit is horizontally fixed to the main frame 100, and the channel-shaped member is installed with its upper portion being opened, and the turntable horizontal movement guide roller 460 slidably contacts on the inner side bottom surface.

The turntable horizontal movement guide roller 460 is operably installed at front and rear side ends of the turntable base 410. The turntable horizontal movement guide roller 460 is operably installed at the roller support member 461 fixed to the front and rear side portions of the outer member 411.

As shown in FIG. 16, the turntable horizontal movement driving unit includes a reversible type turntable horizontal movement driving motor 470 mounted at the turntable support frame (not shown) fixed to the main frame 100 at the drive-in and out floor, and a turntable horizontal movement driving chain 480 having its part fixed to the turntable base 410 and endlessly running by the driving force of the turntable horizontal movement driving motor 470.

A driving sprocket 471 is fixed to the shaft of the turntable horizontal movement driving motor 470, and the turntable horizontal movement driving chain 480 is wound on the idle sprockets 483 and 484 fixed to both ends of the rotation shafts 481 and 482 operably engaged with the turntable support frame (not shown), and the motored sprocket 472 connected with the driving sprocket 471 by the motored chain 473 is fixedly installed at the rotation shaft 481, and the driving force of the turntable horizontal movement driving motor 470 is transferred to the 20 rotation shaft 481 through the driving sprocket 471, the motored chain 473, and the motored sprocket 472, and the rotational force of the rotation shaft 481 is transferred to the turntable horizontal movement driving chain 480 connected between the idle sprockets 483 and 484.

As shown in FIG. 16, the turntable horizontal movement driving chain 480 is designed to run based on a predetermined tensile force without lessening the tensile force by the tensile force control roller 485 elastically supported by the spring 486.

The outer member 411 of the turntable base 410 and the turntable horizontal movement driving chain 480 are connected by the connection member 487.

In addition, as shown in FIGS. 17 through 21, in the lobby floor of the hoist way, the footboard unit is formed on a portion of the turntable 400, so that a driver stably stands thereon for getting into or off from the vehicle when the vehicle V is loaded or unloaded.

In the upper drive-in type and intermediate drive-in parking system, the footboard unit is directed to implement a driver to stably get into or get out of from the vehicle because there is no floor at both sides of the turntable when the vehicle is loaded into/unloaded from the parking room P formed below the drive-in/out floor.

In addition, since the footboard 500 of the footboard unit is installed at the same height as the turntable 400, the lift 200 and the vehicle V should be lifted or lowered through the position of the turntable 400 when loading and unloading the vehicle from the parking room P. Therefore, the footboard 500 is installed not to be interfered by other members when the turntable 400 is horizontally moved.

The footboard 500 is formed in a panel form having a length corresponding to the entire length of the turntable 400 and a width corresponding to the width of the parking room P installed at both sides of the hoist way T.

In the footboard unit, since the footboard 500 is installed at the same height as the turntable 400, there is provided a footboard lifting and lowering guide unit for guiding a lifting and lowering operation of the footboard 500, so that the footboard 500 is lifted at the height higher than the turntable 400 and then is lowered to the position at the same height as the turntable 400 when the turntable 400 goes back to its original position in order to prevent any interference with the turntable when the turntable 400 is horizontally moved by the turntable horizontal movement unit. In addition, there is further provided a footboard lifting and lowering drive unit for lifting and lowering the footboard 500.

As shown in FIGS. 17 through 21, the footboard lifting and lowering guide unit includes a pair of support members 510 fixed to the vertical column of the main frame 100 and parallely extended from both surfaces of each footboard 500 in the portion spaced-apart from the footboard 500, a pair of lifting and lowering guide rails 520 each having its end portion fixed to the end portion of the support member 510 and extended from the upper portion to the bottom of the lobby floor, and a plurality of lifting and lowering guide rollers 530 operably installed at both sides of the footboard 500 and guided by the lifting and lowering guide rail 520.

The lifting and lowering guide roller 530 is operably installed at the pair of the roller support members 531 fixedly and vertically installed at a predetermined portion of both surfaces of the footboard 500. Preferably, in order to maintain a stability, at least two lifting and lowering guide rollers 530 are installed at the roller support member 531.

The footboard lifting and lowering drive unit includes a lifting and lowering drive motor 540 mounted at the support member 510, and a lifting and lowering drive chain 550 reversely operated by the driving force of the lifting and lowering drive motor 540 and having one end fixed to the upper portion of the roller support member 531 supporting the lifting and lowering guide roller 530.

The lifting and lowering drive chain 550 is wound onto the lifting and lowering drive sprocket 560 fixed at both ends of the rotation shaft 561 operably installed at the lifting and lowering floor support member 510 and is reversely operable by the driving operation of the footboard lifting and lowering drive motor 540.

In addition, a motored sprocket 563 connected with the chain 564 fixed to the shaft of the lifting and lowering floor lifting and lowering drive motor 540 is fixed at one end of the rotation shaft 561, so that the driving force of the lifting and lowering drive motor 540 is transferred to the rotation shaft 561 and the lifting and lowering drive sprocket 560 by the chain 564 and the sprockets 562 and 563.

The lifting and lowering drive chain 550 wound onto the lifting and lowering drive sprocket 560 is guided to change its movement direction by the guide sheave 565 operably installed at the upper portion of the lifting and lowering guide rail 520 for thereby implementing a smooth operation.

The footboard 500 is lifted by the lifting and lowering drive chain 550 when the lifting and lowering drive chain 550 is wound by the lifting and lowering drive sprocket 560 and is lowered by its weight when the lifting and lowering drive chain 550 is released.

The elevator type parking method according to the present invention includes an upper floor loading step having a step in which a vehicle comes in a state that the lift is arranged with the turntable in the drive-in/out side and then the vehicle is loaded onto the lift and the turntable, a step in which the lift on which the vehicle is placed is lifted to the position higher than the pallet position of the designated floor, a step in which the pallet is downwardly and horizontally moved, and the lift is lowered lower than the pallet, and the vehicle on the lift is loaded onto the pallet, a step in which the pallet having the vehicle thereon is horizontally moved into the parking room, and a step the lift is lowered to the position of the turntable.

There is further provided an upper floor unloading step having a step in which the lift is lifted to the position lower than the pallet of the designated floor, a step in which the pallet is horizontally moved to the portion above the lift, a step in which the lift is lifted, and the vehicle on the pallet is loaded onto the lift, a step in which the pallet is horizontally moved into the parking room, a step in which the lift is lowered to the position of the same height as the turntable, and a step in which the lift and the vehicle on the turntable are unloaded.

There is further provided a lower floor loading step having a loading step in which a vehicle is loaded in a state that the lift is arranged with the turntable in the side of the drive-in/out portion and then is loaded on the turntable, a step in which the lift is lifted to the position higher than the turntable, and then the vehicle is loaded onto the lift, a step in which the turntable is moved off the hoist way, a step in which the lift with the vehicle thereon is lowered to the position higher than the pallet of the designated floor of the lower floor and is stopped, a step in which the lift is lowered to the position lower than the pallet, and the vehicle on the lift is loaded onto the pallet, a step in which the panel with the vehicle thereon is horizontally moved to the parking room, a step in which the lift is lifted to the position higher than the turntable, a step in which the turntable is horizontally moved to the hoist way, and a step in which the lift is lowered to the position arranged with the turntable.

There is further provided a lower floor unloading step having a step in which the turntable is horizontally moved off the hoist way, a step in which the lift is lowered to the position lower than the pallet of the designated floor of the lower floor, a step in which the pallet with the vehicle thereon is horizontally moved onto the lift, a step in which the lift is lifted and the vehicle loaded on the pallet is loaded onto the lift, a step in which the pallet is horizontally moved to the parking room, a step in which the lift with the vehicle thereon is lifted to the drive-in/out floor and is stopped at the position higher than the turntable, a step in which the turntable is horizontally moved to the hoist way, a step in which the lift is lowered to the position arranged with the table, and then the vehicle is loaded onto the lift and the turntable, and a step in which the vehicle is unloaded from the lift and the turntable.

The loading and unloading operations of the elevator type parking system according to the present invention will be explained with reference to the accompanying drawings.

The lifting and lowering operation of the lift, the horizontal movement of the pallet and the operation of the turntable will be first explained.

Lifting and lowering operation of lift

As shown in FIG. 4, in the lifting and lowering operation of the lift 200, when the lifting and lowering drive motor 280 of the lift lifting and lowering drive unit installed in the machinery compartment M is driven, the driving force of the lifting and lowering drive motor 280 is transferred to the driving sheave 281 through the decelerator, and the ropes R connected with the lifts 210 and 220 and the balance weight B are normally and reversely moved based on the guide sheaves 282.

At this time, when the lifting and lowering drive motor 280 is driven in the normal rotation direction, namely, the same is driven in the direction that the rope R lifts the lifts 210 and 220, the lifts 210 and 220 are lifted, and the balance weight B is lowered. On the contrary, when the lifting and lowering drive motor 280 is driven in the reverse rotation direction, namely, the ropes R lifts the balance weight B, the lifts 210 and 220 are lowered by the weights of the same.

Guiding operation of lift lifting and lowering

In the lifting and lowering operation of the lift 200, the lifting and lowering guide rollers 250 and 260 installed at the lift frames 211 and 221 of the front and rear side lifts 210 and 220 are guided by the lifting and lowering guide rail 270, and the lifting and lowering guide rollers 250 and 260 are operably installed at the roller support frames 253 and 263 fixed to the lift frames 211 and 221 and downwardly and upwardly extended, and the lifting and lowering guide rollers 250 and 260 are formed of front and rear side rollers 251 and 261 and the side rollers 252 and 262, so that the lifting and lowering guide rollers 250 and 260 slidably contact with the rear side guide surface 271 and the lateral guide surface, and thus the lifts 210 and 220 stably run without any movements in the front and rear side directions and leftward and rightward directions.

Horizontal movement operation of pallet

As shown in FIGS. 4 through 12, in the horizontal movement of the pallet, when the horizontal movement drive motors 350 and 360 of the pallet horizontal movement unit are driven, the ball screws 351 and 361 connected through the motored mechanism are rotated, and the nut boxes 355 and 365 screwed to the ball screws 351 and 361 are linearly moved in the horizontal direction based on the guide rods 354 and 364.

Therefore, the hooking member bodies 353 and 363 fixedly engaged with the nut boxes 355 and 365, the extension members 356 and 366 upwardly and downwardly extended from the hooking member bodies 353 and 363, and the hookers 357*a* and 357*b* and 367*a* and 367*b* formed in the upper and lower portions of the extension members 356 and 366 are all horizontally moved.

Here, in the state that the hooking members 352 and 362 are moved to the direction of the parking room P, the hookers 357*a* and 357*b* and 367*a* and 367*b* are positioned to be hooked with the hooking rollers 372, and when the lifts 210 and 220 pass through the position of the pallet 300, the hooking rollers 372 are not interfered with the hookers 357*a* and 357*b* and 367*a* and 367*b* since the hookers 357*a* and 357*b* and 367*a* and 367*b* are formed in a channel shape in which the inner side and upper and lower ends are opened.

When the lifts 210 and 220 arrive at the position slightly higher than the pallet 300 of the designated floor, the lower portion hookers 357*b* and 267*b* are hooked with the hooking roller 372 of the pallet 300, and when the lifts 210 and 220 arrive at the position slightly lower than the pallet 300, the upper portion hookers 357*a* and 367*a* are hooked with the hooking roller 372 of the pallet 300.

In the state that the upper portion hookers 357*a* and 367*a* of the hooking members 352 and 362 or the lower portion hookers 357*b* and 367*b* are hooked with the hooking roller 372 of the engaging member 370, when the hooking members 352 and 362 horizontally move, the pallet 300 engaged with the hooking roller 372 is horizontally moved between the parking room P and the hoist way T.

Horizontal movement guide operation of Pallet

Here, the horizontal movement of the pallet 300 is implemented when the horizontal movement guide roller 340 installed at the pallet frame 310 is guided by the horizontal movement guide rail 330 installed at the pallet support member 150.

Four horizontal movement guide rollers 340 are installed at front and rear portions of each pallet frame 310, and the distance therebetween is wider than the distance between inner end portions of the horizontal movement guide rail 330, so that when the pallet 300 is horizontally moved, at least three horizontal movement guide rails 330 are supported by the horizontal movement guide rail 330 for thereby implementing a stable operation of the pallet 300.

Rotation operation of turntable

In the state that the vehicle V is placed on the turntable forks 423 of the turntable 400, when the turntable rotation drive motor 440 rotates, the pinion 442 engaged with the shaft of the rotation drive motor 440 is rotated and is supported by the support shaft 443 fixed to the turntable base 410, and the ring gear 441 fixedly engaged with the rotation member 420 and meshed with the pinion 442 is rotated.

As the ring gear 441 is rotated, the rotation member is rotated, and the rotation member 420 of the turntable 400 changes its position direction, so that the parking direction of the vehicle V loaded on the rotation member 420 of the turntable 400 is changed.

At this time, the rotation member 420 is rotated together with the ring gear 441 supported by the support shaft 443 based on the bearing 444, so that it is possible to implement more stable operation without noise and any movements compared to the conventional rolling support method.

Horizontal movement of turntable

When the driving motor 470 of the turntable horizontal movement drive unit is rotated in the normal direction, the driving force of the same is transferred to the rotation shaft 481 through the driving sprocket 471, the motored sprocket 472, and the motored chain 473, and the rotation shaft 481 is rotated. Since the rotation shaft 481 is connected with the rotation shaft 482 through the idle sprockets 483 and 484 and the turntable driving chain 480, the turntable horizontal movement driving chain 480 is operated in the normal direction.

At this time, since the turntable horizontal movement driving chain 480 is connected with the turntable base 410 by the connection member 485, the turntable base 410 and the entire construction of the turntable 400 including the rotation member 420 are horizontally moved, namely, in the normal direction from the hoist way T to the parking room P. The turntable 400 is moved off the hoist way T and is positioned at the side of the parking room P.

When the turntable horizontal movement driving motor 470 is rotated in the reverse direction, the turntable 400 is horizontally moved in the direction from the parking room P to the hoist way T, namely, which direction is reverse to the normal direction rotation.

When the turntable 400 is horizontally moved, the turntable horizontal movement guide roller 460 operably installed at the turntable base 410 slidably contacts with the turntable horizontal movement guide rail 450 fixedly installed at the main frame 100 for thereby implementing a stable and accurate horizontal movement.

Lifting and lowering operation of footboard

When the lifting and lowering drive motor 540 is rotated in the normal direction, the rotation force is transferred to the rotation shaft 561 through the driving sprocket 562, the chain 564, and the motored sprocket 563, and the lifting and lowering drive sprocket 560 fixed to the rotation shaft 561 is rotated in the normal direction. Therefore, the lifting and lowering drive chain 550 is wound onto the lifting and lowering drive sprocket 560, and the footboard 500 connected to the end thereof through the roller support member 531 is lifted up, so that the footboard 500 is lifted to the position higher than the turntable 400.

In addition, when the lifting and lowering drive motor 540 is rotated in the reverse direction, the footboard 500 is lowered to the position of the turntable 400, which is reverse to the normal rotation direction of the lifting and lowering drive motor 540.

In the lifting and lowering operation of the footboard 500, since the lifting and lowering guide roller 530 operably-installed at the roller support member 531 engaged at both sides of the footboard 500 is slidably guided by the lifting and lowering guide rail 520 for thereby implementing a smooth lifting and lowering operation of the footboard 500.

Upper floor loading operation

Figure 22A:
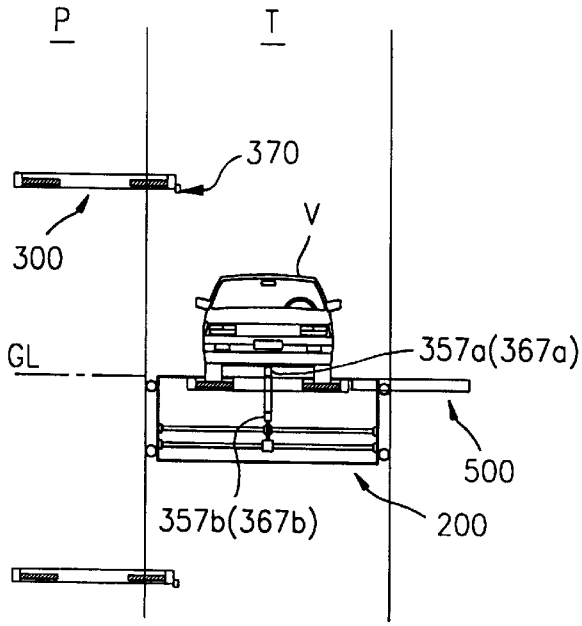
FIGS. 22A, 22B, 22C, 22D, 22E, and 22F are views illustrating an operational state for explaining an upper floor loading step of a vehicle in an elevator type parking system according to an embodiment of the present invention.

When loading the vehicle V into the parking room P of the upper floor of the drive-in/out floor, as shown in FIG. 22*a*, the lifts 210 and 220 are lifted or lowered in the above-described manner before the vehicle V is loaded, and then the lift forks 230 and 240 and the turntable forks 423 are alternately engaged on the same plane as the height of the drive-in/out floor, and the footboard drive unit is operated, and the footboard 500 is positioned at the same height as the turntable 400.

In this state, the vehicle V coming in through the drive-in/out port runs on the lift forks 230 and 240 and the turntable forks 423 through the front side deck panel of the deck panels 430 installed at both sides of the rotation shaft 420 of the turntable 420 and is stopped at the designated position for thereby finishing the drive-in operation of the vehicle V.

At this time, the lift forks 230 of the front side lift 210 are alternately engaged with the inner and outer forks 423*a* and 423*b* of the turntable forks 423, and the lift forks 240 of the rear side lift 220 are alternately engaged with the outer forks 423*b* of the turntable forks 423 and are not alternately engaged with the inner side forks 423*a*.

Here, the surface area of the outer forks 423*b* of the turntable forks 423 is narrow, and the lift forks 230 and 240 are alternately engaged therewith. Therefore, a predetermined gap is formed between the neighboring forks for thereby implementing a stable running operation by preventing an over load from being applied to the forks. The inner forks 423*a* of the turntable forks 423 are not alternately engaged with the lift forks 230 and 240. In this case, since the surface area of the same is wide, it is possible to implement a stable operation of the vehicle V by preventing an over load from being applied to the forks. As a result, in a state that the lifts 210 and 220 are placed on the same plane as the turntable 400, the vehicle V stably runs on the lift forks 230 and 240 and the turntable forks 423.

The wheels of the vehicle V at the normal position are positioned on the outer forks 423*b* of the turntable forks 423 and the lift forks 230 and 240. Therefore, when the lifts 210 and 220 are lifted, the vehicle V are placed on the lift forks 230 and 240 and then are lifted up.

At this time, since the footboard 500 maintains the same height as the turntable 400 based on the lifting and lowering operation of the lifting and lowering drive unit, the vehicle driver got off from the vehicle V after the drive-in/out operation is finished stably gets off on the footboard 500.

The vehicle V is generally positioned with its head portion being positioned at the side of the rear side lift 220. When the vehicle comes out, since the read side of the vehicle V is in the side of the drive-in/out port, it is difficult to drive out the vehicle V.

Therefore, in order to implement an easier drive-out operation of the vehicle V, the rotation member 420 of the turntable 400 is rotated with its head portion of the vehicle V heading for the drive-in/out port.

The rotation operation of the rotation member 420 of the turntable 400 will be explained.

First, in a state that the vehicle V is loaded on the lifts 210 and 220 and the turntable 400, the lifting and lowering drive unit of the lifts 210 and 220 is driven, and the lifts 210 and 220 are lowered to the position slightly lower than the rotation member 420 of the turntable 400. In this state, the vehicle V on the lifts 210 and 220 and the turntable 400 is loaded on the rotation member 420 of the turntable 400. In this state, the turntable rotation drive unit is operated, and then the rotation member 420 is rotated, so that the parked direction of the vehicle V is changed, and the front portion of the vehicle V is headed for the front side lift 210.

The drive-in operation and the getting-off of the driver are finished, the lifts 210 and 220 are lifted by the operation of the lift lifting and lowering drive unit. Therefore, the vehicle V loaded on the lift forks 230 and 240 and the turntable forks 423 is lifted to the designated floor in the state that the vehicle V are loaded on the lift forks 230 and 240.

In addition, the hooking members 352 and 362 of the parking unit drive unit installed in the lifts 210 and 220 and hooked by the engaging member 370 installed in the side of the pallet 300 are moved to the position in which the same is hooked with the engaging member 370 while the hooking members 352 and 362 are moving to the pallet 300 of the designated floor.

The hooking members 352 and 362 of the pallet horizontal movement unit are not moved to the position for the hooking operation of the engaging member 370 at the moment when the lifts 210 and 220 arrives at the pallet 300 of the designated floor.

Figure 22B:
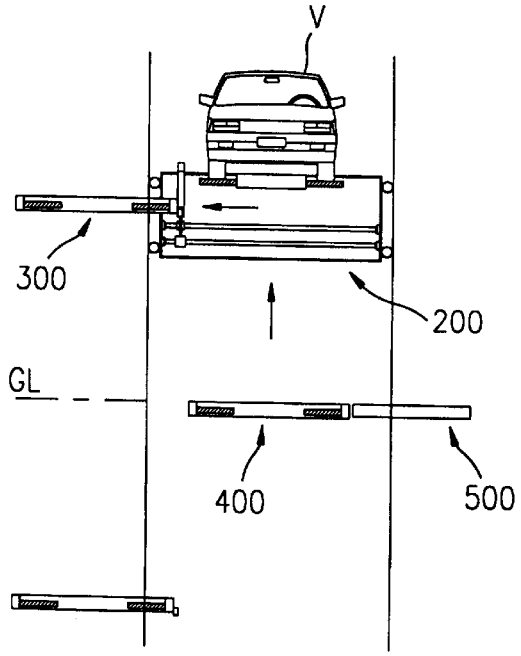

Namely, the hooking members 352 and 362 are moved to the position in which the same may be hooked by the engaging member 370, and when the lifts 210 and 220 as shown in FIG. 22B are moved to the position slightly higher than the pallet 300 of the designated floor, the lower side hookers 357*b* and 367*b* of the hooking members 352 and 362 are hooked by the engaging member 370 of the pallet 300 without an additional operation of the pallet horizontal movement unit.

When the lifts 210 and 220 arrive at the position slightly higher than the pallet 300 of the designated floor, the position detection unit (not shown) installed in the main frame 100 and the lift 200 detects the position of the lifts 210 and 220 and stops the operation of the lift lifting and lowering drive unit, so that the lifts 210 and 220 stop.

In the present invention, the hooking members 352 and 362 are moved to the position in which the same are hooked by the engaging member 370 while the lifts 210 and 220 are being moved, so that it is possible to decrease time required for moving the hooking members 352 and 362 to the position in which the same are hooked by the engaging member 370 after the lifts 210 and 220 arrived at the position of the pallet 300 of the designated floor.

When the lifts 210 and 220 with the vehicle V thereon stop at the position slightly higher than the lift 300 of the designated floor, the horizontal movement drive motors 350 and 360 of the pallet horizontal movement unit are operated, and the ball screws 351 and 361 connected through the motored mechanism are rotated, so that the nut boxes 355 and 365 screwed by the ball screws 351 and 361 are moved to the hoist way T and the hooking members 352 and 362 are moved to the hoist way T.

Figure 22C:
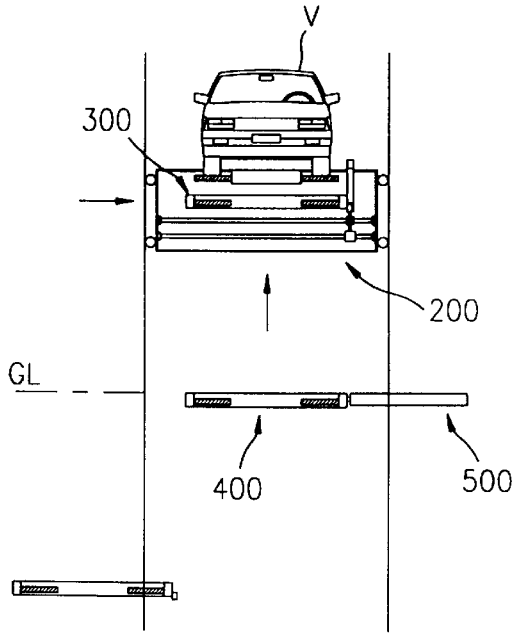
Figure 22D:
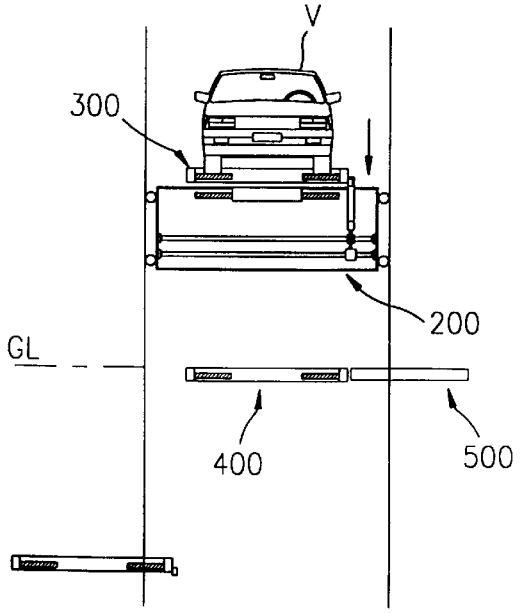
Figure 22E:
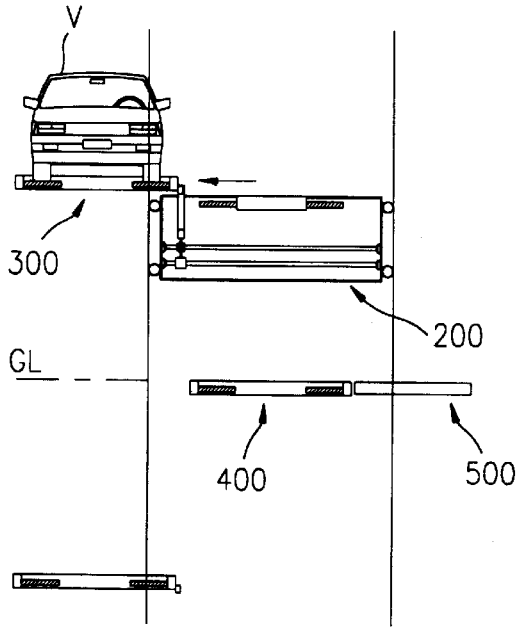
Figure 22F:
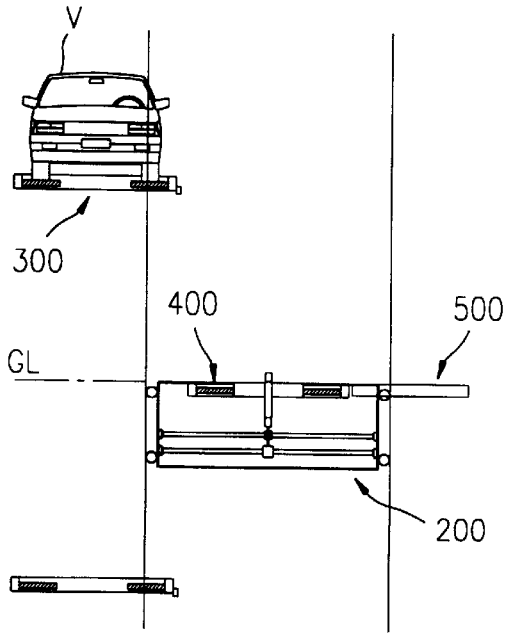

FIGS. 22A, 22B, 22C, 22D, 22E, and 22F are views illustrating an operational state for explaining an upper floor loading step of a vehicle in an elevator type parking system according to an embodiment of the present invention described hereinafter. FIG. 22A and FIG. 22B illustrate operational positions where the lift 200 is positioned at the ground level GL and at an upper level, respectively. FIG. 22C and FIG. 22D illustrate operational positions where the vehicle V is transferred from a position supported by the lift 200 to a position supported by the pallet 300, respectively. FIG. 22E and FIG. 22F illustrate operational positions where the pallet 300 is moved to the parking room P adjacent to the hoist way.

The engaging member 370 in the side of the pallet 300 of the designated floor to which the lower hookers 357*b* and 367*b* of the hooking members 352 and 362 are backwardly moved toward the hoist way T, so that the pallet 300 is moved to the side of the hoist way T and are stopped below the lifts 210 and 220.

In this state, the lift lifting and lowering drive unit is operated for lowering the lifts 210 and 220 to the position lower than the pallet 300, and the vehicle loaded on the lifts 210 and 220 as shown in FIG. 22D becomes a state that the vehicle V is loaded on the pallet 300.

At this time, since the lift forks 230 and 240 and the pallet forks 320 are alternately engaged, the same are not interfered when lowering the lifts 210 and 220 to the position lower than the pallet 300.

The lifts 210 and 220 are lowered to the position in which the hookers 357*a*and 367*a* of the hooking members 352 and 362 are hooked by the engaging member 370 of the pallet 300.

Next, the parking unit driving is driven, and the hooking members 352 and 362 are moved to the parking room P, so that the upper side hookers 357*a* and 367*a* of the hooking members 352 and 362 push the engaging member 370 of the pallet 300 in the direction of the parking room P. Therefore, the pallet 300 with the vehicle thereon is horizontally moved to the parking room P.

Thereafter, the lift lifting and lowering drive unit is operated, and the lifts 210 and 220 are lowered to the drive-in/out floor as shown in FIG. 22F, so that the upper floor loading operation with respect to the vehicle V is completed.

Upper floor unloading operation

Figure 23A:
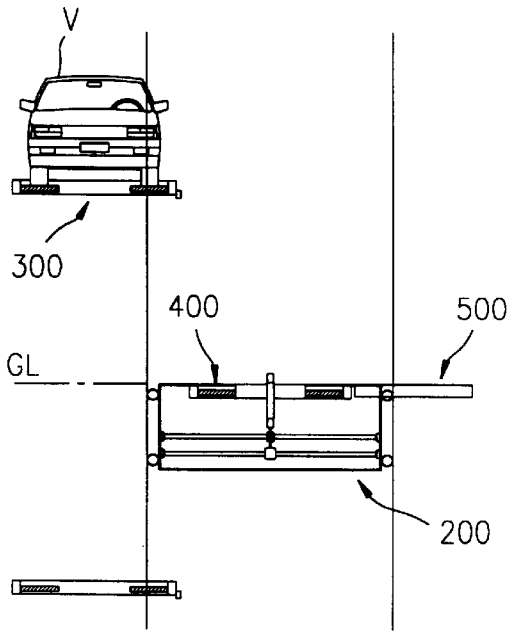
FIGS. 23A, 23B, 23C, 23D, 23E, and 23F are views illustrating a operational state for explaining an upper floor unloading step of a vehicle in an elevator type parking system according to the present invention.

When unloading the vehicle V from the upper floor parking room P above the drive-in/out floor, the lifts 210 and 220 are lifted to the designated floor by the lift lifting and lowering drive unit as shown in FIG. 23A.

The footboard 500 is positioned at the same height as the turntable 400 by the operation of the footboard lifting and lowering unit.

Figure 23B:
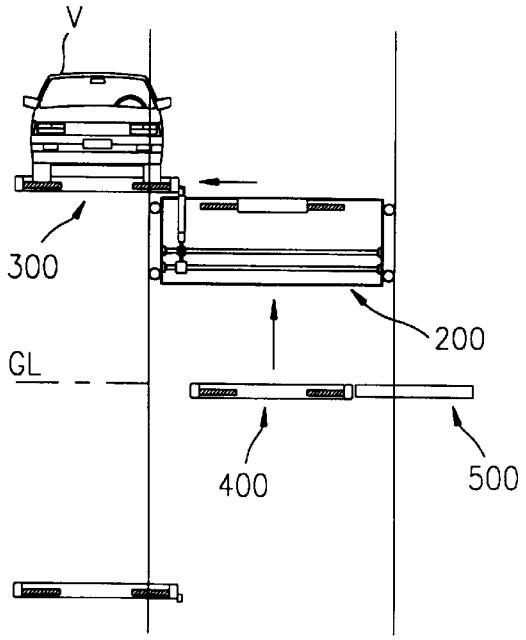

When the hooking members 352 and 362 are moved to the parking room P by the operation of the parking unit driving unit while the lifts 210 and 220 are lifted, and the lifts 210 and 220 as shown in FIG. 23*b* arrive at the position slightly lower than the pallet 300 of the designated floor, the upper side hookers 357*a* and 367*a* of the hooking members 352 and 362 are hooked by the engaging member 370 of the pallet 300.

Figure 23C:
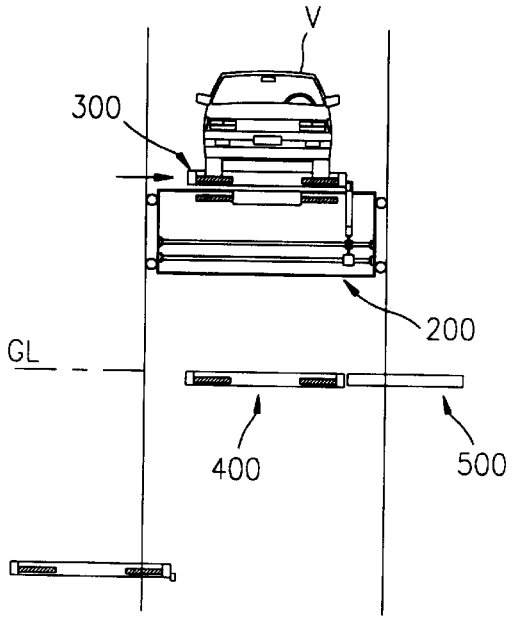
Figure 23D:
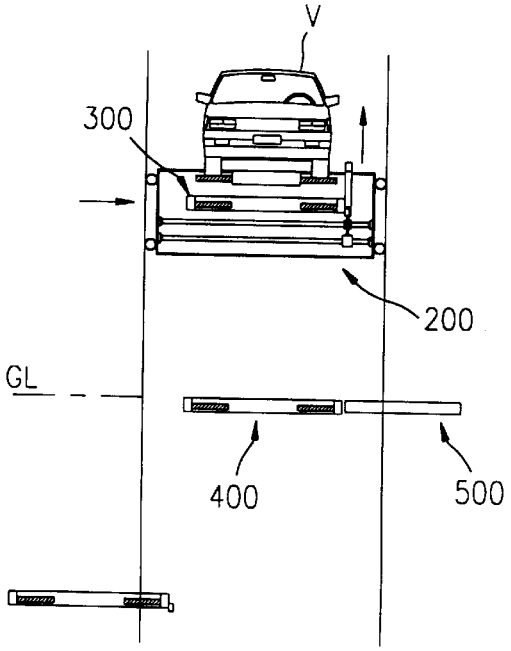

In this state, the lifts 210 and 220 are stopped, and the parking unit driving unit is driven. Thereafter, the hooking members 352 and 362 are moved to the hoist way T. The pallet 300 having the engaging member 370 hooked by the upper side hookers 357*a* and 367*a* of the hooking members 352 and 362 is positioned on the lifts 210 and 220 as shown in FIG. 23C.

When the lifts 210 and 220 are lifted to the position higher than the pallet 300, the vehicle V becomes a state that the vehicle V is loaded on the lifts 210 and 220. As the lifts 210 and 220 are lifted, the lower side hookers 357*b* and 367*b* of the hooking members 352 and 362 are hooked by the engaging member 370 of the pallet 300.

Figure 23E:
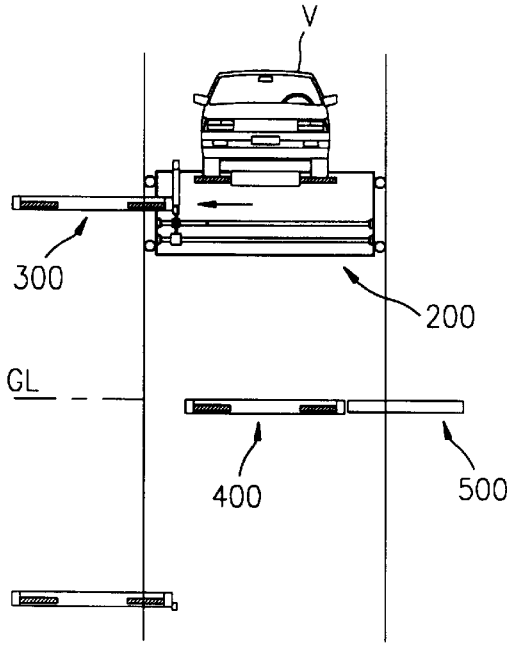

When the parking unit driving unit is moved to the parking room P, the pallet 300 having the engaging member 370 hooked by the lower side hookers 357*b* and 367*b* of the hooking members 352 and 362 returns to the parking room P as shown in FIG. 23E.

Figure 23F:
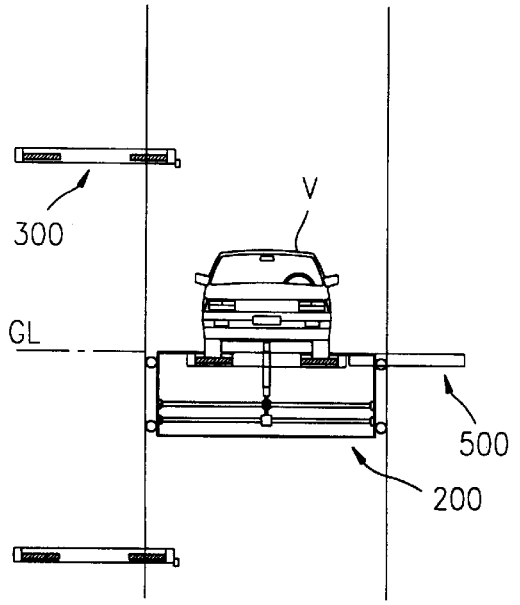

Thereafter, the lifts 210 and 220 with the vehicle thereon V are lowered to the position of the drive-in/out floor as shown in FIG. 23F, so that the vehicle V is placed on the lift forks 230 and 240 and the turntable forks 423.

In this state, the vehicle driver stands on the footboard 500 at the same height as the turntable 400 and then gets into the vehicle V and drives to the outside for thereby completing the unloading operation.

At this time, when unloading the vehicle V parked with its head portion being headed for the opposite side of the drive-in/out floor, in the case that the vehicle is lowered in a state that the front side of the vehicle V is loaded on the rear side lift 220, and then the vehicle V loaded on the lifts 210 and 220 and the turntable 400 is unloaded, the lifts 210 and 220 are lowered to the position lower than the rotation member 420 of the turntable 400, and the wheels of the vehicle V are placed on only the turntable forks 423, and then the rotation member 420 is rotated by the turntable rotation drive unit, so that the front side of the vehicle faces the drive-in/out port for thereby completing the unloading operation.

Lower floor loading operation

Figure 24A:
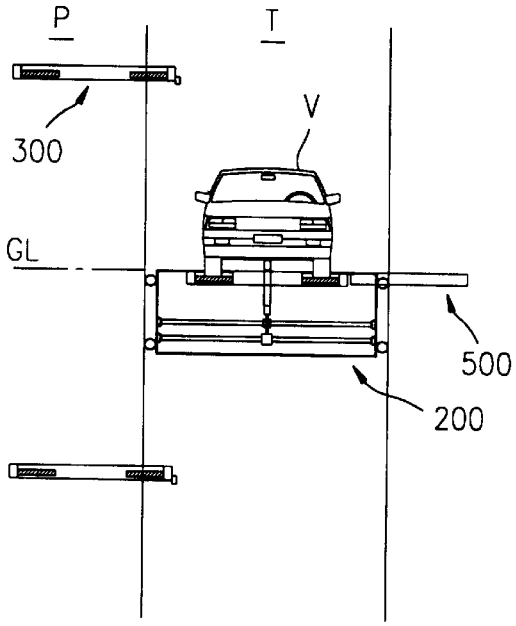
FIGS. 24A, 24B, 24C, 24D, 24E, 24F, 24G, and 24I are views illustrating an operational state for explaining a lower floor loading step of a vehicle in an elevator type parking system according to the present invention.

When the vehicle V is loaded into the lower floor parking room P positioned below the lobby floor, the lifts 210 and 220 are positioned at the lobby floor as shown in FIG. 24A, and then the lift forks 230 and 240 and the turntable forks 423 are alternately engaged at the same height as the surface height of the drive-in/out floor.

The footboard 500 maintains the same height as the turntable 400 by the operation of the footboard lifting and lowering unit.

In this state, the vehicle V driving in and out through the drive-in/out port runs on the lift forks 230 and 240 and the turntable forks 423 through the front side deck panel 430 and stops on the set position for thereby completing the loading operation of the vehicle.

At this time, the lift forks 230 of the front side lift 210 are alternately engaged with the inner and outer side forks 423*a* and 423*b* of the turntable 423, and the lift forks 240 of the rear side lift 220 are alternately engaged with the outer side forks 423*b* of the turntable forks 423 and are alternately not engaged with the inner side forks 423*a*.

Here, the outer side forks 423*b* of the turntable forks 423 have narrow surface areas. However, since the life forks 230 and 240 are alternately engaged, there are small gaps between the forks of the lift 200 and the turntable 400 for thereby implementing a stable operation without any impact. The inner side forks 423*a* of the turntable forks 423 are not alternately engaged with the lift forks 230 and 240 but have wider surface area, so that the vehicle V stably runs thereon.

The vehicle V in position is positioned on the outer forks 423*b* of the turntable forks 423 and the lift forks 230 and 240.

Since the footboard 500 maintains a state lowered to the same height as the turntable 400 by the lifting and lowering operation of the lifting and lowering floor drive unit, the vehicle driver got off from the vehicle V after the drive-in/out operation is completed stably gets off using the footboard 500.

The head portion of the positioned vehicle V generally heads for the rear side lift 220. Therefore, since the rear portion of the vehicle V heads for the drive-in/out port, it is inconvenient for unloading the vehicle.

Therefore, for easily unloading the vehicle, the rotation member 420 of the turntable 400 is driven, so that the front portion of the vehicle V is rotated to head for the drive-in/out port.

Since the rotation operation of the rotation member 420 of the turntable 400 is the same as the upper floor loading operation, the description thereof will be omitted.

Figure 24B:
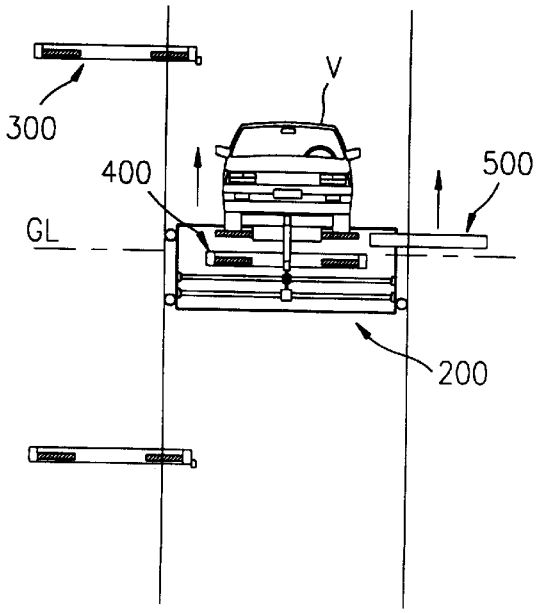
Figure 24C:
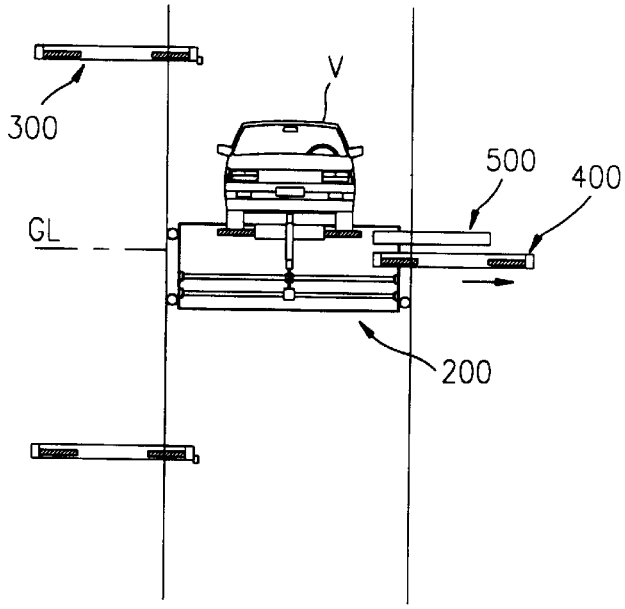
Figure 24D:
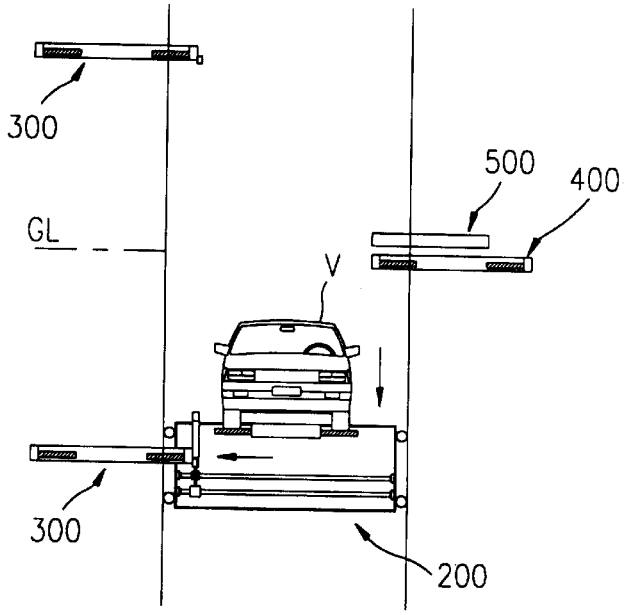

When the driving-in and out operation of the vehicle V is completed, and the driver gets off from the vehicle, as shown in FIG. 24B, the lifts 210 and 220 are lifted to the position in which the horizontal movement of the turntable 400 is not interfered, and the vehicle V is loaded onto the lift forks 230 and 240 of the lifts 210 and 220. As shown in FIG. 24C, the turntable 400 is horizontally moved from the hoist way T to the parking room P by the turntable horizontal movement unit, so that the lowering operation of the lifts 210 and 220 are not interfered.

In this state, when the lifts 210 and 220 are lowered by the operation of the lift lifting and lowering drive unit, the vehicle V is lowered to the designated floor in a state that the vehicle V is loaded on the lift forks 230 and 240.

In addition, the hooking members 352 and 362, which are installed at the lifts 210 and 220, of the pallet horizontal movement unit hooked by the engaging member 370 in the side of the pallet 300 are moved to the position for being hooked by the engaging member 370 while the lifts 210 and 220 are lowered below the drive-in/out floor and are moved to the pallet 300 of the designated floor.

Namely, the hooking members 352 and 362 of the pallet horizontal movement unit are not moved to the position for being hooked by the engaging member 370 at the time when the lifts 210 and 220 arrive at the position of the pallet 300 of the designated floor. Namely, the hooking members 352 and 362 of the same are moved to the position for being hooked by the engaging member 370 before the lifts 210 and 220 arrive at the designated floor. Therefore, when the lifts 210 and 220 arrive at the position slightly higher than the pallet 300 of the designated floor, the lower side hookers 357*b* and 367*b* of the hooking members 352 and 362 are hook ed by the engaging member 370 of the pallet 300 without a further operation of the pallet horizontal movement unit.

Thereafter, when the lifts 210 and 220 are continuously lowered and reach the position slightly higher than the pallet 300 of the designated floor, the position detection unit (not shown) installed at the main frame 100 and the lift 200 detects the positions of the lifts 210 and 220, and stops the operation of the lift lifting and lowering drive unit, so that the lifts 210 and 220 stop at a predetermined position.

The hooking members 352 and 362 of the parking unit driving unit are moved to the position for being hooked by the engaging member 370 while the lifts 210 and 220 are moved to the designated floor, so that it is possible to decrease the operation time required for an additional operation compared to the conventional art in which when the lifts 210 and 220 arrive at the position of the pallet 300 of the designated floor and then are moved to the position in order for the hooking members 352 and 362 to be hooked by the engaging member 370 by an additional operation.

When the lifts 210 and 220 with the vehicle V thereon arrive at the position slightly higher than the pallet 300 of the designated floor, the horizontal movement drive motors 350 and 360 of the pallet horizontal movement unit are operated, and the ball screws 351 and 361 connected through the motored mechanism are rotated, so that the nut boxes 355 and 365 screwed to the ball screws 351 and 361 are moved toward the hoist way T, and the hooking members 352 and 362 are moved to the hoist way T.

Figure 24E:
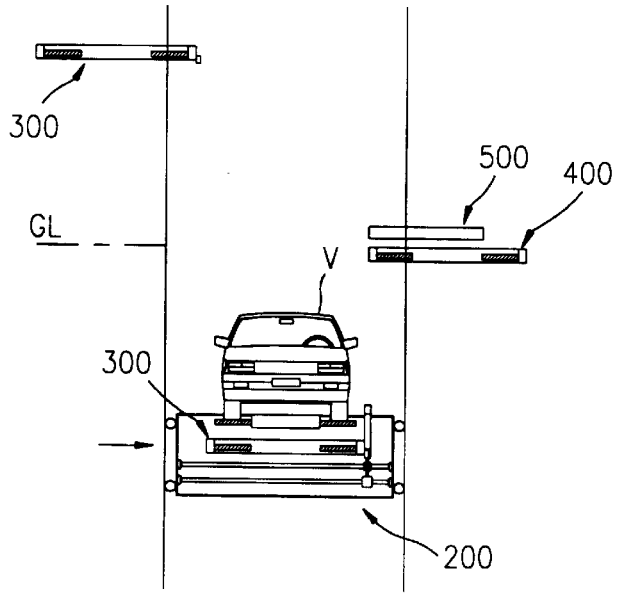

The engaging member 370 in the side of the pallet 300 of the designated floor to which the lower side hookers 357*b* and 367*b* of the hooking members 352 and 362 are hooked are pulled in the direction of the hoist way T. Therefore, as shown in FIG. 24E, the pallet 300 is moved in the direction of the hoist way T and is positioned below the lifts 210 and 220.

Figure 24F:
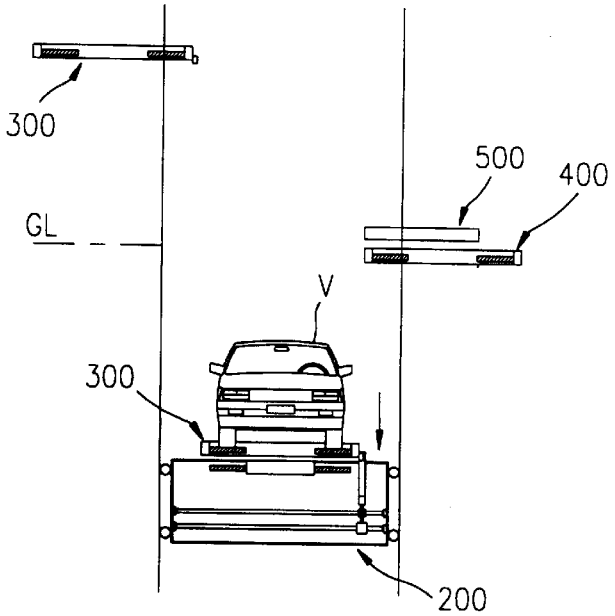

In this state, the lift lifting and lowering drive unit is driven, and the lifts 210 and 220 are lowered below the pallet 300. As shown in FIG. 24F, the vehicle V loaded on the lifts 210 and 220 are moved to the pallet 300.

At this time, since the lift forks 230 and 240 and the pallet forks 320 are alternately engaged, when lowering the lifts 210 and 220 below the pallet 300, there will be not interference between the lift forks 230 and 240 and the pallet forks 320.

The lifts 210 and 220 are lowered to the position in which the upper side hookers 357*a* and 367*a* of the hooking members 352 and 362 are hooked by the engaging member 370 of the pallet 300 and are stopped.

Figure 24G:
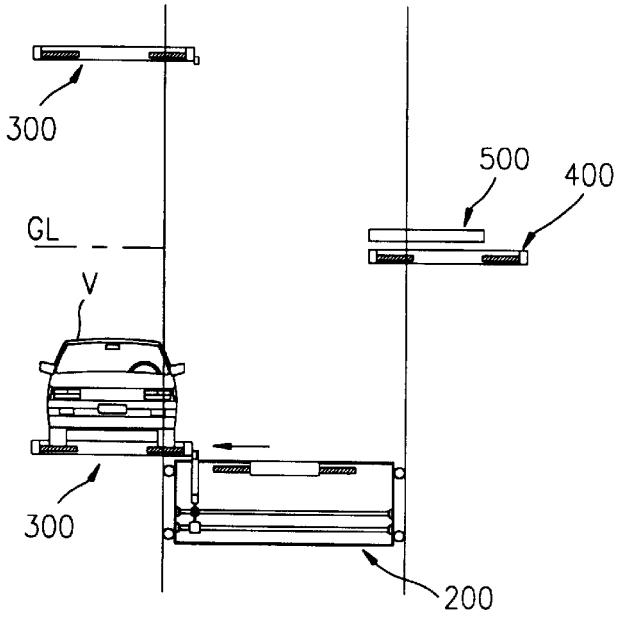

Next, the pallet horizontal movement unit is driven, and the hooking members 352 and 362 are moved in the direction of the parking room P. At this time, the upper side hookers 357*a* and 367*a* of the hooking members 352 and 362 push the engaging member 370 of the pallet 300 in the direction of the parking room P, so that the pallet 300 with the vehicle thereon is horizontally moved and returns to the parking room P as shown in FIG. 24G.

Figure 24H:
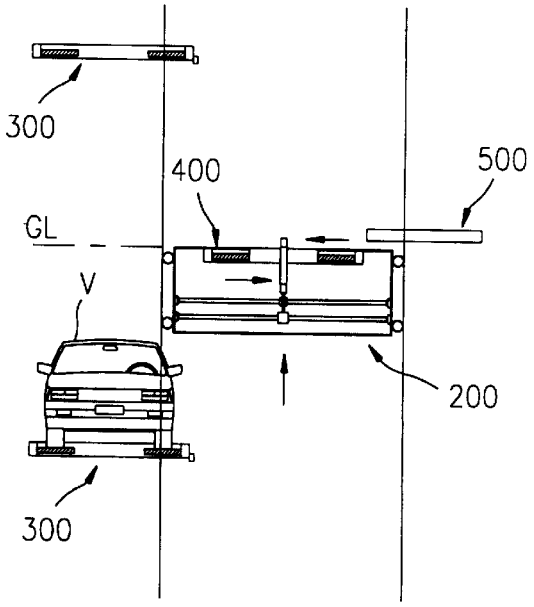
Figure 24I:
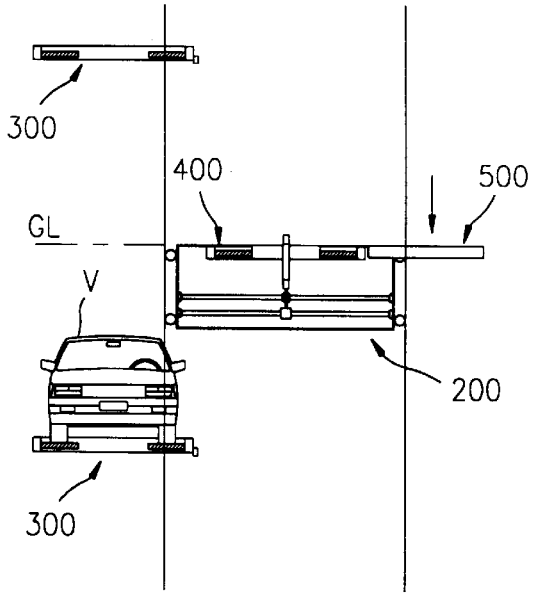

The lift lifting and lowering drive unit is driven, and the lifts 210 and 220 are lifted to the drive-in/out floor as shown in FIG. 24H.

In addition, the turntable 400 horizontally moved toward the parking room P is horizontally moved in the direction of the hoist way T before the lifts 210 and 220 arrive at the drive-in/out floor.

Therefore, when the lifts 210 and 220 arrive at the drive-in/out floor, the turntable 400 and the lifts 210 and 220 return to the same state as the original drive-in/out state.

In addition, as shown in FIG. 241, the footboard 500 lifted to the position higher than the turntable 400 is lowered, and the driver stands on the footboard 500 and gets into the vehicle for thereby driving out the vehicle.

The turntable 400 is horizontally moved to the hoist way T from the time when the lifts 210 and 220 are lowered to the time when the vehicle V is moved to the pallet 300 of the lower floor parking room P and then arrives at the drive-in/out floor. In addition, the footboard 500 is lowered to the same position as the turntable 400 from the time when the turntable 400 is returned to the side of the hoist way T to the time when the lifts 210 and 220 arrive at the drive-in/out floor for thereby completing a lower floor loading operation of the vehicle V.

Lower floor unloading operation

Figure 25A:
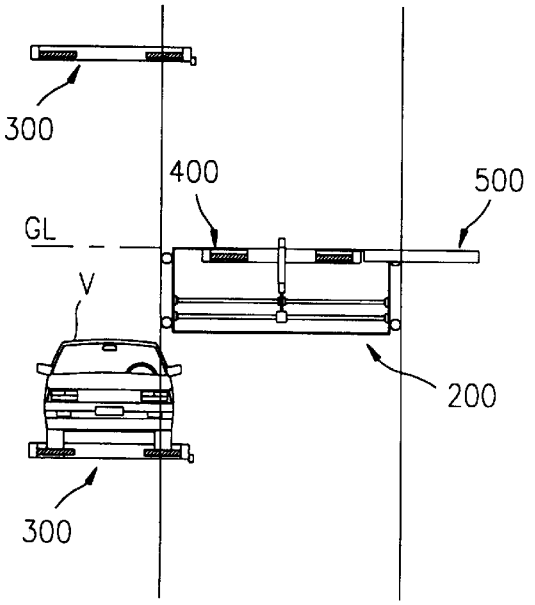
FIGS. 25A, 25B, 25C, 25D, 25E, 25F, 25G, and 25I are views illustrating an operational state for explaining a lower floor unloading step of a vehicle in an elevator type parking system according to the present invention.
Figure 25B:
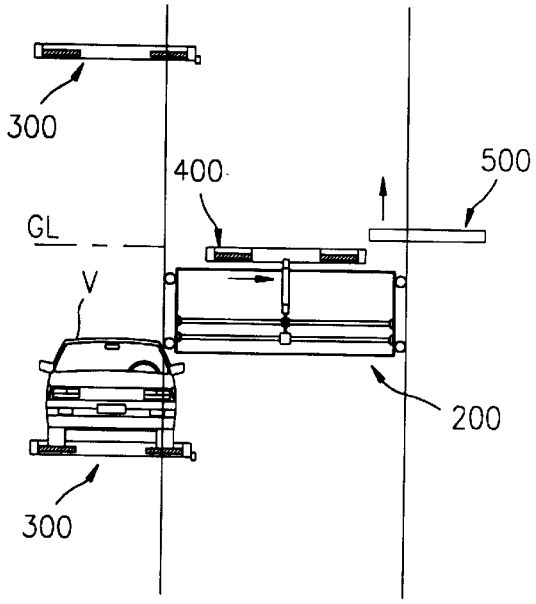
Figure 25C:
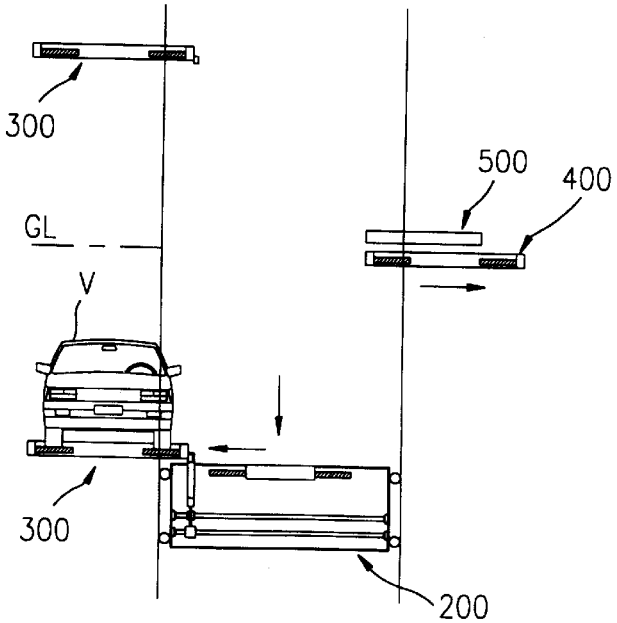

When unloading the vehicle V from the parking room P in the lower floor of the drive-in/out floor, as shown in FIG. 25A, in a state that the lifts 210 and 220, the turntable 400 and the footboard 500 are positioned at the drive-in/out floor, the footboard 500 is lifted to the position by the lifting and lowering unit in which the horizontal movement of the turntable 400 is not interfered as shown in FIG. 25B. In addition, as shown in FIG. 25C, the turntable 400 is horizontally moved from the hoist way T to the parking room P by the turntable horizontal movement unit so that the lifts 210 and 220 are lowered to the lower floor.

Figure 25D:
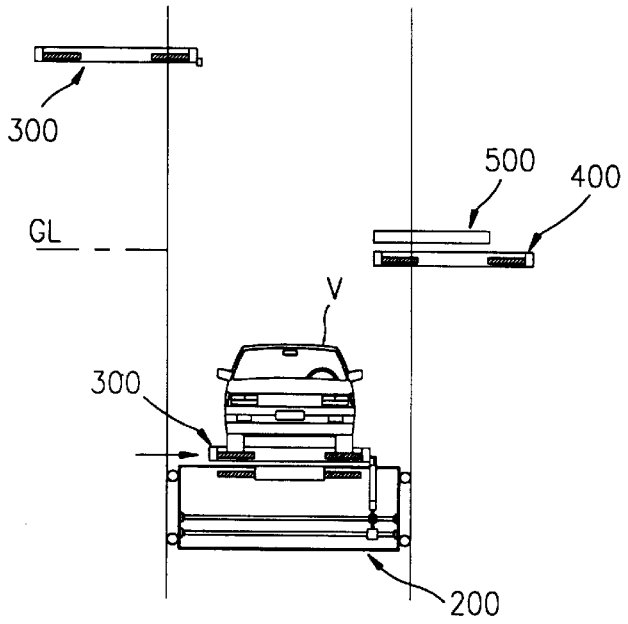
Figure 25E:
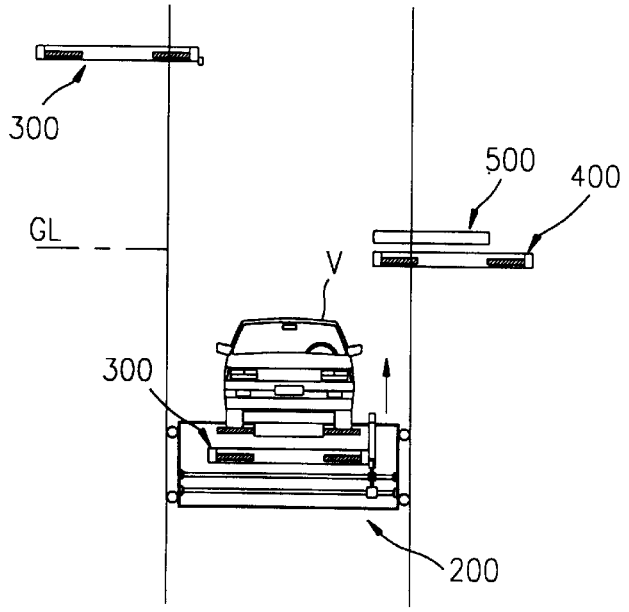

The lifts 210 and 220 are lowered to the designated floor by the lift lifting and lowering unit and stop at the position slightly lower than the pallet 300 of the designated floor as shown in FIG. 25D.

At this time, the hooking members 352 and 362 are moved to the parking room P by the operation of the pallet horizontal movement unit while the lifts 210 and 220 are lowering. When the lifts 910 and 220 arrive at the position slightly lower than the pallet 300 of the designated floor, the upper side hookers 357*a* and 367*a* of the hooking members 352 and 362 are hooked by the engaging member 370 of the pallet 300.

In this state, the lifts 210 and 220 are stopped, and the pallet horizontal movement unit is driven, and the hooking members 352 and 362 are moved toward the hoist way T. At this time, since the engaging member 370 of the pallet 300 is hooked by the upper side hookers 357*a* and 367*a* of the hooking members 352 and 362, the pallet 300 is positioned above the lifts 210 and 220.

As shown in FIG. 25A, the lifts 210 and 220 are lifted again to the position slightly higher than the pallet 300, so that the vehicle V is placed on only the lifts 210 and 220.

As the lifts 210 and 220 are slightly lifted, the lower side hookers 357*b* and 367*b* of the hooking members 352 and 362 are hooked by the engaging member 370 of the pallet 300.

Figure 25F:
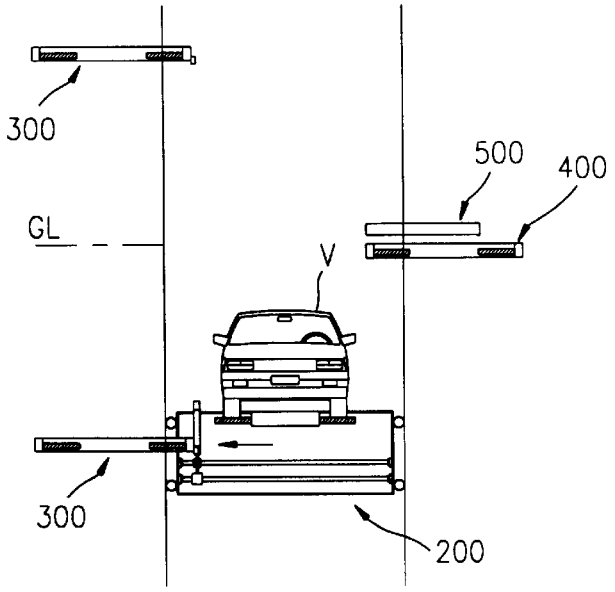

In this state, the pallet horizontal movement unit is operated, and the hooking members 352 and 362 are moved to the parking room P. As shown in FIG. 25F, since the pallet 300 is hooked by the lower side hookers 357*b* and 367*b* of the hooking members 352 and 362, the pallet 300 is returned to the parking room P.

Figure 25G:
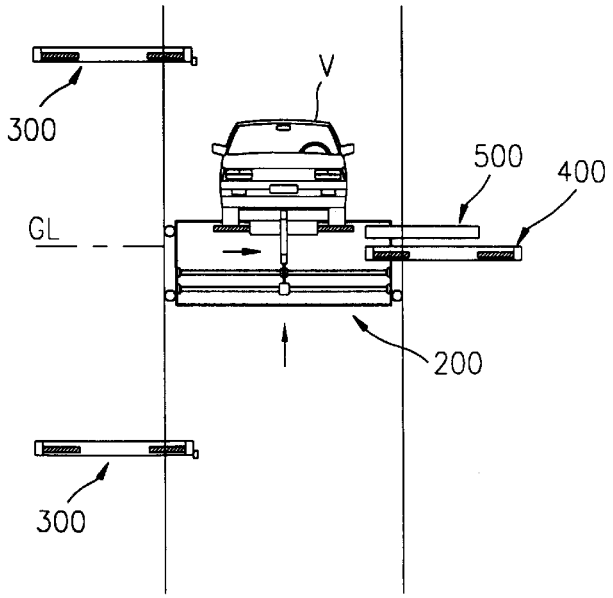
Figure 25H:
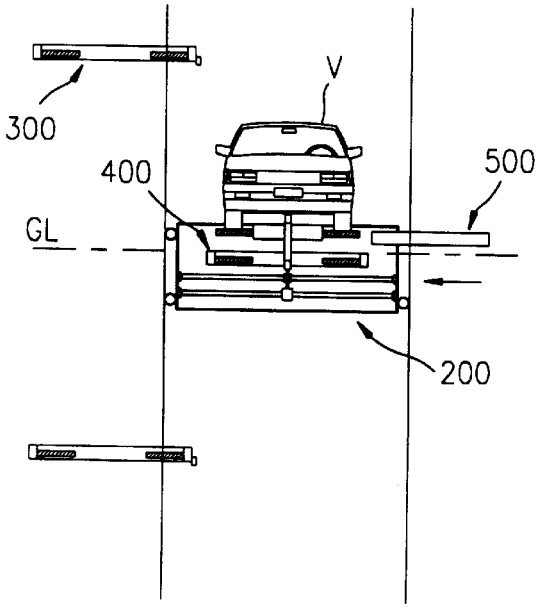
Figure 25I:
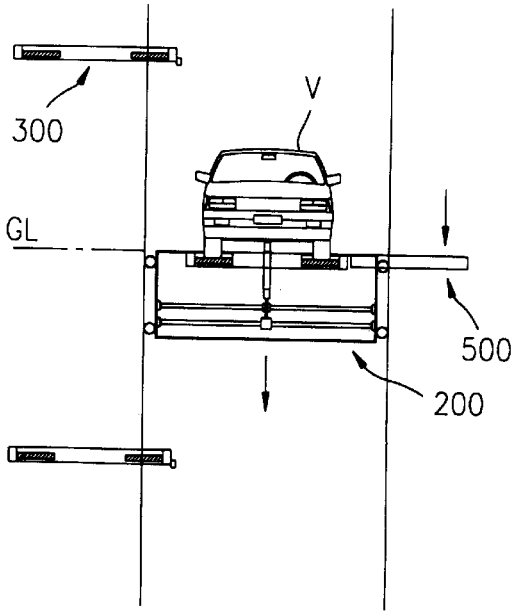

The lifts 210 and 220 with the vehicle V thereon are lifted to the drive-in/out floor as shown in FIGS. 25G through 25I, and the vehicle V is placed on the lift forks 230 and 240 and the turntable forks 423 like the initial loading stage, and the footboard 500 is lowered to the position having the same height as the turntable 400.

The vehicle driver stands on the lifting and lowering floor which is lowered to the position having the same height as the turntable 400 and the gets into the vehicle V and drives out from the drive-in/out port for thereby completing an unloading operation of the vehicle V.

At this time, when unloading the vehicle V having its head portion heading for the opposite side of the drive-in/out port, the vehicle V is lowered with its head portion being parked on the rear side lift 220, and then the vehicle V loaded on the lifted 210 and 220 and the turntable 400 is unloaded with its head portion heading for the opposite side of the drive-in/out port. In this case, the lifts 210 and 220 are lowered to the position lower than the rotation member 420, and in a state that the wheels of the vehicle V are placed on only the turntable forks 423, the rotation member 420 is rotated by the turntable rotation drive unit, and the front portion of the vehicle V is rotated to head for the drive-in/out port for thereby easily unloading the vehicle.

Figure 26:
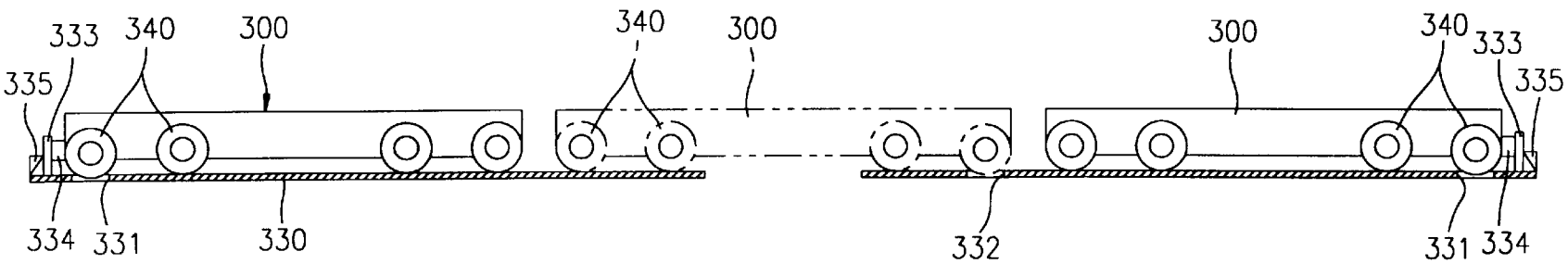
FIG. 26 is a vertical cross-sectional side view illustrating a parking unit horizontal movement guide unit for an elevator type parking system according to another embodiment of the present invention.

As shown in FIG. 26, the pallet horizontal movement guide unit of the elevator type parking system according to a first embodiment of the present invention includes a pallet escape and pallet shaking prevention unit having a roller support groove 331 in which one of the horizontal movement guide rollers 340 of the pallet 300 is inserted into the pallet horizontal movement rail 330 of the pallet horizontal movement guide unit, so that when the pallet 300 is positioned in the parking room P, the escape and shaking of the pallet 300 is prevented.

In the pallet escape and shaking prevention unit, an outer roller support groove 331 is formed in one side of the pallet horizontal movement guide rail 330 so that one of the pallet horizontal movement guide rollers 340 is inserted into the outer roller support groove 331 when the panel 300 is positioned in the parking room P, and an inner roller support groove 332 is formed in the other side of the pallet horizontal movement guide rail so that one of the pallet horizontal movement guide rollers 340 is inserted into the inner roller support groove 332 when the outer roller support groove 331 and the pallet 300 are positioned to be arranged with the lift 200.

A stopper 333 is formed at an outer end portion of the pallet horizontal movement guide rail 330 in the portion further than the outer roller support groove 331, and a buffer member 334 is formed on the inner side of the stopper 333 for buffering the impact force of the pallet 300, and a reinforced member 335 is formed at the pallet horizontal movement guide rail 330 for increasing the strength of the stopper 333 on the outer surface of the stopper 333.

Since the construction and operation of the above-described embodiments of the present invention are the same as the earlier embodiment of the present invention, only the features different therefrom will be explained with reference to the accompanying drawings.

In the description, the same elements as the elements in the earlier embodiment will be given the same reference numerals.

In this embodiment of the present invention, when the pallet 300 is parked in the parking room P, one of the pallet horizontal movement guide rollers 340 is inserted and supported by the outer roller support groove 331 for thereby preventing an escape and shaking of the pallet 300. When the pallet 300 is at the same position as the lift 200, one of the pallet horizontal movement guide rollers 340 is inserted and supported by the inner roller support groove 332 for thereby preventing an escape and shaking. Therefore, in a state that the vehicle V is loaded on the pallet 300 and is parked in the parking room P, the shaking of the pallet 300 is prevented when the vehicle V is moved from the lift 200 to the pallet 300 or from the pallet 300 to the lift 200 for thereby stably moving the vehicle V between the lift 200 and the pallet 300.

The stopper 333 is formed to prevent the occasion that the vehicle V runs beyond the pallet horizontal movement guide rail 330 when the pallet 300 moves to the parking room P, so that the pallet 300 and the vehicle V may collide with each other.

Figure 27:
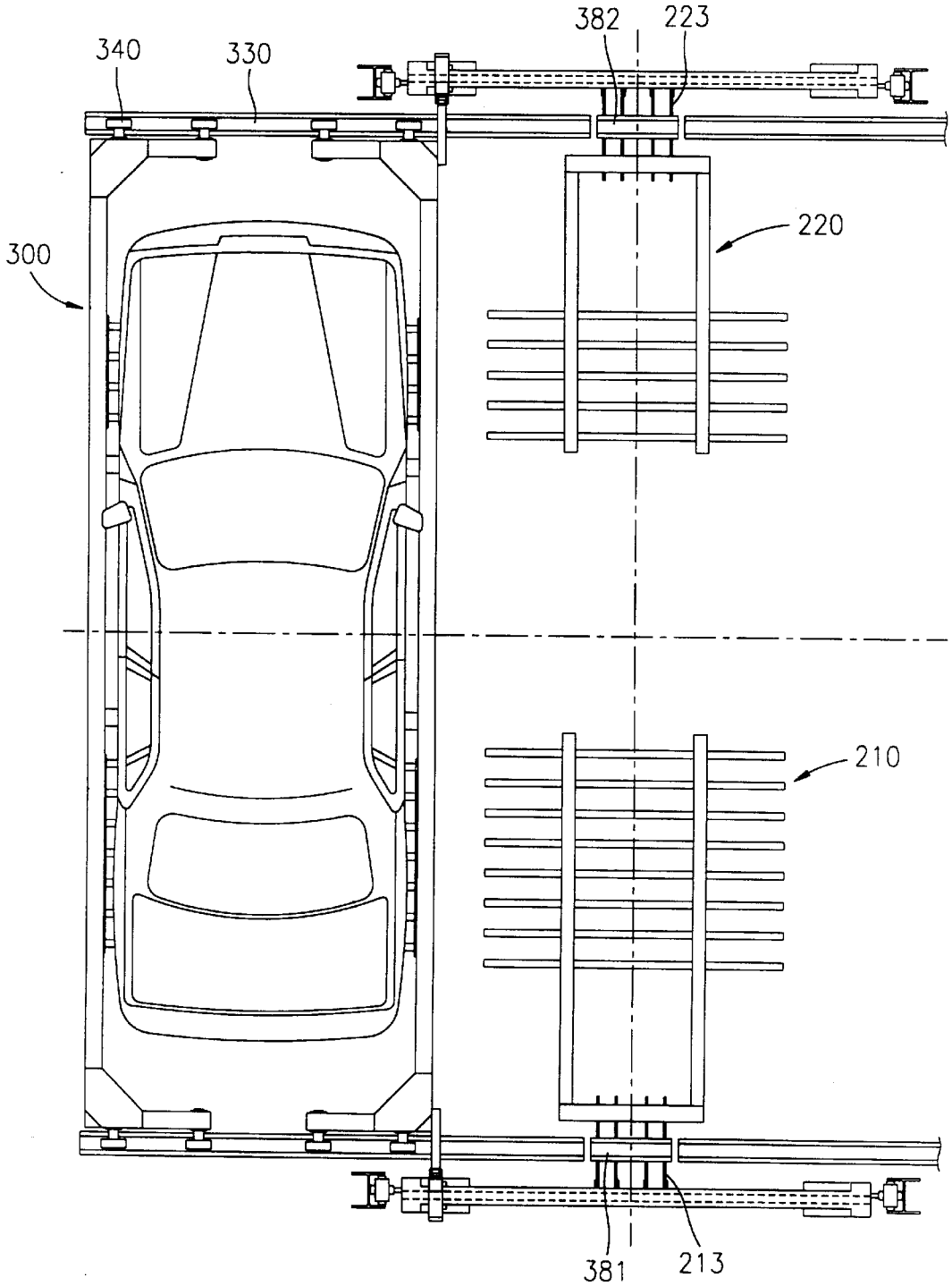
FIG. 27 is a plan view illustrating a parking unit horizontal movement guide unit for an elevator type parking system according to the present invention.
Figure 28:
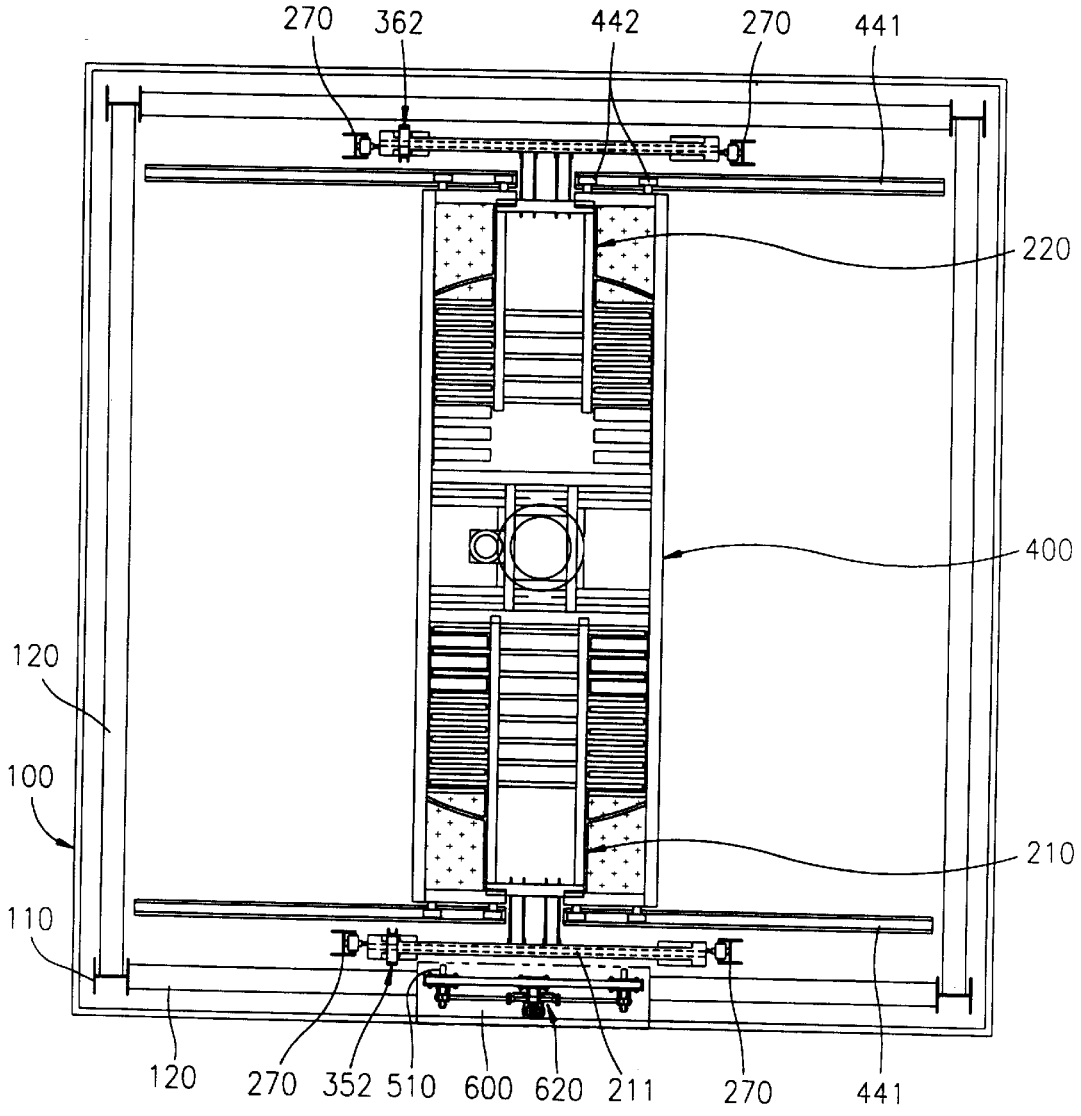
Figure 29:
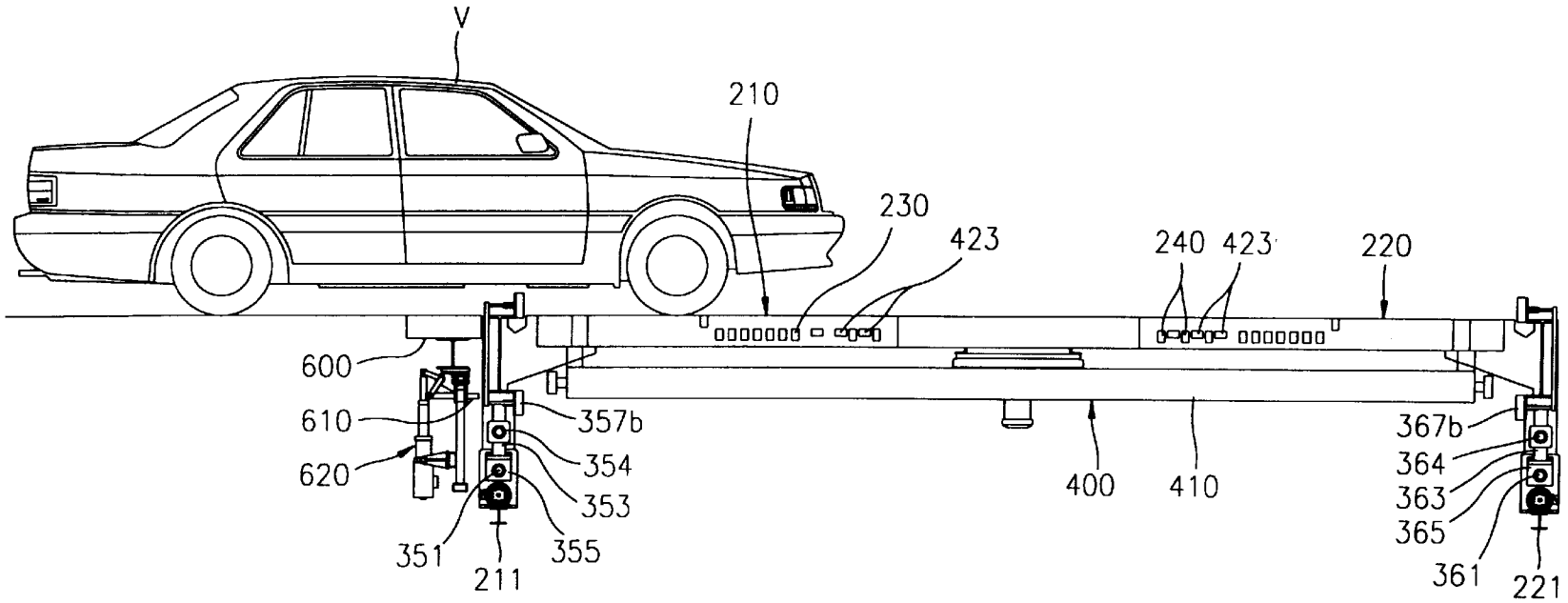
Figure 30:
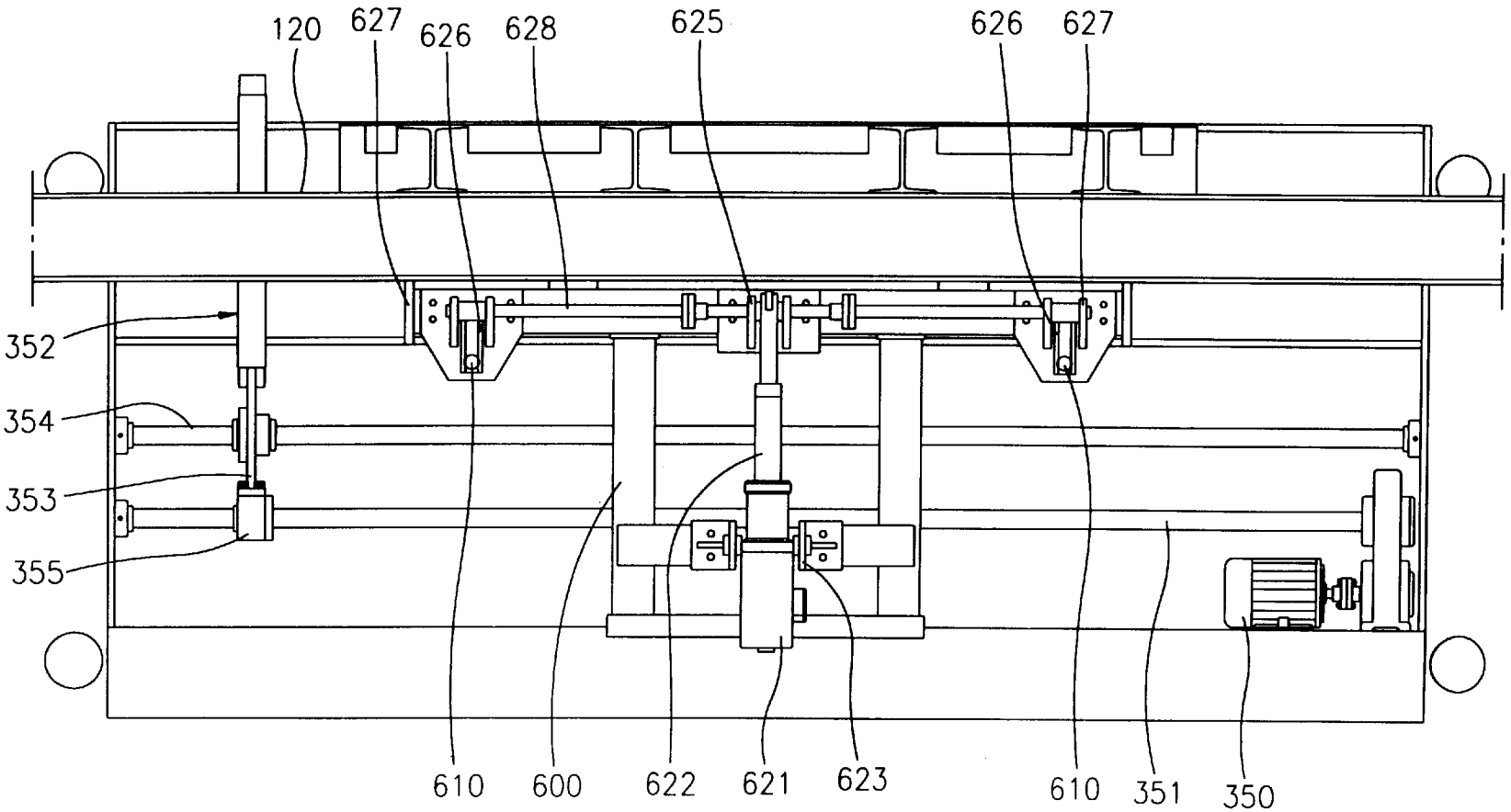
Figure 31:
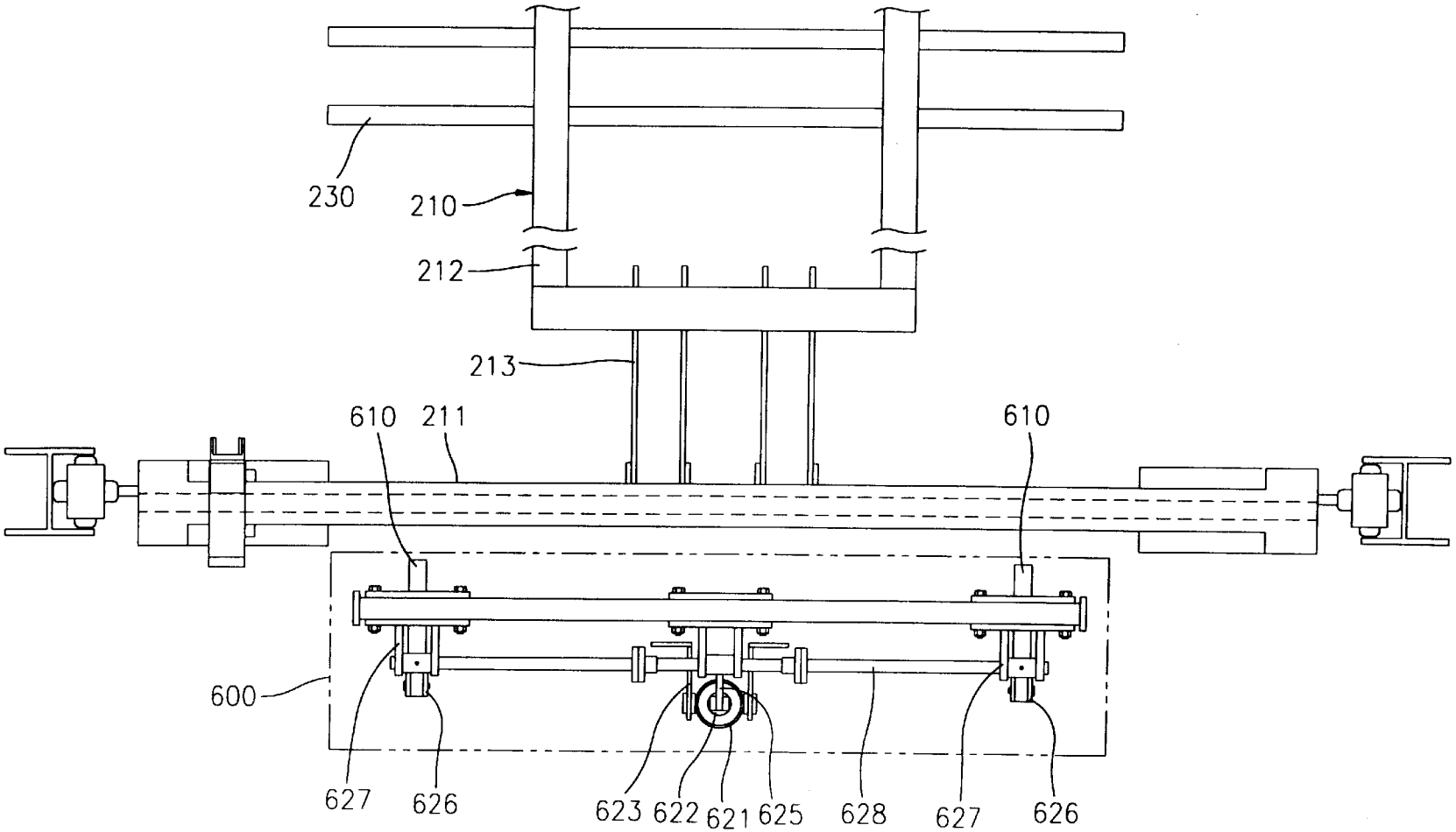
Figure 32:
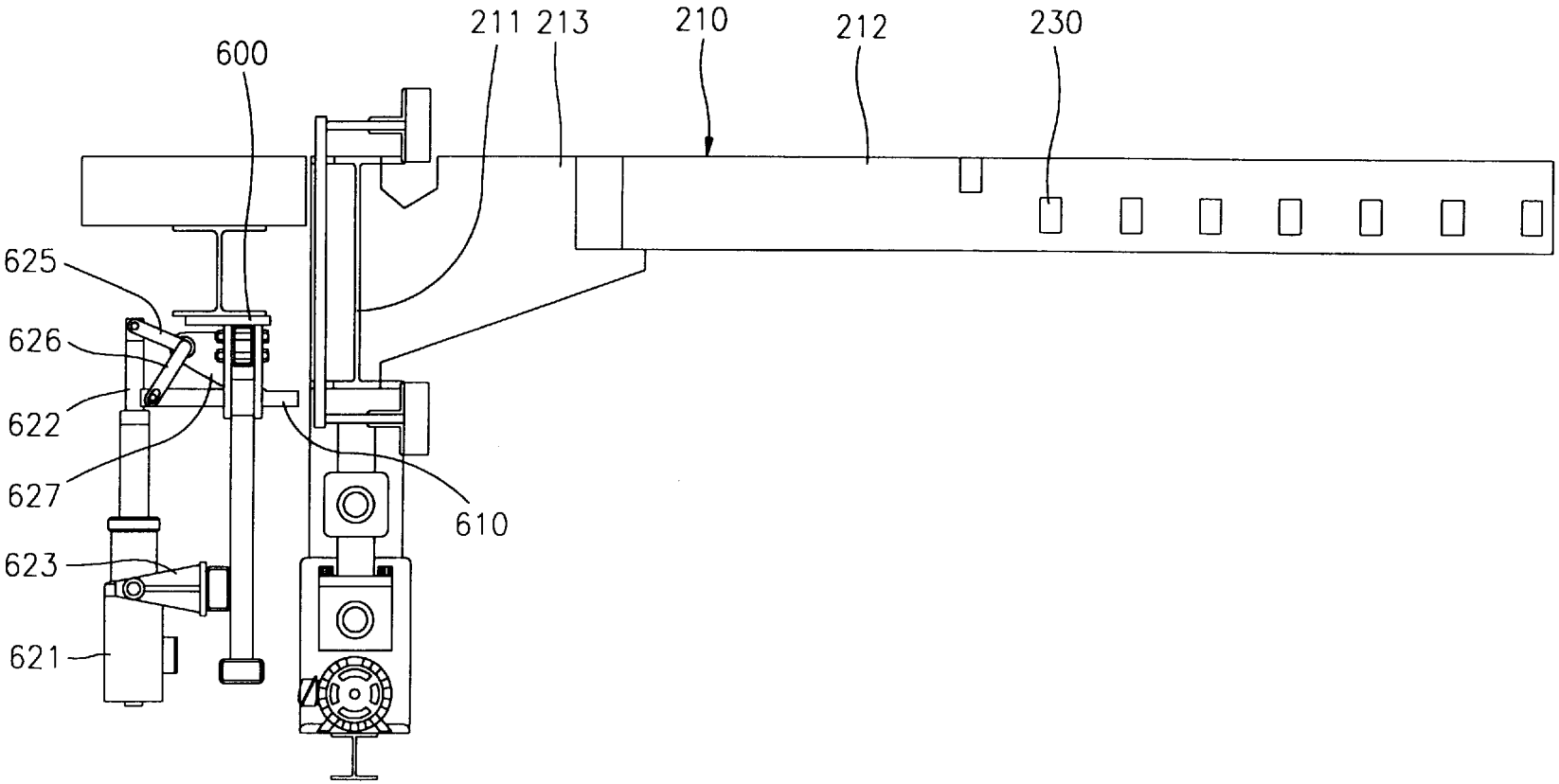

In the pallet horizontal movement guide unit of the elevator type parking system according to the first embodiment of the present invention, as shown in FIG. 27, the pallet horizontal movement extra-guide rails 381 and 382 next to the pallet horizontal movement guide rail 330 may be installed in the connection members 212 and 223 of the lifts 210 and 220 so that the horizontal movement guide rollers 340 are smoothly guided when the pallet 300 is horizontally moved.

Since the construction and operation of the above-described embodiments of the present invention are the same as the earlier embodiment of the present invention, only the features different therefrom will be explained with reference to the accompanying drawings.

In the description, the same elements as the elements in the earlier embodiment will be given the same reference numerals.

In the embodiment of the present invention, the pallet horizontal movement extra-guide rails 381 and 382 are installed at the same plane and height as the pallet horizontal movement guide rail 330. When the pallet 300 is horizontally moved, the horizontal guide rollers 340 are guided by the pallet horizontal movement guide rail 330 or the pallet horizontal movement extra-guide rails 381 and 382 for thereby easily implementing the horizontal movement of the pallet 300.

In addition, in the second embodiment of the present invention, as shown in FIGS. 28 through 34, in a state that the lift forks 230 and 240 of the lifts 210 and 220 are arranged with the turntable forks 423 of the turntable 400, there is provided a lift unbalance prevention unit for preventing the unbalance of the front side lift 210 when the vehicle V driven in and out.

Namely, in a state that the lifts 210 and 220 are lowered to the drive-in/out floor and the lift forks 230 and 240 are arranged on the same plane as the turntable forks 423, the unbalance may occur when the front wheels of the vehicle V are placed on the lift forks 210 in the case of the drive-in operation, and when the rear wheels of the vehicle V are placed on the lift forks 210 in the case of the drive-out operation, so that the weight of the vehicle v may be concentrated on a predetermined portion at the time when the vehicle is placed thereon for thereby unbalancing the vehicle. In the embodiment of the present invention, the lift unbalance prevention unit is installed in order to prevent the above-described unbalance of the lift 210.

As shown in FIGS. 28 through 34, the lift unbalance prevention unit includes a unbalance prevention plate 610 movably supported by the support member 600 fixed to the main frame 100 for supporting the lift frame 211, and a unbalance prevention operation unit 620 for operating the unbalance prevention support plate 610 within the support position and the release position.

The upper end of the support member 600 is fixed to the horizontal member 120 of the main frame 100 through the fixed member 601 and is downwardly extended, and the unbalance prevention plate 610 is forwardly and backwardly movable by the guide bushing 611 fixed to the intermediate portion of the support member 600.

The unbalance prevention operation unit 620 includes a linear movement mechanism 621 fixed to the lower portion of the support member 600 by a bracket and having a upwardly extended linear operation rod 622, and a link mechanism 624 connected between the upper portion of the linear operation rod 622 of the linear movement mechanism 621 and the front portion of the unbalance prevention plate 610 for converting the upward and downward linear movement of the linear movement mechanism 621 into the forward and backward linear movement.

As the linear movement mechanism 621, the pneumatic cylinder is preferably used. Any type of linear movement mechanism may be used for the same purpose.

The link mechanism 624 is formed of a pair of links 625 and 626 having their end portions hinged to the upper portion of the linear movement rod 622 and the front portion of the unbalance prevention rod 610, respectively, and their other end portions commonly hinged to the bracket 627 fixed to the support member 600.

The unbalance prevention plate 610 is installed at both sides of the support member 600 for supporting both sides of the lift frame 211. Therefore, one end of the link 625 of the link mechanism 624 is hinged to the upper portion of the linear operation rod 622 of the linear movement mechanism 621, and the other end of the same is connected with the horizontally extending connection shaft 628 and one end of each of the bracket 627 and link 626 is connected with both sides of the connection shaft 628, and the other end of the link 626 is connected with the unbalance prevention plate 610.

Figure 33:
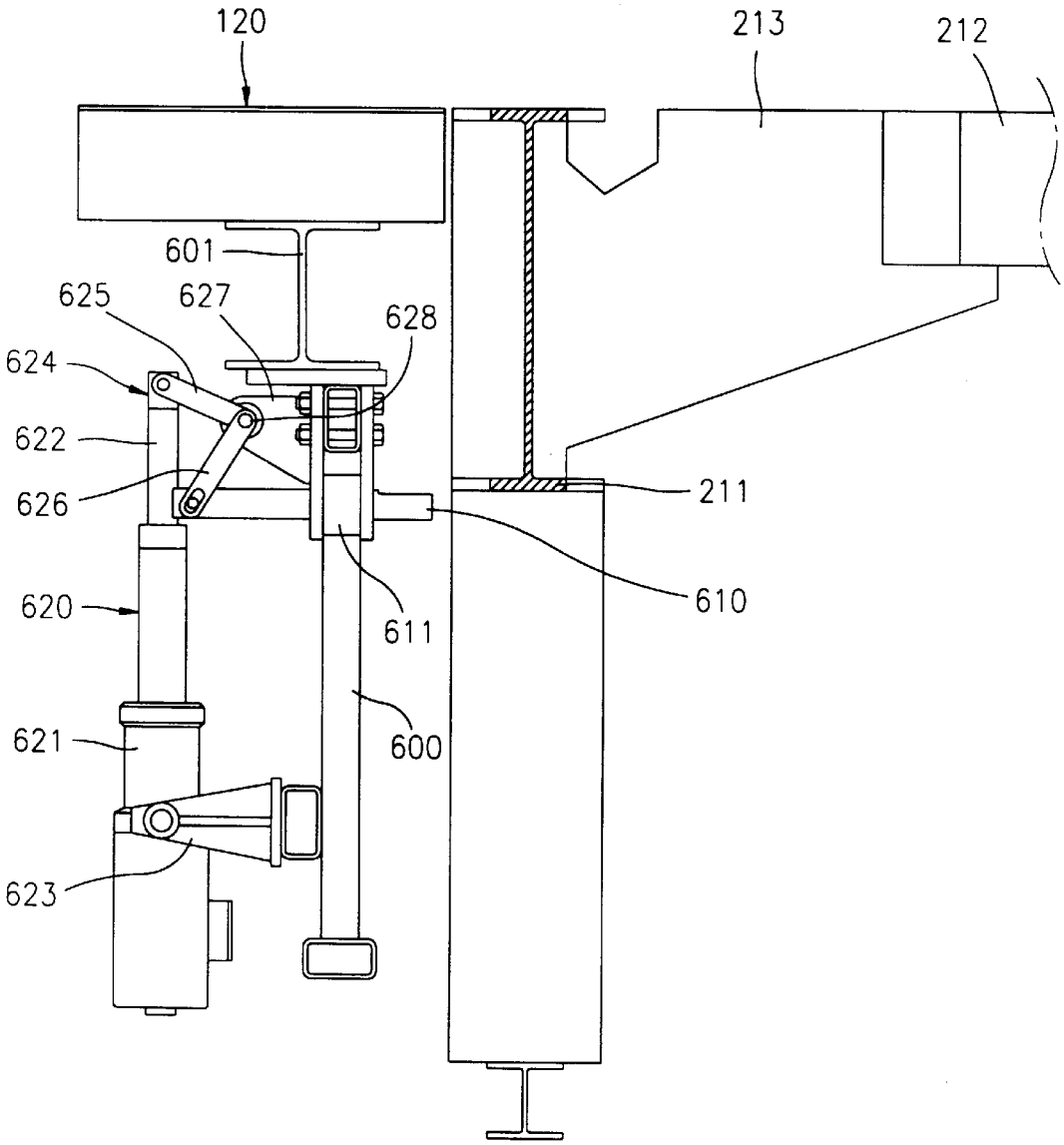
Figure 34:
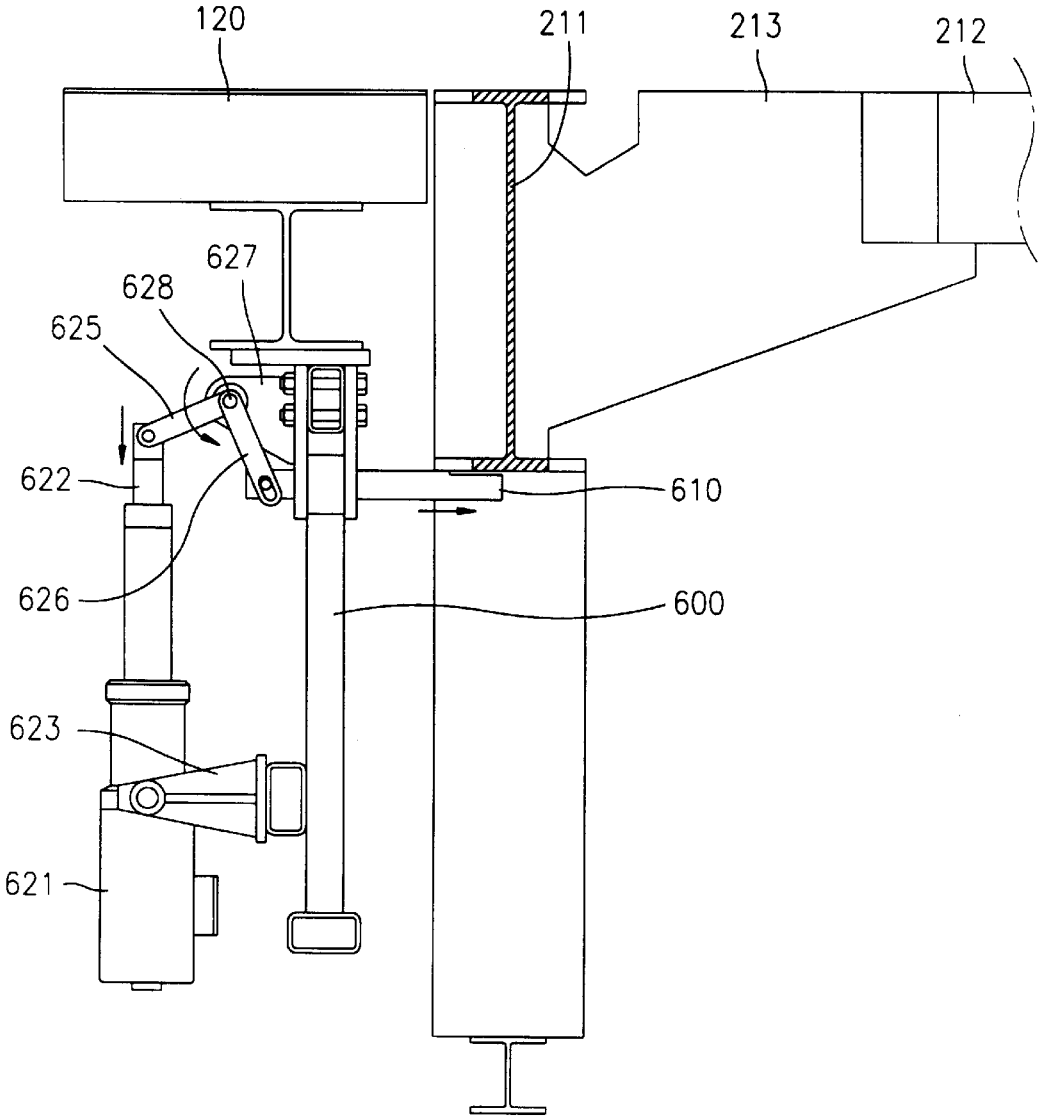

As shown in FIG. 33, in the lift unbalance prevention unit, as the lifts 210 and 220 are lowered, and the lift forks 230 and 240 are alternately engaged with the turntable forks 423 for thereby implementing the same plane therebetween. In this state, when the linear operation rod 622 of the linear movement mechanism 621 is downwardly moved, the downward linear movement is transferred to the unbalance prevention rod 610 through the link mechanism 624, so the unbalance prevention rod 610 is backwardly moved toward the position below the lift frame 211 of the front side lift 210 for thereby supporting the lift frame 211.

In a state that the unbalance prevention plate 610 supports the lift frame 211, when the vehicle V is loaded, the front side wheels of the vehicle are placed on the lift forks 230 in the loading mode, and the rear side wheels of the same are placed on the lift forks 230 in the unloading mode. Therefore, even when the weight of the vehicle V is applied thereto in a biased state, the lift 210 is not unbalanced, so that an over load is not applied to the lift lifting and lowering drive unit.

Figure 35:
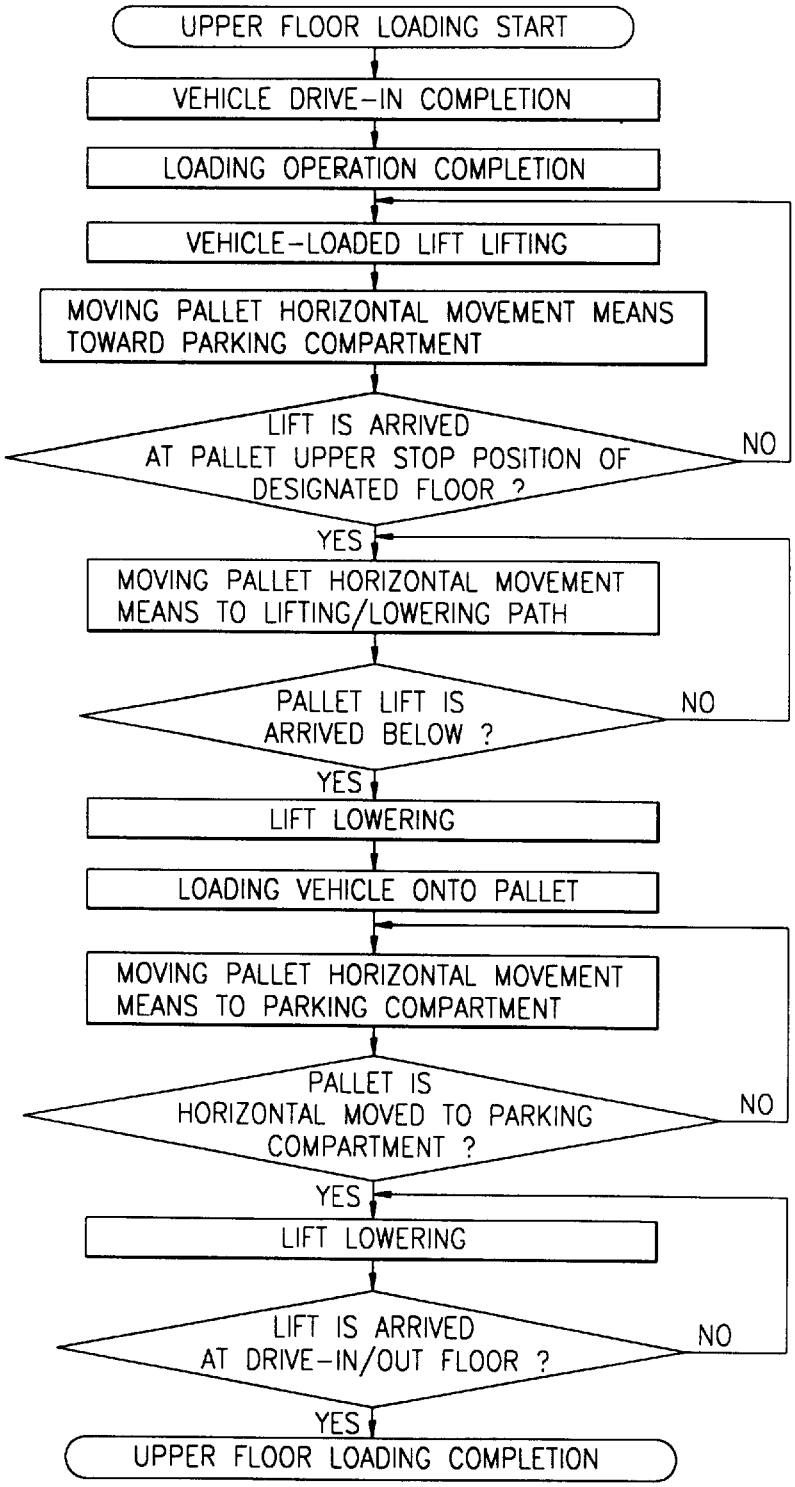
FIG. 35 is a flow chart illustrating an upper floor loading step according to the present invention.
Figure 36:
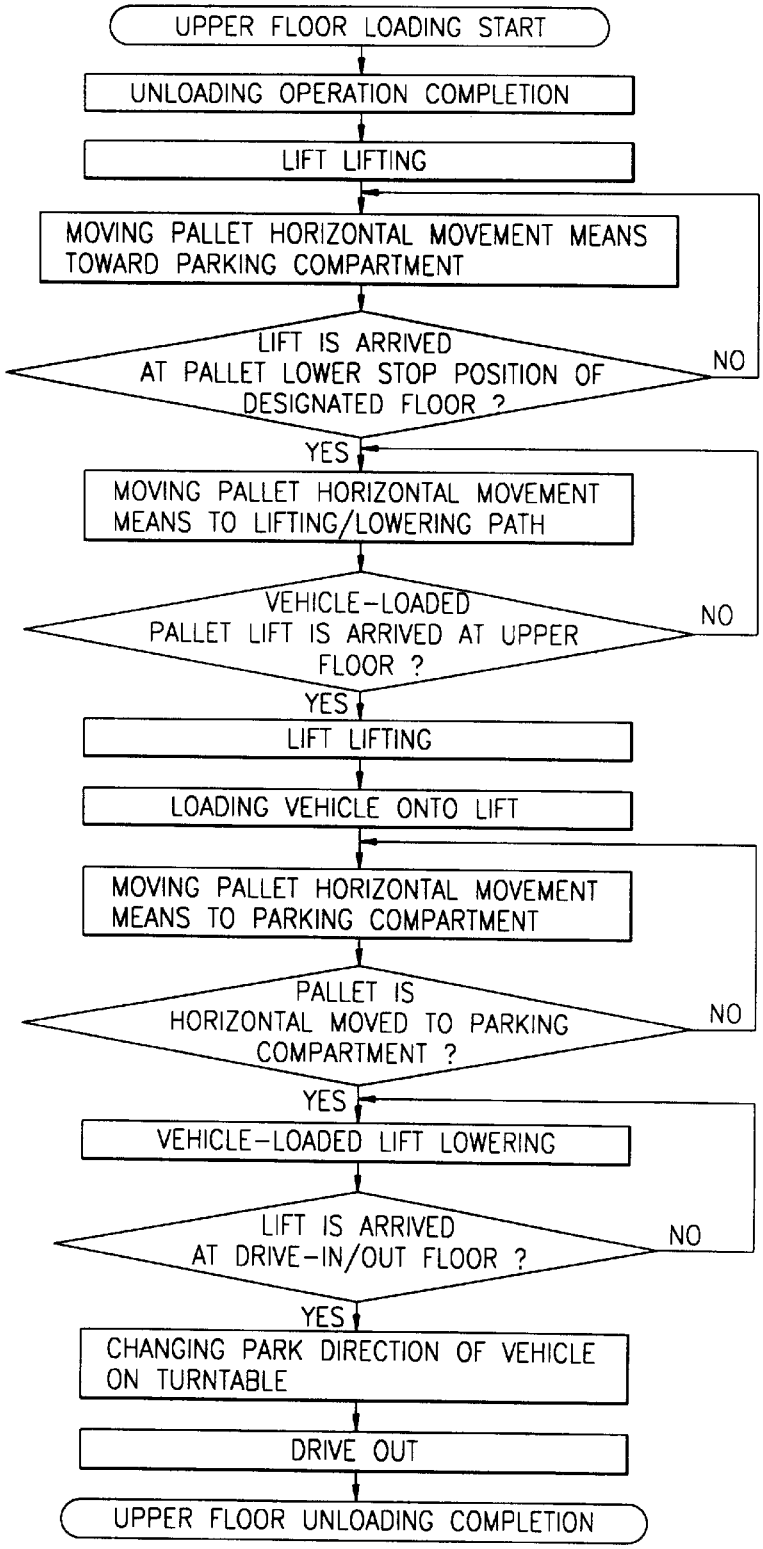
FIG. 36 is a flow chart illustrating an upper floor unloading step according to the present invention.
Figure 37:
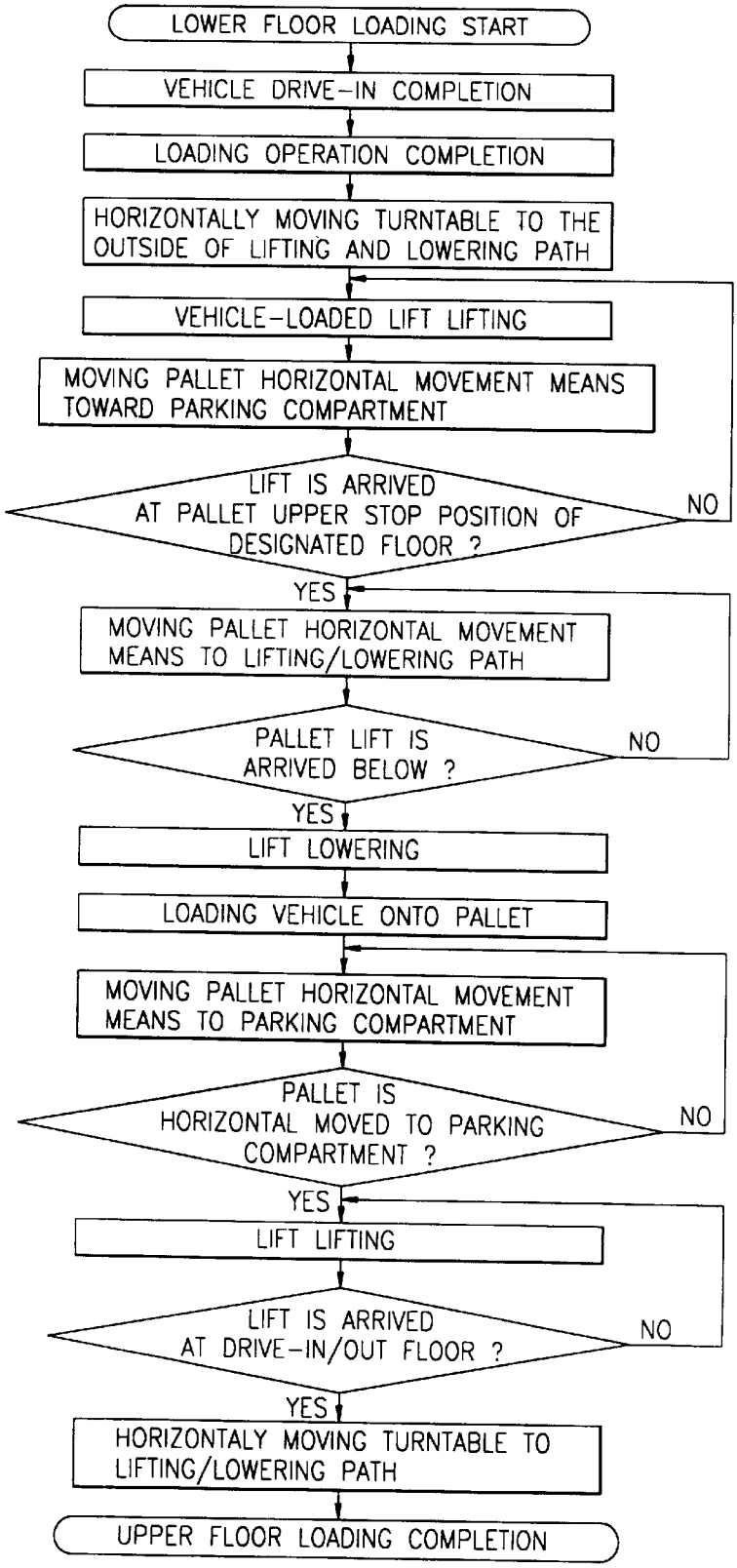
FIG. 37 is a flow chart illustrating a lower floor loading step according to the present invention.
Figure 38:
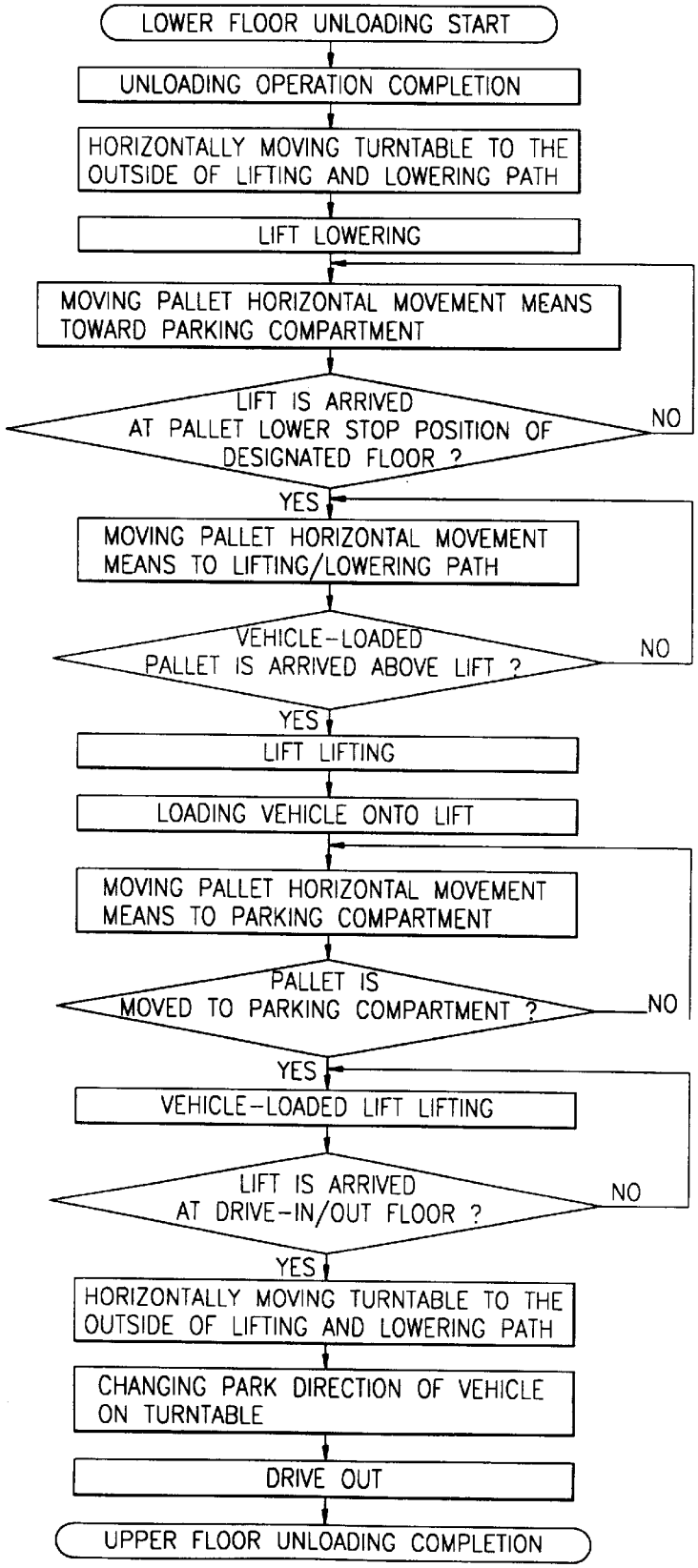
FIG. 38 is a flow chart illustrating a lower floor unloading step according to the present invention.
Figure 39:
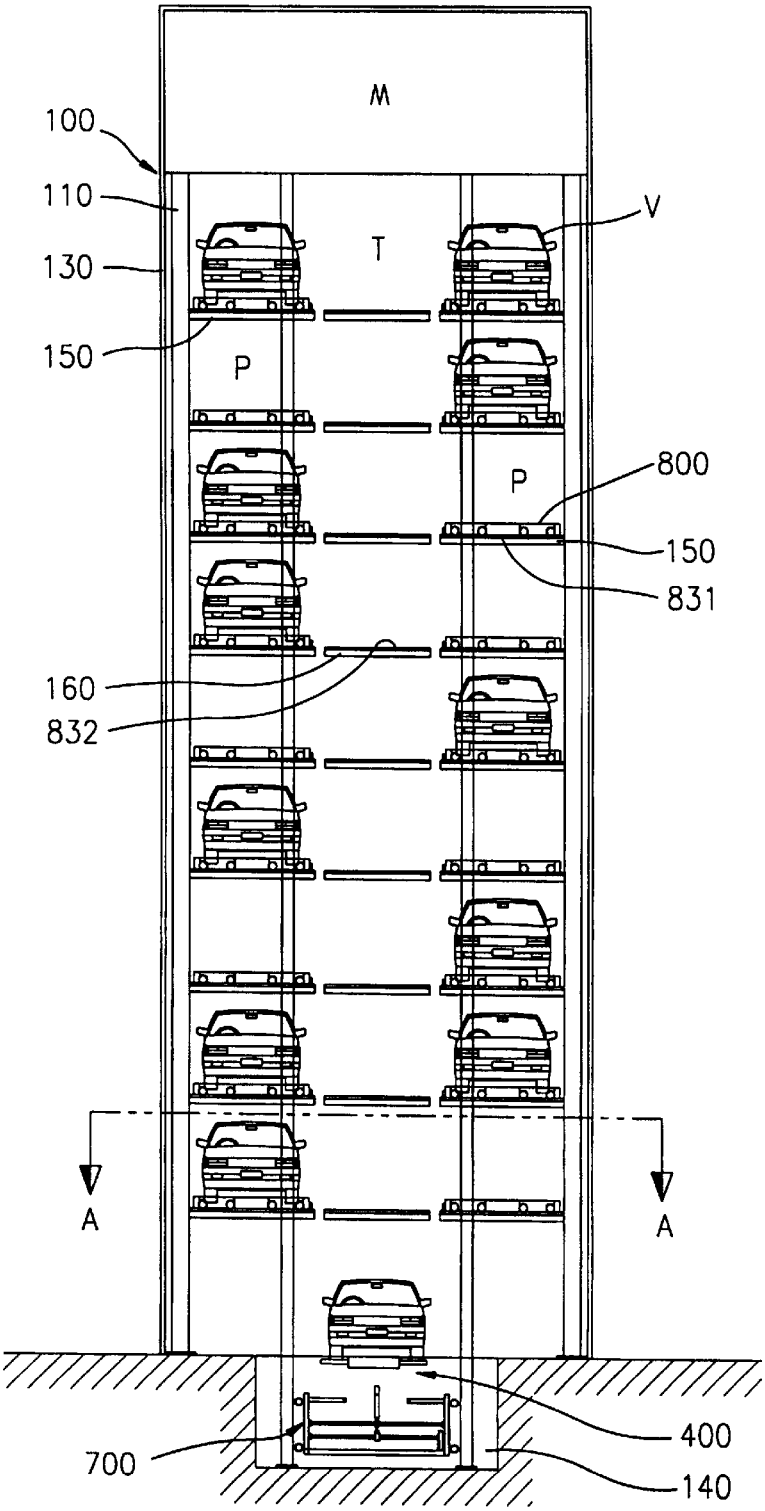

FIGS. 35–36 show flow charts illustrating upper floor loading and unloading procedures, respectively, according to the present invention. FIGS. 37–38 show flow charts illustrating lower floor loading and unloading procedures, respectively, according to the present invention.

In addition, in the elevator type parking system according to a third embodiment of the present invention, as shown in FIGS. 39 through 46, there are provided a lift 700 having a pair of lift frames 710 slidable by the lift lifting and lowering drive unit and lift forks 722 each having its one end fixed to the upper portion of the lift frame 710 and extended from the lift frames 710 toward the opposite parking room; a pallet 800 having a pallet frame 810 horizontally movable between the hoist way T and the parking room P in a pair of pallet support members 150 horizontally installed between the main column 110 of the main frame 100 and the extra-columns, and a plurality of pallet forks 820 fixed to the pallet frame 810 and extended in the direction opposite to the hoist way and arranged alternately with the lift forks 722 of the lift 700; and a pallet horizontal movement guide unit having a pallet horizontal movement guide rail 831 horizontally installed in each parking room P of the main frame 100, a pallet horizontal movement guide rail 832 installed at the position corresponding to each parking room P in the hoist way T, and a plurality of pallet horizontal movement guide rollers 840 operably installed at the pallet frame 810 of the pallet 800 and guided by the pallet horizontal movement guide rails 831 and 832.

Figure 40:
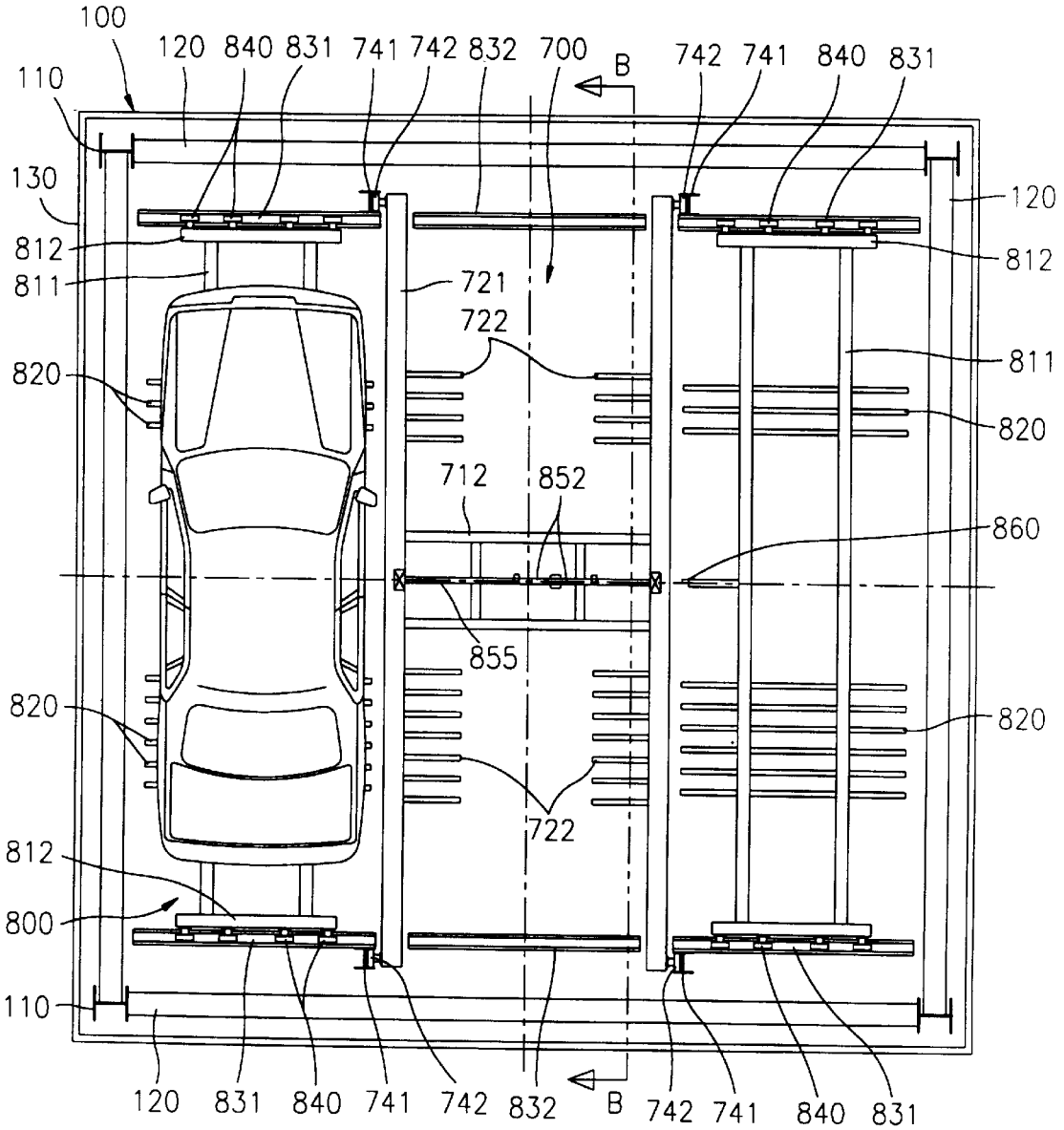
Figure 41:
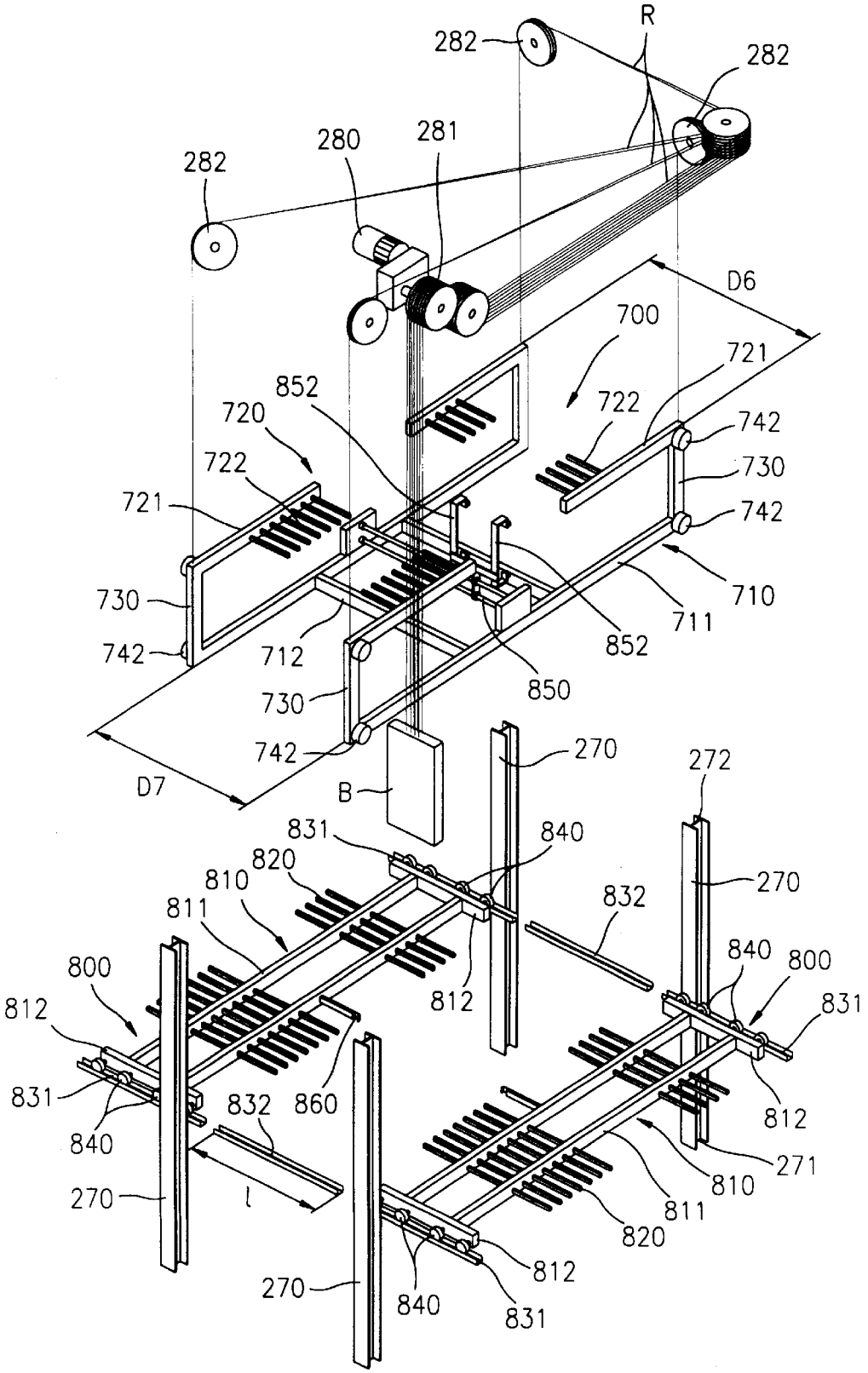

As shown in FIGS. 40 and 41, in the lift lifting and lowering drive unit, one end of a rope formed of a plurality of strands (preferably, eight strands) operated by the lifting and lowering drive motor 280 installed in the machinery compartment M shown in FIG. 1 is connected with the balance weight B, and the other end of the same is connected with the vertical connection member 730 of the lift 700 through the guide sheave 282.

Figure 42:
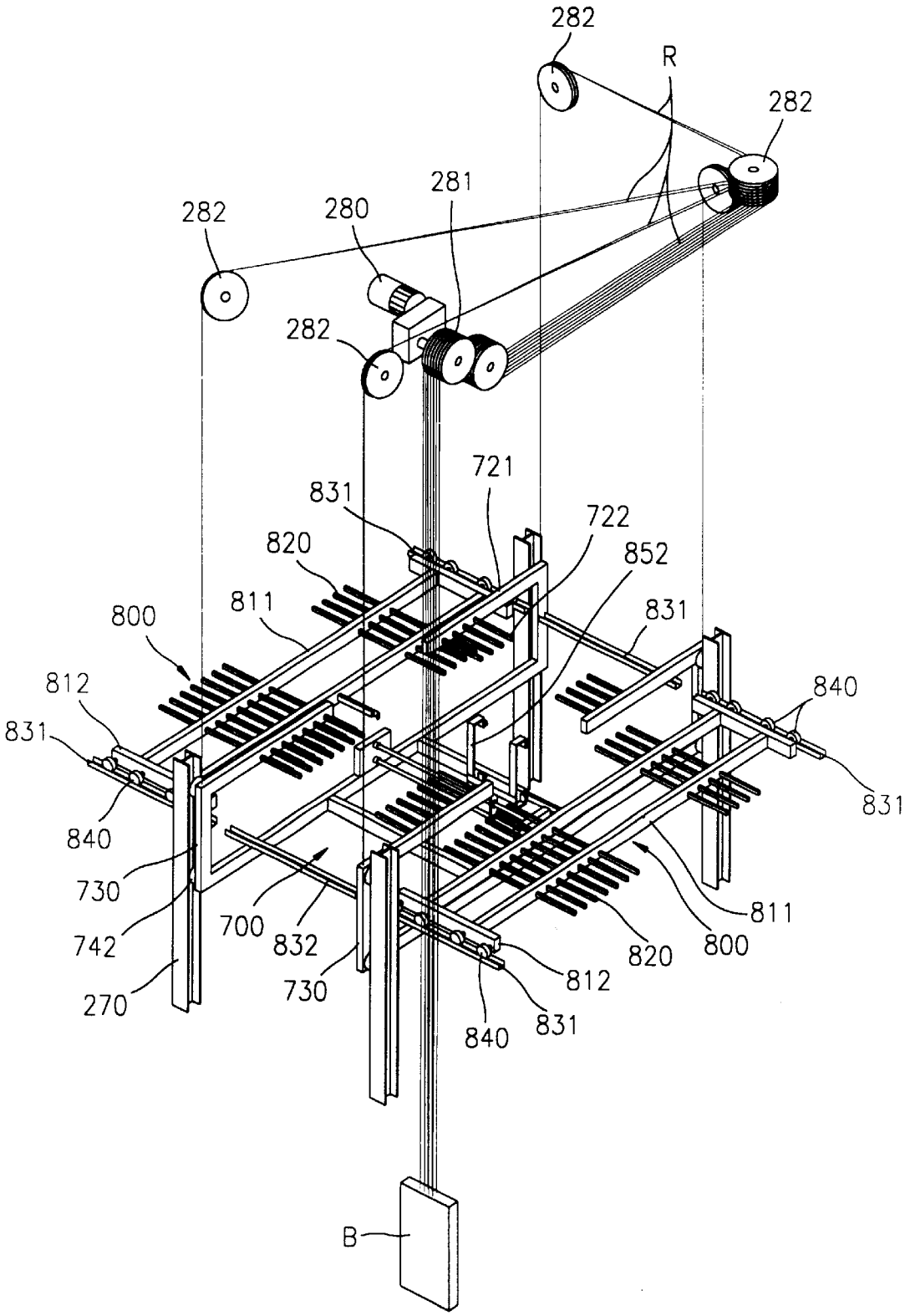
Figure 43:
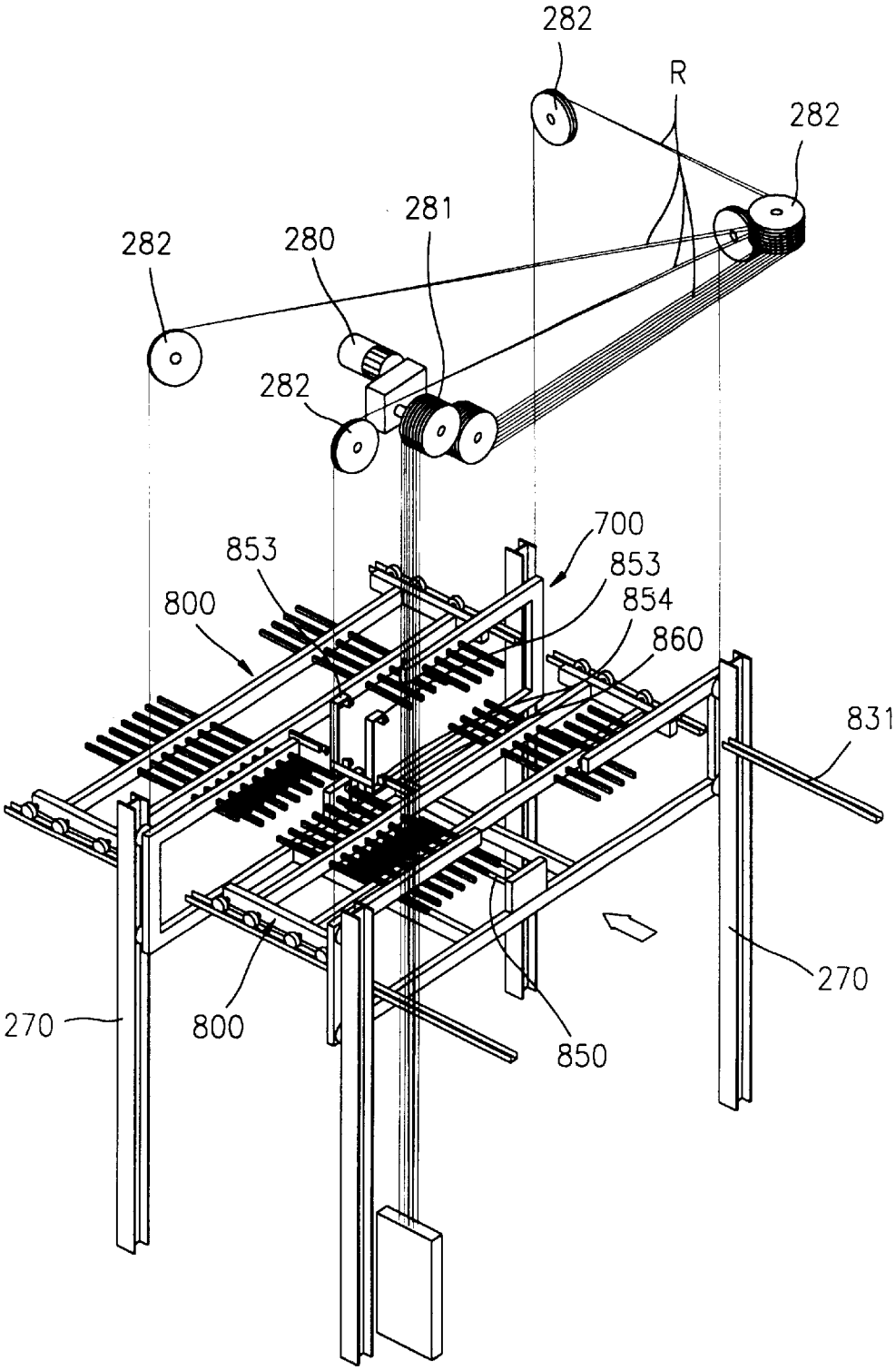
Figure 44:
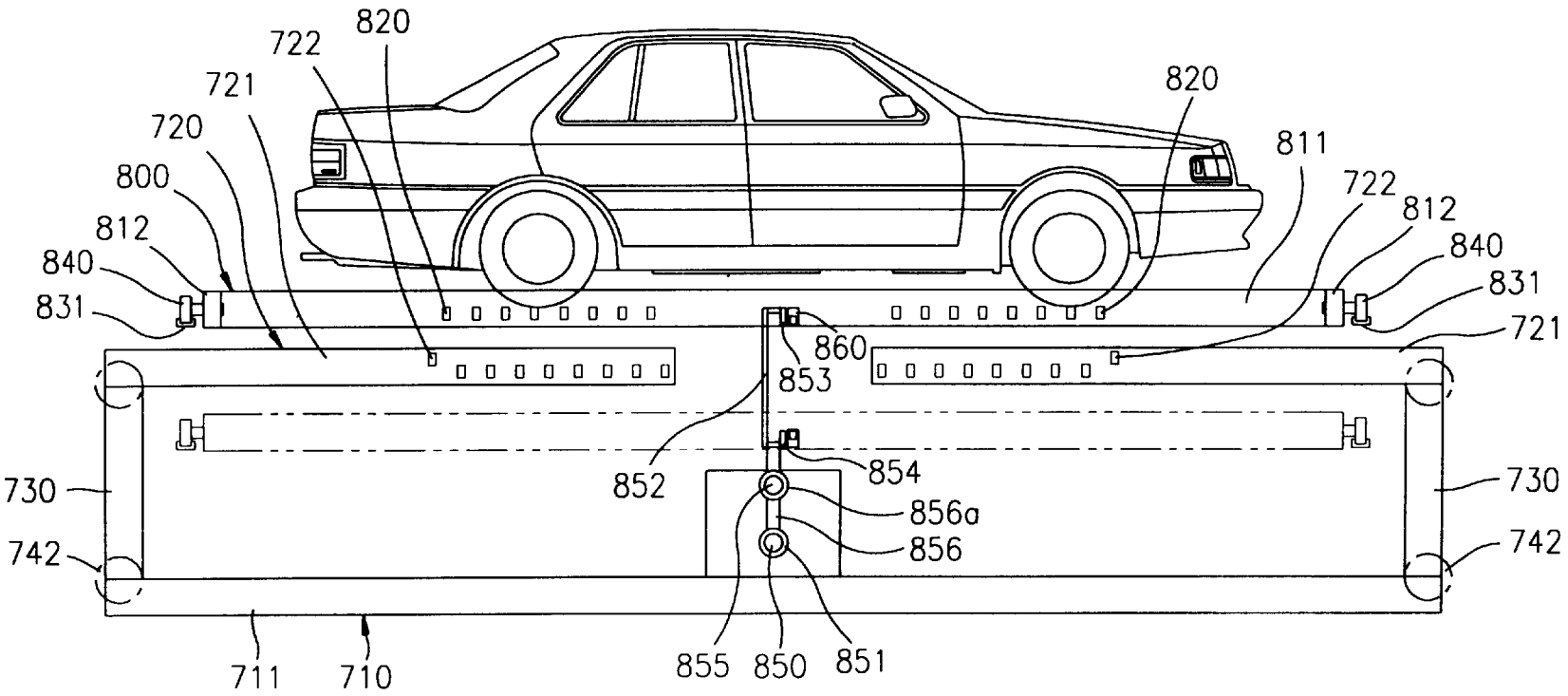

As shown in FIG. 41, the lift base 710 includes a pair of lift base frames 711 connected with the rope R of the lift lifting and lowering drive unit, a pair of vertical columns 730 upwardly extended from both ends of the lift base frame 711, a pair of spaced-apart upper columns 721 upwardly extended from the upper portion of the vertical column 730 to the upper portion of the opposite vertical column 730, and a connection member 712 connected across the center portion in the lengthy direction of the lift base frames 711. One end portion of each of the lift forks 722 is fixed to the upper column 721 and extended toward the opposite upper column 721. The hallow lift frame 710 is formed in a rectangular shape or a C shape and has its opened upper center portion. Here, the height from the lift base frame 711 of the lift frame 710 to the upper column 721 is higher than the pallet 800. Therefore, the pallet 800 can pass through the inner space of the lift frame 710. FIGS. 42 and 43 illustrate the above-described constructions.

The pallet frame 810 includes a pair of parallel lengthy columns 811 and a pair of short columns 812 crossingly Axed to both ends of each of the lengthy columns 811 by a known welding method.

The pallet frame 810 is formed in a parallel shape.

The pallet frame 810 is formed to have a predetermined width for being movable inside the lift 700, and the plurality of the pallet forks 820 are fixed to the lengthy column 811 and extended from the lengthy column 811 to the hoist way or the opposite direction.

In addition, the lift forks 722 of the lift 700 and the pallet forks 820 of the pallet 800 are alternately arranged for preventing any interference when the lift 700 passes through the pallet 800.

The pallet horizontal movement guide rail 831 installed in the parking room P is supported by the pallet support member 150 horizontally installed at the main column 110 of the main frame 100 in each parking room P.

The pallet horizontal movement guide rail 832 installed in the side of the hoist way T is fixed at the main frame 100 through the rail support member 160, and the length in the horizontal direction is shorter than the width of the lift frame 710, namely, the distance D7 between the lift base frames 711 or the distance D6 between the upper columns 721 for preventing any interference when the lift 700 is lifted and lowered. Here, the distance D6 between the upper columns 721 and the distance D7 between the lift base frames 711 are identical.

In addition, a predetermined gap is formed between the pallet horizontal movement guide rail 831 and the pallet horizontal movement guide rail 832 by the thickness of the lift base frames 711 and the vehicle support frame 721. The installation interval of the pallet horizontal movement guide roller 840 is wider than the distance between the pallet horizontal movement guide rails 831 and 832, so that the rollers stably runs on the pallet horizontal movement guide rails 831 and 832 when the pallet 800 is horizontally moved.

Four pallet horizontal movement guide rollers 840 are installed in the front and rear portions of each pallet frame 810, respectively, and the distance therebetween is wider than the distance between the pallet horizontal movement guide rails 831 and 832, so that when the pallet 800 horizontally moves, more than one pallet horizontally guide roller 840 are not concurrently positioned in the distance between the pallet horizontal movement guide rails 831 and 832. Namely, at least three pallet horizontal movement guide roller 840 are supported by the pallet horizontal movement guide rails 831 and 832 for thereby implementing a stable movement of the pallet 800.

As shown in FIGS. 41 through 44, the pallet horizontal movement unit includes a ball screw 850 operably installed at the intermediate portion of the lift base frames 711 of the lift base 710 in the horizontal direction and reversely rotatable by the motored motor (not shown), a nut box 851 screwed by the ball screw 850, a pair of hooking members 852 fixed to the nut box 851 and having hookers 853 and 854 installed at an upper and lower portion of the same, and a hooking member 860 installed at both sides of the pallet frame 810 of the pallet 800 and selectively hooked by the hookers 853 and 854.

The hooking member 852 includes a upwardly extended hooking member body 856 having its lower portion connected with the nut member 851, a horizontal support member having its center portion fixed to the upper portion of the hooking member body 856, a pair of channel-shaped extended members fixed to both ends of the horizontal support member, and an upper side hooker 853 and lower side hooker 854 fixed to the upper and lower free ends of the extended member.

Preferably, the parking unit driveunit may include a sliding support member 856*a* engaged with the hooking member body 856 and slidably supporting the hooking member body 856 for preventing shaking when the hooking member 852 horizontally moves, and a guide rod 855 having its two ends fixed to the frame of the lift for slidably and horizontally guiding the sliding support member 856*a*. Here, the sliding support member 856*a* is hollow, and the guide rod 855 is inserted into the hollow portion, and the sliding support member 856*a* is slidable on the guide rod 855 for thereby supporting the hooking member body 856.

The hookers 853 and 854 includes rollers installed at the upper and lower portions of the hooking member 852, and the hooking member 860 is formed in a channel shape in which the upper and lower end portions and one side of the same are opened for being hooked by the hookers 853 and 854.

Since the construction and operation of the third embodiment of the present invention are the same as the second embodiment, the description of the same will be omitted except for the following different features.

The same elements as the earlier embodiment of the present invention are given the same reference numerals.

Horizontal operation of pallet

When the ball screw 850 is normally or reversely rotated by the horizontal drive motor (not shown) of the pallet horizontal movement unit, the nut box 851 screwed to the ball screw 850 is linearly moved in the leftward and rightward directions.

Therefore, the hooker 852 integrally engaged with the nut box 851 is guided by the guide rod 855 and is linearly moved in the leftward and rightward direction, so that the hookers 853 and 854 installed at the upper portion of the hooking member 852 are horizontally moved in the leftward and rightward directions.

In the state that the hookers 853 and 854 are moved toward the parking room P, one of the hookers 853 and 854 is placed at the position to be engaged with the hooking member 860 installed in the pallet 800. When the lift 700 arrives at the position of the pallet 800, one of the hookers 853 and 854 of the hooking member 852 is hooked by the hooking member 860.

Here, the hookers 853 and 854 are formed of a roller, and the hooking member 860 is formed in a channel shape in which the upper and lower end portions and one side of the same are opened. In this state, when the hooking member 852 is moved to the position of the parking room P so that the hookers 853 and 854 are hooked by the hooking member 860, any interference does not occur between the hookers 853 and 854 and the hooking member 860 while the lift 700 passes through the pallet 800. When the lift 700 arrives at the position of the pallet 800 of the designated floor, one of the hookers 853 and 854 is hooked by the hooking member 860 in the side of the pallet 800.

In the state that one of the hookers 853 and 854 is hooked by the hooking member 860, when the ball screw 850 is reversely rotated by the horizontal movement drive motor (not shown), the nut box 851 and the hooking member 852 are moved to the lift 700 by the guide of the guide rod 855. Therefore, the pallet 800 is horizontally moved toward the lift 700.

In addition, in this state, when the ball screw 850 is rotated in the normal direction by the horizontal movement drive motor, the nut box 851 and the hooking member 852 fixed thereto are moved to the parking room P by the guide of the guide rod 855, and then the pallet 800 is horizontally moved to the parking room P.

Horizontal guide operation of pallet

At this time, the pallet horizontal movement guide roller 840 installed in the pallet frame 810 is guided by the pallet horizontal movement guide rail 831 installed in the pallet support member 150 and the pallet horizontal movement guide rail 832 installed in the hoist way T for thereby easily implementing a horizontal movement of the pallet 800.

The pallet horizontal movement guide roller 840 is guided by the pallet horizontal movement guide rail 831 installed in the pallet support member 150 in the side of the parking room P and is guided by the pallet horizontal movement guide rail 832 installed in the lift base frame 711 in the side of the hoist way T.

Four pallet horizontal movement guide rollers 840 are installed at the front and rear portions of each pallet frame 810, respectively. The distance therebetween is wider than the distance between the pallet horizontal movement guide rails 831 and 832, so that when the pallet 800 is horizontally moved, more than one pallet horizontal movement guide rollers 840 are not positioned in the distance between the pallet horizontal movement guide rails 831 and 832, and more than three pallet horizontal movement guide rollers 840 are supported by the pallet horizontal movement guide rails 831 and 832 for thereby implementing a stably horizontal movement of the pallet 800.

Loading operation

Figure 45A:
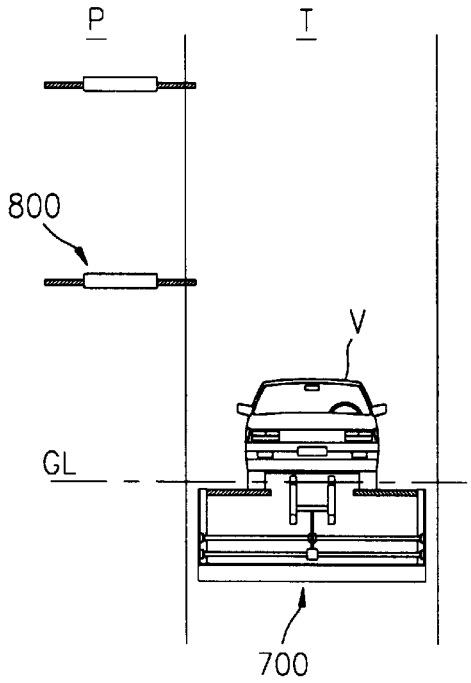

Next, the loading operation of the vehicle V will be explained. before the vehicle V is loaded, as shown in FIG. 45A, the lift 700 is lowered to the lifting and lowering floor. In this state, the vehicle V driving-in though the drive-in/out port is loaded onto the lift forks 722 of the vehicle support member 720.

When the loading operation of the vehicle V is completed, the lift 700 with the vehicle V thereon is guided by the lift lifting and lowering guide rail 270 and the lift lifting and lowering guide roller 742 and is lifted to the position of the designated floor.

While the lift 700 with the vehicle V thereon is being lifted to the designated floor, the hooking member 852 is moved toward the parking room P for thereby implementing a hooking ready state with respect to the hooking member 860.

Figure 45B:
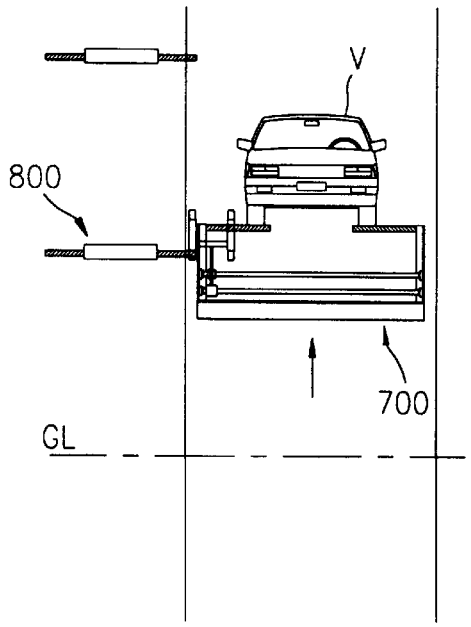
Figure 45C:
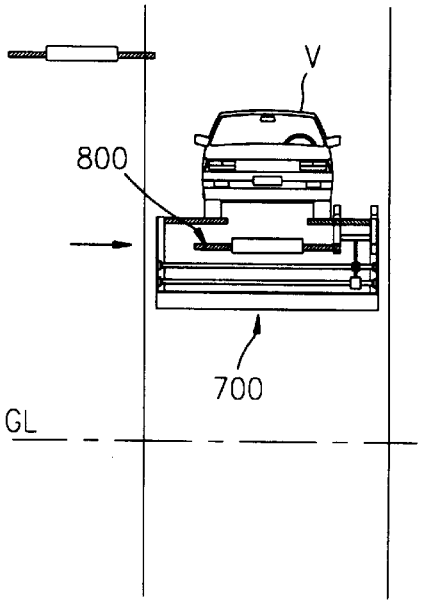

In this state, the lift 700 is lifted and arrives at the designated floor as shown in FIG. 45B. When the vehicle support member 720 stops at the position higher than the pallet 800 of the designated floor, the lower side hooker 854 of one of the hooking members 852 which was moved to the parking room P (in the drawings, the leftward hooking member) is hooked by the hooking member 860 of the pallet 800 of the designated floor.

In the state that the hooker 854 is hooked by the hooking member 860, when the hooking member 852 is moved toward the lift 700 by the operation of the pallet horizontal movement drive unit, the pallet 800 of the designated floor is horizontally moved by the guide of the pallet horizontal movement guide unit, and thus the pallet 800 is positioned between the lift base 710 of the lift 700 and the vehicle support member 720.

Figure 45D:
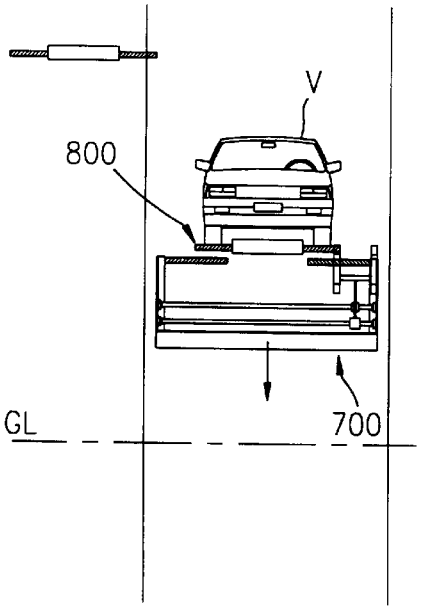

Next, the lift lifting and lowering drive unit is driven, and as shown in FIG. 45D, the lift 700 is lowered, and the vehicle support member 720 is lowered to the position lower than the pallet 800, so that the vehicle V loaded on the lift forks 722 of the vehicle support member 720 is loaded onto the pallet forks 820 of the pallet 800.

Figure 45E:
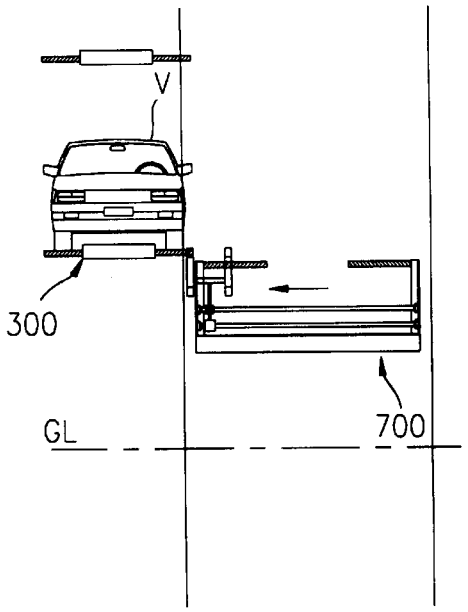

When the vehicle V is loaded onto the pallet 800, the pallet horizontal movement drive unit is driven, and as shown in FIG. 45E, the hooking member 852 is moved toward the parking room P and the pallet 300 with the vehicle V thereon is horizontally moved to the parking room P by the guide of the pallet horizontal movement guide unit.

Figure 45F:
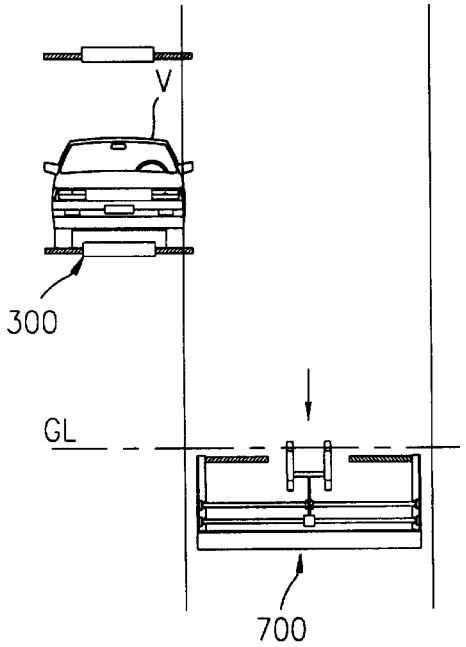

In addition, the lift 700 loaded the vehicle V onto the pallet 800 is lowered to the drive-in/out floor as shown in FIG. 45F by the operation of the lift lifting and lowering drive unit for thereby completing a parking operation of the vehicle.

Unloading operation

Figure 46A:
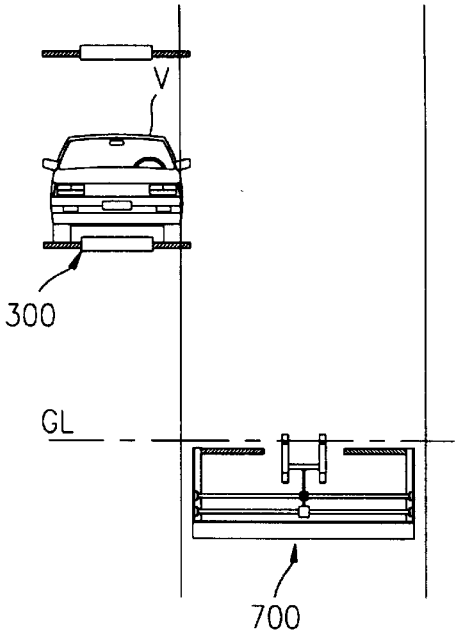

First, when unloading the vehicle V, as shown in FIG. 46A, the lift 700 positioned on the drive-in/out floor is lifted to the designated floor by operating the lift lifting and lowering drive unit.

Figure 46B:
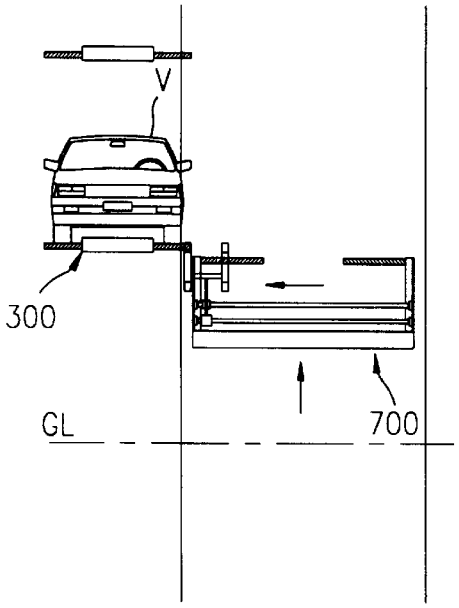

At this time, before, the lift 700 arrives at the designated floor, the hooking member 852 is moved to the parking room P by the operation of the pallet horizontal movement unit. When the lift 700 arrives at the designated floor, and the vehicle support member 720 is positioned lower than the pallet 800 of the designated floor, as shown in FIG. 46B, the upper hooker 853 of one of the hooking members 852 (in the drawings, the leftward hooking member) is hooked by the hooking member 860 of the pallet 800 of the designated floor.

Figure 46C:
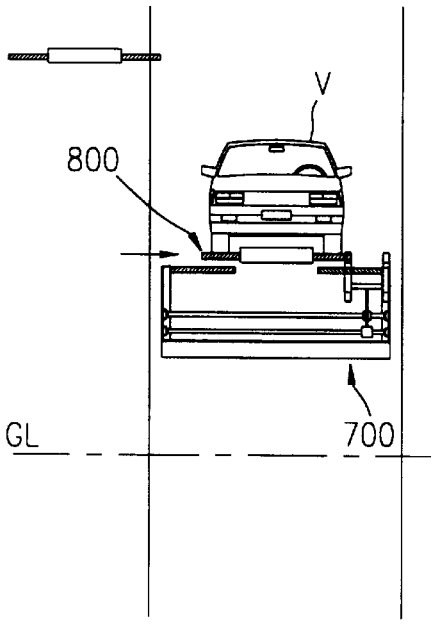

In this state, when the hooking member 852 is moved toward the lift 700 by the operation of the pallet horizontal movement drive unit, as shown in FIG. 46C, the pallet 800 with the vehicle V thereon is horizontally moved by the guide of the pallet horizontal movement guide unit, and then is moved onto the vehicle support member 720 of the lift 700.

Figure 46D:
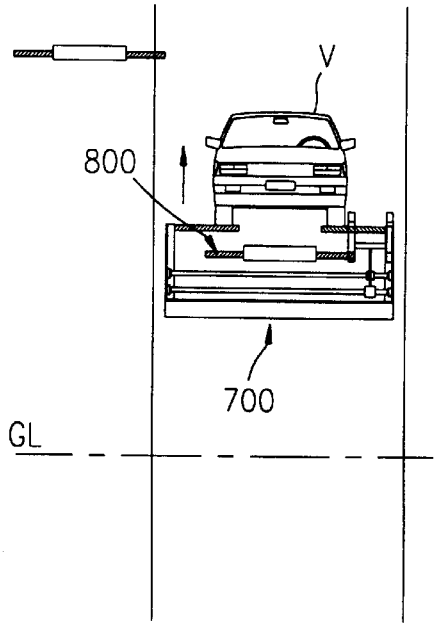

When the vehicle V is positioned on the vehicle support member 220, as shown in FIG. 46D, the vehicle support member 720 is lifted, and the vehicle V loaded on the pallet 800 is loaded onto the lift forks 722 of the vehicle support member 720.

Figure 46E:
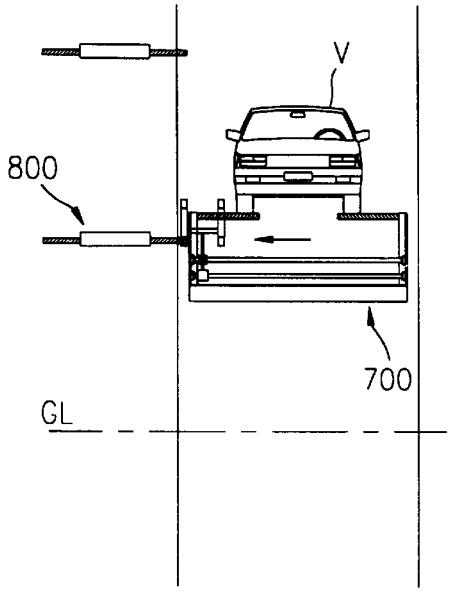

In the state that the vehicle V is loaded on the lift forks 722, the hooking member 852 is moved toward the parking room P by the operation of the pallet horizontal movement drive unit, and as shown in FIG. 46E, the pallet 800 moved the vehicle V to the side of the lift 700 is horizontally moved toward the parking room P by the guide of the pallet horizontal movement guide unit.

Figure 46F:
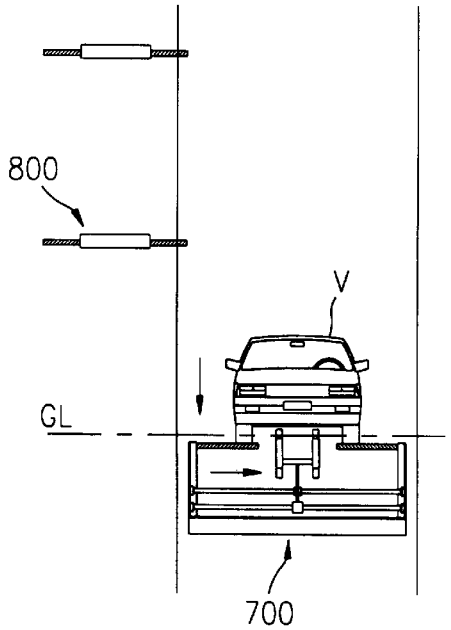

The lift 700 with the vehicle V thereon is lowered to the drive-in/out floor by the operation of the lift lifting and lowering drive unit as shown in FIG. 46F. In this state, the driver gets into the vehicle and drives out from the drive-in/out floor for thereby completing an unloading operation of the vehicle.

As described above, in the elevator type parking system according to the present invention, the pallet is horizontally movable along the pallet horizontal movement guide rail, and the pallet of each parking room is horizontally moved between the parking room and the hoist way by providing the lift with one pallet horizontal movement unit for thereby enhancing the productivity of the product and decreasing the fabrication cost.

In addition, in the elevator type parking system according to the present invention, the pallet horizontal movement unit installed in the lift is moved to the position in which the pallet is horizontally moved before the lift arrives at the position for horizontally moving the pallet for loading and unloading the vehicle of the designated floor. Therefore, in the present invention, it is possible to significantly decrease the time required for loading and unloading the vehicle compared to the conventional art in which the pallet is horizontally moved and then is engaged with the pallet horizontal movement unit by an additional operation after the lift arrived at the pallet of the designated floor.

In addition, in the present invention, the pallet is horizontally moved in a state that the pallet is supported by the pallet horizontal movement guide rail installed in the pallet support member of the main frame. Therefore, when the pallet with the vehicle thereon is horizontally moved, the weight of the pallet and the vehicle is not applied to the lift, so that it is possible to prevent an over loading of the lift lifting and lowering drive unit.

In the present invention, the lifting and lowering floor is formed in the drive-in/out floor, so that a driver stands on the footboard and gets into/off the vehicle, and thus the driver can easily get into/off the vehicle. In addition, since the lifting and lowering floor is movable within a predetermined distance between the same height as the turntable and the height in which the horizontal movement of the turntable is not interfered, so that the lower floor loading and unloading operation of the upper drive-in type and intermediate drive-in type parking system is implemented.

In the present invention, since the pallet shaking and escape prevention unit supporting the pallet horizontal movement guide roller operably installed at the pallet is provided in the pallet horizontal movement guide rail, it is possible to prevent a shaking or escape of the pallet in position in a state that the pallet is horizontally moved to the parking room and to the side of the lift.

In the present invention, when the pallet is horizontally moved by providing the pallet horizontal movement extra-guide rail connected with the pallet horizontal movement guide rail of the pallet support member of the main frame in the lift, the pallet is horizontally moved by the pallet horizontal movement guide rail and the pallet horizontal movement extra guide rail. In addition, in the present invention, when the vehicle is loaded or unloaded in a state that the lift is arranged with the turntable, the weight of the vehicle which is concentrated onto the front side lift is supported by the lift unbalance prevention unit for thereby preventing the unbalance of the lift and a biased weight applied to the lift lifting and lowering unit.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. An elevator type parking system comprising:

a main frame having a plurality of vertical columns and horizontal columns forming a hoist way in a center portion of said main frame;

a plurality of parking rooms positioned on sides of the hoist way, said hoistway positioned between a plurality of floors;

a lift having a front side lift and a rear side lift, each side lift including a rectangular lift frame, a support member horizontally extended from the rectangular lift frame to the center of the hoist way, and a plurality of lift forks fixed to the support member and extended from the support member towards respective parking rooms for moving along the hoist way formed in the main frame;

a lift lifting and lowering drive means for lifting and lowering the lift;

a pallet installed in each parking room of each of said floors and being horizontally movable with respect to said lift;

a pallet actuating means installed on the lift for horizontally moving each pallet from each parking room to and from said hoist way, wherein said pallet actuating means includes a hooking member installed in the lift and horizontally moveable between each parking room and said hoist way, a driving means horizontally moving the hooking member; and an engaging member fixed to each pallet and driven by the pallet actuating means for thereby horizontally moving each pallet, wherein said engaging member is fixed to each pallet and includes a hooking roller to be hooked by said hooking member.

2. The system according to claim 1, wherein said lift further comprises:

a plurality of forks on which wheels of a vehicle are placed;

a hollow support frame to which the forks are fixed for support; and wherein said lift lifting and lowering drive means further comprise a motor;

a plurality of rotatable sheaves connected with the motor;

a rope having a first end connected with the support frame via one of the sheaves and wound or unwound by the sheaves for thereby lifting or lowering the support frame;

a balance weight connected with a second end of the rope;

a plurality of rollers rotatably supported by the support frame; and a plurality of vertical guide rails for guiding the rollers when the support frame is lifted or lowered.

3. The system according to claim 1, wherein said lift includes a guide rail for guiding the pallet when the pallet is horizontally moved.

4. The system according to claim 1, wherein said lift lifting and lowering drive means comprises:

a motor;

a plurality of rotatable sheaves connected with the motor;

a rope having a first end connected with a support frame via one of the sheaves and wound or unwound by the sheaves for thereby lifting and lowering the support frame;

a balance weight connected with a second end of the rope;

a plurality of rollers rotatably supported by the support frame; and a plurality of vertical guide rails for guiding the rollers when the support frame is lifted or lowered.

5. The system according to claim 1, wherein a number of said forks of the front side lift is larger than a number of said forks of the rear side lift.

6. The system according to claim 1, wherein said lift comprises:

a pair of rectangular lift frames having an opened upper center portion; and a plurality of forks extended from upper frames of the lift frames towards respective parking room sides of the hoist way, with an inner portion of the forks surrounded by a hollow lift frame, and wherein said lift lifting and lowering drive means further comprise a motor;

a plurality of rotatable sheaves connected with the motor;

a rope having a first end connected with the support frame through a one of the sheaves and wound or unwound by the sheaves for thereby lifting or lowering the support frame;

a balance weight connected with a second end of the rope;

a plurality of rollers rotatably supported by a support frame; and a plurality of vertical guide rails for guiding the rollers when the support frame is lifted or lowered.

7. The system according to claim 1, wherein each pallet comprises:

a rectangular frame having at least a pair of columns, with an inner portion surrounded by the frame being hollow;

a plurality of forks fixed to the columns of the frame and extended from the columns toward the hoist way or an opposite portion of the hoist way;

a plurality of rollers rotatably supported by both ends of each column; and a pair of guide rails slidably guiding said rollers and horizontally installed in each parking room.

8. The system according to claim 7, wherein said pair of guide rails protrude from each parking room toward the hoist way, said guide rails of each parking room being arranged at an interval shorter than a distance between the roller moving on the rails.

9. The system according to claim 7, wherein said guide rails include a pair of first guide rails installed in each parking room.

10. The system according to claim 7, wherein each of said guide rails installed in each parking room includes a roller stopping groove into which at least one of the rollers can fall into for stopping the roller.

11. The system according to claim 7, wherein guide rails are installed in the hoist way and each of said guide rails installed in the hoist way include a roller stopping groove.

12. The system according to claim 7, wherein each of said guide rails further comprise:

a first end portion and a second end portion;

a stopper fixed to an upper surface of said first portion of the guide rails positioned farther from the hoist way among said two end portions with respect to a horizontal direction of the guide rail for preventing an excessive movement of the rollers; and a buffering means installed at second end portion of each guide rail which is installed near the hoist way.

13. The system according to claim 1, wherein said parking means comprises:

a frame having a pair of C-shaped columns, wherein a first C-shaped column is disposed oppositely to a second C-shaped column;

one connection plate connected across the longitudinal center portion of the columns;

a plurality of rollers rotatably supported by both ends of each column;

a plurality of forks fixed to the columns and extended toward the hoist way or the opposite direction of the same; and a horizontally installed guide rail for slidably guiding the rollers thereon.

14. The system according to claim 1, wherein said pallet actuating means comprises:

a motor fixed to the frame of the lift;

a ball screw rotatably supported by the frame of the lift, connected with the motor and extending across the hoist way;

a nut member screwed to the ball screw and horizontally movable depending on a rotation of the ball screw; said hooking member connected with the nut member and horizontally moving together with the nut member; wherein the hooking member includes a circular column-shaped hooking member body having lower portions connected with the nut member and upwardly extended;

a lied down U-shaped extended member fixed with an upper portion of the hooking member body; and an upper hooker and a lower hooker fixed to an upper free end and a lower free end of the extended member, respectively, said hooking roller includes a pair of members to be hooked fixed on a lateral surface near the hoist way of each pallet and extended toward the hoist way.

15. The system according to claim 14, wherein said pallet actuating means further comprises:

sliding support members engaged with the hooking member bodies and slidably supporting the hooking member bodies for preventing shaking when the hooking member is horizontally moved; and a guide rod having two ends fixed to the frame of the lift for slidably and horizontally guiding the sliding support members, wherein a hollow is formed in the sliding support members, and the guide rod is inserted into the hollow, so that the sliding support members are slidably supported when placed on the guide rod.

16. The system according to claim 14, wherein said upper hookers and said lower hookers are formed of a U-shaped plate having opened upper and lower ends and an opened front or rear side surface, and said members to be hooked are formed of rollers inserted into the hookers for being hooked thereby.

17. The system according to claim 14, wherein said upper hookers and said lower hookers are formed of a U-shaped plate having opened upper and lower ends and an opened front or rear side surface, respectively, and said hooking roller is inserted into a U-shaped groove of the plate to be hooked for being hooked thereby.

18. The system according to claim 1, wherein said pallet actuating means further comprises:

a motor fixed to the frame of the lift;

a ball screw rotatably supported by the frame of the lift, connected with the motor and extending across the hoist way;

a nut member screwed to the ball screw and horizontally movable depending on a rotation of the ball screw; said hooking member connected with the nut member and horizontally moving together with the nut member; wherein the hooking member includes a circular column-shaped hooking member body having lower portions connected with the nut member and upwardly extended;

a horizontal support member having a center portion fixed to an upper portion of the hooking member body;

a pair of lied down U-shaped extended members fixed to both ends of the horizontal support member;

an upper hooker and a lower hooker fixed to both free ends of an upper portion and a lower portion of each of the extended members;

said driven means is fixed to a center portion of a lateral surface near the hoist way of the parking means and said hooking roller includes one member to be hooked protruding towards the hoist way.

19. The system of claim 18, wherein said pallet actuating means further comprises:

a sliding support member engaged with the hooking member body for preventing shaking motion when the hooking member is horizontally moved and slidably supporting the hooking member body; and a guide rod having two ends fixed to the frame of the lift for slidably and horizontally guiding the sliding support member, wherein a hollow is formed in the sliding support member, and the guide rod is inserted into the hollow, so that the sliding support member is slidably supported when placed on the guide rod.

20. The system according to claim 18, wherein said upper side hookers and said lower side hookers are formed of a U-shaped plate, said plate having opened upper and lower ends and an opened front side surface and an opened rear side surface, and wherein said members to be hooked are formed of rollers inserted into the hookers and hooked thereby.

21. The system according to claim 18, wherein said upper hookers and lower hookers are formed of a U-shaped plate having opened upper and lower ends and an opened front or rear side surface, respectively, and said hooking roller is inserted into a U-shaped groove of the plate to be hooked for being hooked thereby.

22. An elevator type parking system comprising:

a main frame having a plurality of vertical columns and horizontal columns for forming a hoist way in a center portion thereof;

a plurality of parking rooms positioned at opposite sides of the hoist way;

a lift moveable along the hoist way formed in the main frame;

a lift lifting and lowering drive means for lifting and lowering the lift;

a parking means installed in each floor of the parking room and being horizontally moveable with respect to said hoist way;

an actuating means installed on the lift for horizontally pulling the parking means from the parking room to the hoist way and pushing the parking means from the hoist way to the parking room;

a driven means fixed to the parking means and driven by the parking means actuating means for thereby horizontally moving the parking means;

a turntable installed at a lobby floor, in which a vehicle drives in and out, for changing a park direction of the vehicle loaded thereon;

a turntable horizontal movement means for horizontally moving the turntable between the hoist way and the parking room and a vertically movable footboard means;

wherein said vertically movable footboard means includes a footboard means installed in the lobby floor and capable of supporting a vehicle driver standing thereon when getting into or off the vehicle in order to load or unload the vehicle from the lift or the turntable, and for preventing said vehicle driver from falling down into the hoist way; a footboard installed between the lobby floor surface and the lobby floor hoist way capable of supporting a vehicle driver standing thereon; a footboard lifting and lowering guide means for guiding a lifting and lowering operation of the footboard and for preventing any interference with the turntable if the turntable is horizontally moved; and a footboard lifting and lowering drive means for lifting and lowering the footboard; and wherein said footboard lifting and lowering guide means includes a pair of support members each having one end perpendicularly fixed to a vertical column of the main frame and parallely extending from both sides of each footboard at a spaced-apart position; a pair of guide rails each having one end fixed to an end portion of the support members and extending from an upper portion to a floor surface of the lobby floor; a guide roller rotatably installed at a predetermined portion of both sides of the footboard; and a roller support member perpendicularly installed at a predetermined portion of both sides of the footboard for rotatably supporting the guide roller.

23. The system according to claim 22, wherein said footboard lifting and lowering drive means comprises:

a driving motor mounted at a first support member of said pair of support members; and a driving chain being rotatable by a driving force of the driving motor and fixed to an upper portion of a first roller support member of said roller support members.

* * * * *